US010219591B2

(12) United States Patent
Hatanaka et al.

(10) Patent No.: US 10,219,591 B2
(45) Date of Patent: Mar. 5, 2019

(54) ATTACHMENT SYSTEM FOR AN ELECTRONIC DEVICE

(71) Applicant: Apple Inc., Cupertino, CA (US)

(72) Inventors: Motohide Hatanaka, Tokyo-to (JP); Fletcher R. Rothkopf, Cupertino, CA (US); Eiryo Shiraishi, Tokyo-to (JP); Osamu Yabe, Cupertino, CA (US); Hsiang Hung Chen, Shenzhen (CN)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/415,761

(22) Filed: Jan. 25, 2017

(65) Prior Publication Data

US 2017/0265607 A1 Sep. 21, 2017

Related U.S. Application Data

(60) Provisional application No. 62/311,399, filed on Mar. 21, 2016.

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01)

(58) Field of Classification Search
CPC ..... A44C 5/14; G04B 37/1486
See application file for complete search history.

(56) References Cited

U.S. PATENT DOCUMENTS

| | | | |
|---|---|---|---|
| 1,498,070 | A | 6/1924 | Beucke |
| 1,498,109 | A | 6/1924 | Mulholland |
| 1,704,795 | A | 3/1929 | Heileman |
| 2,126,263 | A | 8/1938 | Kestenman |

(Continued)

FOREIGN PATENT DOCUMENTS

| | | |
|---|---|---|
| CN | 2052214 | 2/1990 |
| CN | 1147358 | 4/1997 |

(Continued)

OTHER PUBLICATIONS

Author Unknown, "Ikepod Wristwatches by Mark Newson," http://www.dezeen.com/2007/12/10/ikepod-wristwatches-by-marc-newson/, 32 pages, Dec. 10, 2007.

(Continued)

*Primary Examiner* — Victor D Batson
*Assistant Examiner* — David M Upchurch
(74) *Attorney, Agent, or Firm* — Morgan, Lewis & Bockius LLP

(57) ABSTRACT

Embodiments are directed to an attachment system for a consumer product and methods related to the manufacture thereof. In one aspect, an embodiment includes an attachment system including a band having an insert portion. The insert portion may include an aperture. The attachment system may further include a lug having a cavity and a friction element disposed at, and extending away from, an outer surface of the lug to define a protrusion. The attachment system may further include a pin and a retention member positioned within the cavity. The retention member may be configured to retain the pin within the aperture upon advancement of the pin past the retention member.

20 Claims, 33 Drawing Sheets

(56) References Cited

U.S. PATENT DOCUMENTS 2,346,887 A 4/1944 Winkler
2,408,279 A 9/1946 Valcourt
2,505,044 A 4/1950 Heinrich
2,518,551 A 8/1950 Jaccarino
2,536,007 A 12/1950 Milner
2,948,941 A * 8/1960 Bruhn ..... A44C 5/14 24/265 B
3,293,714 A 12/1966 Shafer
3,376,616 A 4/1968 Kaczorowski
3,578,208 A 5/1971 Herzog
3,589,341 A 6/1971 Krebs
3,675,284 A 7/1972 Rieth
3,707,744 A * 1/1973 Manzo ..... A44C 5/14 24/265 B
3,740,804 A 6/1973 Levinger
3,747,171 A 7/1973 Montague, Jr.
3,818,552 A * 6/1974 Droz ..... A44C 5/14 24/265 B
RE28,793 E 5/1976 Bert
4,069,953 A 1/1978 Vetter
4,136,805 A 1/1979 Storms
4,178,751 A 12/1979 Liautaud
4,249,267 A 2/1981 Voss
4,326,321 A 4/1982 Colognori
4,414,714 A 11/1983 Kostanecki et al.
4,432,655 A * 2/1984 Wollman ..... G04B 37/1486 224/164
4,447,238 A 5/1984 Eldridge, Jr.
4,615,185 A 10/1986 Bollinger
D305,743 S 1/1990 Hirsch
4,903,253 A 2/1990 Nikles et al.
4,941,236 A 7/1990 Sherman et al.
5,130,899 A 7/1992 Larkin et al.
5,146,437 A 9/1992 Boucheron
5,168,281 A 12/1992 Tokunaga
5,244,134 A 9/1993 Riley
5,305,503 A 4/1994 Yamagata
5,307,582 A 5/1994 Quintel
5,668,784 A 9/1997 Iguchi
5,788,400 A * 8/1998 Wey ..... F16B 7/0413 24/589.1
5,914,913 A 6/1999 Shriqui
5,930,873 A 8/1999 Wyser
5,951,193 A 9/1999 Yamamoto et al.
6,067,692 A 5/2000 Chang
6,163,938 A 12/2000 Weber-Unger
6,170,131 B1 1/2001 Shin
6,179,025 B1 1/2001 Sutton
6,292,985 B1 9/2001 Grunberger
6,311,373 B1 11/2001 Hashimoto
6,481,069 B1 * 11/2002 Cheng ..... A44C 5/2038 24/537
6,505,385 B2 1/2003 Grunberger
6,588,069 B2 7/2003 Deriaz et al.
6,598,271 B2 7/2003 Nire
6,606,767 B2 8/2003 Wong
6,647,597 B2 11/2003 Reiter
6,678,898 B2 1/2004 Jones et al.
6,701,580 B1 3/2004 Bandyopadhyay
6,726,070 B2 4/2004 Lautner
6,746,058 B2 6/2004 Kienzler
7,243,824 B2 7/2007 Tabata
7,249,398 B2 7/2007 Roy
7,296,752 B2 11/2007 Carnevali
7,363,687 B2 4/2008 Kraus et al.
7,373,696 B2 5/2008 Schoening et al.
7,451,528 B2 11/2008 Sima
7,509,712 B2 * 3/2009 Sima ..... A44C 5/147 24/265 WS
7,618,260 B2 11/2009 Daniel et al.
7,640,632 B2 1/2010 Lazarus
7,806,309 B2 10/2010 Korchmar
7,810,683 B2 10/2010 Chan
7,905,039 B2 3/2011 Karovic
8,088,043 B2 1/2012 Andren et al.
8,091,261 B2 1/2012 Chadwick
8,261,416 B2 9/2012 Rothbaum et al.
8,316,515 B2 11/2012 Slank
8,328,055 B1 12/2012 Snyder
8,471,658 B2 6/2013 Fullerton et al.
8,474,669 B2 7/2013 Rohrbach et al.
8,486,481 B2 7/2013 Giuseppin et al.
8,573,458 B1 11/2013 Hamilton
8,578,569 B1 11/2013 Karnoski et al.
8,615,849 B2 12/2013 Rothbaum
8,662,362 B1 3/2014 Bastian et al.
8,787,006 B2 7/2014 Golko et al.
8,789,246 B2 7/2014 Yliluoma et al.
8,857,683 B2 10/2014 Cameron et al.
8,967,437 B2 3/2015 Wilson
9,003,611 B2 4/2015 Catanese
9,049,894 B2 6/2015 Wong
9,101,184 B2 8/2015 Wilson
9,245,678 B2 1/2016 Fiedler
9,258,670 B2 2/2016 Goyal et al.
9,314,092 B2 4/2016 Wang et al.
9,351,551 B2 5/2016 Morgan et al.
9,357,817 B2 6/2016 Lee et al.
9,392,829 B2 7/2016 Manuello
D798,189 S 9/2017 Nielsen et al.
9,826,789 B2 11/2017 Dey et al.
2005/0102802 A1 5/2005 Sitbon et al.
2005/0265132 A1 * 12/2005 Ho ..... G04B 37/1486 368/282
2006/0156520 A1 7/2006 Meranto
2006/0186150 A1 8/2006 Willows et al.
2006/0254105 A1 11/2006 Chang
2007/0028429 A1 2/2007 Ishida
2007/0070823 A1 3/2007 Sima
2007/0279852 A1 12/2007 Daniel et al.
2008/0210722 A1 * 9/2008 Ishihara ..... A44C 5/14 224/180
2009/0020570 A1 1/2009 Chan
2009/0133438 A1 5/2009 Stampfli et al.
2009/0265832 A1 10/2009 Clement
2010/0200627 A1 8/2010 Shen
2010/0258601 A1 10/2010 Thrope
2010/0032462 A1 11/2010 Cameron et al.
2010/0327030 A1 12/2010 Yang
2011/0083254 A1 4/2011 Trutna et al.
2011/0309121 A1 12/2011 Dooley et al.
2012/0152990 A1 6/2012 Kulas
2013/0086774 A1 4/2013 Krasinski et al.
2013/0205476 A1 8/2013 Gentile et al.
2013/0326790 A1 12/2013 Cauwels et al.
2016/0003269 A1 1/2016 Russell-Clarke et al.
2016/0010673 A1 1/2016 Russell-Clarke et al.
2016/0025119 A1 1/2016 Russell-Clarke et al.
2016/0037878 A1 2/2016 Yabe et al.
2016/0040695 A1 * 2/2016 Perkins ..... A44B 17/0011 403/376
2016/0058375 A1 3/2016 Rothkopf
2016/0069371 A1 3/2016 Chen et al.
2016/0128209 A1 5/2016 Yoon et al.
2016/0154425 A1 6/2016 Yang et al.
2016/0192526 A1 6/2016 Gao et al.
2016/0215799 A1 8/2016 Ely et al.
2016/0261037 A1 9/2016 Chen et al.
2016/0278203 A1 9/2016 Nakayama
2017/0086538 A1 3/2017 Siahaan

FOREIGN PATENT DOCUMENTS

CN 1236583 A 12/1999
CN 2575724 9/2003
CN 200983868 12/2007
CN 201709560 1/2011
CN 102202533 9/2011
CN 202026953 11/2011
CN 202587325 12/2012
CN 202664274 1/2013
CN 202704189 1/2013
CN 103376734 A 10/2013

(56) References Cited

FOREIGN PATENT DOCUMENTS

| | | | |
|---|---|---|---|
| CN | 103488076 | | 1/2014 |
| CN | 203407616 | U | 1/2014 |
| CN | 105371076 | A | 3/2016 |
| EP | 2098131 | | 3/2009 |
| EP | 2633776 | | 9/2013 |
| FR | 1291875 | | 4/1962 |
| FR | 2492238 | | 4/1982 |
| FR | 2532239 | | 3/1984 |
| GB | 464417 | | 4/1937 |
| GB | 1491532 | | 11/1977 |
| GB | 2113975 | | 8/1983 |
| GB | 2355281 | | 4/2001 |
| JP | H06189814 | | 7/1994 |
| JP | 2001-060997 | A | 3/2001 |
| JP | 2005143988 | | 6/2005 |
| JP | 2005318247 | | 11/2005 |
| JP | 2006102026 | | 4/2006 |
| JP | 3134581 | | 8/2007 |
| JP | 2009-124652 | A | 6/2009 |
| JP | 2012-248580 | A | 12/2012 |
| KR | 200320475 | | 7/2003 |
| KR | 200396918 | | 9/2005 |
| WO | WO2010/036090 | | 4/2010 |
| WO | WO2011/0048344 | | 4/2011 |
| WO | WO2012/160195 | | 11/2012 |

OTHER PUBLICATIONS

Author Unknown, "Tajan," http://www.tajan.com/pdf/7812.pdf, 2 pages, Dec. 10, 2007.

Author Unknown, v2.0 Ikepod Has Landed . . . again . . . , http://qp.granularit.com/media/38876/QP24_Ikepod.pdf, 3 pages, at least as early as Apr. 25, 2015.

U.S. Appl. No. 15/273,657, filed Sep. 22, 2016, pending.

Chinese Utility Model Patent Evaluation Report (UMPER) from Chinese Patent Application No. ZL201720276345.9, dated May 16, 2018, 17 pages.

* cited by examiner

ATTACHMENT SYSTEM FOR AN ELECTRONIC DEVICE

CROSS-REFERENCE TO RELATED APPLICATION(S)

This application is a nonprovisional patent application of and claims the benefit of U.S. Provisional Patent Application No. 62/311,399, filed Mar. 31, 2016 and titled "Attachment System for an Electronic Device," the disclosure of which is hereby incorporated herein by reference in its entirety.

FIELD

The present disclosure is generally directed to an attachment system for coupling two objects together and, more specifically, to an attachment system for a consumer product.

BACKGROUND

A wearable consumer product may be attached to a user in a variety of manners. Many traditional systems for attaching a consumer product to a user may be difficult or cumbersome. Additionally, traditional systems may attach a consumer product to a user in a manner that is not aesthetically pleasing.

SUMMARY

Embodiments of the present disclosure are directed to an attachment system for a consumer product.

In a first aspect, the present disclosure includes an attachment system. The attachment system includes a band having an insert portion. The attachment system includes an aperture within the insert portion. The attachment system further includes a lug having a cavity. The attachment system further includes a friction element disposed at, and extending away from, an outer surface of the lug and defining a protrusion. The attachment system further includes a pin. The attachment system further includes a retention member positioned within the cavity. The attachment system may be configured to retain the pin within the aperture upon advancement of the pin past the retention member.

A number of feature refinements and additional features are applicable in the first aspect and contemplated in light of the present disclosure. These feature refinements and additional features may be used individually or in any combination. As such, each of the following features that will be discussed may be, but are not required to be, used with any other feature combination of the first aspect.

For example, in an embodiment, the retention member may include a tapered surface extending between a first width and a second width of the cavity. The second width of the cavity may be less than a length of the pin. In this regard, the length of the pin may be elastically deformable to the second width of the cavity. In some cases, the cavity of the attachment system may include a groove disposed adjacent the retention member and configured to receive the pin. Accordingly, the pin may return to an undeformed shape upon the receipt of the pin by the groove.

In another embodiment, the friction element of the attachment system may include a flange. The friction element may be connected to the lug at the flange. Additionally or alternatively, the friction element may include an anchor pin. The friction element may be connected to the lug at the anchor pin.

According to another embodiment, the friction element may be a first friction element and the protrusion may be a first protrusion. In this regard, the attachment system may further comprise a second friction element disposed at, and extending away from, the outer surface of the lug to define a second protrusion. The attachment system may further comprise a catch member disposed between the first friction element and the second friction element at the outer surface. The catch member may be configured to move from a first position to a second position as the lug slides relative to a consumer product. In some instances, the friction element may include a shaft extending into the cavity of the lug. Accordingly, the insert portion may be configured to receive the shaft when the pin is advanced past the retention member.

In this regard, a second aspect of the present disclosure includes a method for assembling an attachment system for an electronic device. The method includes inserting a sleeve into a channel of an attachment structure. The method further includes attaching the sleeve to the lug. The method includes advancing a band into the sleeve. The band may include an engagement member configured to affix the band and the sleeve upon the advancement of the band into the sleeve. The method further includes securing a friction element at an outer surface of the attachment structure.

A number of feature refinements and additional features are applicable in the second aspect and contemplated in light of the present disclosure. These feature refinements and additional features may be used individually or in any combination. As such, each of the following features that will be discussed may be, but are not required to be, used with any other feature combination of the second aspect.

For example, in an embodiment, the band may include an insert portion having an aperture and the engagement member may include a pin disposed within the aperture. In this regard, the advancing may include contactably engaging the pin with an interface surface of the sleeve. The contactable engagement of the pin with the interface surface of the sleeve may prevent movement of the band relative to the attachment structure.

According to another embodiment, the method may further include welding the sleeve to the band at the engagement member. In some instances, the band may include an insert portion having a pattern of apertures. Further, the engagement member may include a plate having a pattern of fingers disposed within the pattern of apertures.

In this regard, a third aspect of the present disclosure includes a method for reinforcing a strap. The method includes placing a woven strap adjacent a metal sheet. The metal sheet may include a securement mechanism. The method further includes inducing a flow of electrical current across a segment of the metal sheet such that the metal sheet produces heat to melt at least a portion of the woven strap. The method further includes causing the melted portion of the woven strap to flow toward the securement mechanism for bonding of the woven strap and the metal sheet.

A number of feature refinements and additional features are applicable in the third aspect and contemplated in light of the present disclosure. These feature refinements and additional features may be used individually or in any combination. As such, each of the following features that will be discussed may be, but are not required to be, used with any other feature combination of the third aspect.

For example, in an embodiment, the securement mechanism may be an opening. Further, the woven strap may be a hollow woven strap configured to encircle the metal sheet.

In another embodiment, the causing may include compressing the woven strap and the metal sheet with a non-metal fixture. In some instances, the woven strap may include a first surface and a second surface. Accordingly, the second surface of the woven strap may not be melted by the flow of electrical current across the metal sheet.

In this regard, a fourth aspect of the present disclosure includes a method for assembling an over-molded attachment system. The method includes placing a band within a form. The band may include a securement mechanism. The method further includes causing material to flow into the form and toward the securement mechanism to define a housing enveloping a portion of the band for bonding of the band and the housing. The method further includes creating an aperture within a region of the band that is vertically aligned with an opening of the housing. The method further includes positioning a friction element within the aperture and the opening such that at least a portion of the friction element protrudes from an outer surface of the housing.

A number of feature refinements and additional features are applicable in the fourth aspect and contemplated in light of the present disclosure. These feature refinements and additional features may be used individually or in any combination. As such, each of the following features will be discussed may be, but are not required to be, used with any other feature combination of the fourth aspect.

For example, in an embodiment, the securement mechanism may be a groove. Additionally or alternatively, the securement mechanism may be a pin extending from a surface of the band.

In another embodiment, the material may be an injection-moldable plastic. In some instances, the method further includes, before the causing, positioning a plate adjacent the band. The plate may have a greater stiffness than the band.

According to another embodiment, the material is a first material, the housing is a first housing, and the form is a first form. In this regard, the method may further include placing the first housing into a second form. The method may further include causing a second material to flow into the second form to define a second housing enveloping the first housing. In some instances, the second housing may include a different stiffness than the first housing.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
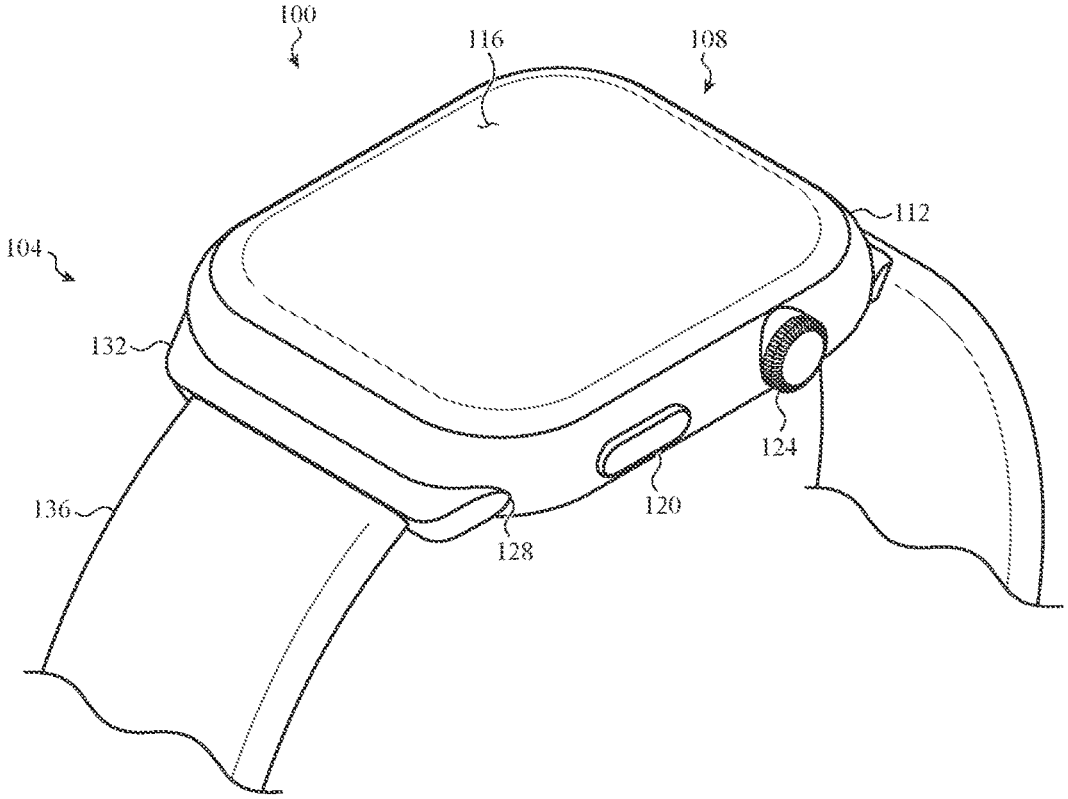
FIG. 1 illustrates an example consumer product that may utilize an attachment system.

The description that follows includes sample systems, methods, and apparatuses that embody various elements of the present disclosure. However, it should be understood that the described disclosure may be practiced in a variety of forms in addition to those described herein.

The present disclosure describes systems, devices, and techniques related to an attachment system for a consumer product. The attachment system may attach a consumer product to a user. In one instance, this may include attaching a wearable device (e.g., including an electronic or non-electronic device) to the wrist of a user. The attachment system may include a substantially rigid component configured to removeably engage the attachment system with a consumer product. The attachment system may also include a substantially flexible component that is non-separably interlocked with the rigid component. The term "non-separable," or variants thereof, means that associated components, elements, or the like are permanently affixed to one another, and/or are not intentionally separable. The flexible component may include one or more features to attach the consumer product to the user.

The attachment system may be used as an accessory for a consumer product. In one implementation, the attachment system may be interchangeable with a variety of consumer products. This may allow the attachment system to be used with an ecosystem of consumer products that includes a common engagement structure. The common engagement structure may be configured for removable engagement with any one of a group of attachment systems described herein. Accordingly, the group of attachment systems may be interchangeable with the ecosystem of consumer products. In this manner, different ones of the group of attachment systems may be interchanged with a given consumer product based on a user's preferences.

In some instances, it may be useful to interchange attachment systems to aesthetically, structurally, and/or functionally enhance the consumer product. The attachment system may be removeably engaged with a consumer product. In particular, the attachment system may be removeably engageable with a consumer product while maintaining a non-separable interlock between the flexible component and the rigid component of the attachment system. The rigid component may therefore include one or more features (e.g., including a catch member, various friction elements, or the like, described in greater detail below) that facilitate the removeable engagement of the attachment system with the consumer product. Further, the rigid component may include one or more features (e.g., including a cavity having a retention member, receiving groove, or the like, described in greater detail below) that may affix or non-separably interlock the rigid component and flexible component. As such, the rigid component may form a connection between the flexible component and the consumer product. In some instances, the rigid component may have a greater material stiffness as compared to the flexible component, thereby providing a reinforced connection between the flexible component and the consumer product.

The rigid component and the flexible component may be non-separably interlocked in a manner that maintains the aesthetic properties (e.g., color, texture, shape, etc.) of the attachment system. For example, a portion of the flexible component may be received within a cavity of the rigid component. The portion of the flexible component received within the cavity may be non-separably interlocked with the rigid component at a location within the cavity. The non-separably interlocked connection of the flexible component and the rigid component may be concealed from the user. This may create the appearance of a seamless connection between the flexible component and the rigid component.

In some example embodiments, the flexible component may include a band, strap, or other feature attachable to a user. The band may be a fabric or textile band, lanyard strap, or the like formed from any appropriate material (e.g., nylon, fluroelastomeric polymer, or other suitable polymer). The insert portion may be defined by a segment of the band that is received by the rigid component. In some cases, the insert portion may be defined as two prongs extending from a side surface of the band. For example, the insert portion may be received within a cavity of the rigid component to non-separably interlock the flexible component and the rigid component. In this regard, the insert portion may include one or more features configured to non-separably interlock the rigid component and the flexible component, including, for example, one or more apertures. In one example embodiment, the apertures may be coupled with a pin that projects into the cavity of the rigid component when the rigid component receives the insert portion. This may non-separably interlock the flexible component and the rigid component.

In an illustrative embodiment, the rigid component may be a lug, attachment structure, housing, or other structure. The lug may be a metallic or non-metallic structure having a material stiffness greater than the band. The lug provides a connection between the band and, for example, a consumer product. In particular, the lug may define a structure configured for removable engagement with the consumer product, while maintaining a non-separable interlock with the band.

To facilitate the foregoing, the lug may include a retention member contained at least partially within a cavity of the lug. The retention member may include various structural features to non-separably interlock the band and the lug. In one embodiment, the retention member may include a tapered surface extending between a first width and a second width of the cavity. The first width may substantially correspond to a height of a pin disposed within an aperture of the band. The second width may substantially correspond to a height of the insert portion of the band. In this regard, the pin may be elastically deformed as the pin is advanced (while being disposed within the insert portion) past the retention member (e.g., due to the second width being less than the height of the pin).

A groove positioned within the cavity may receive the pin (e.g., upon the advancement of the pin past the retention member). The pin may return to an undeformed state within the groove. Accordingly, the retention member may retain the pin within the cavity due in part to the second width of the tapered surface being less than an undeformed height of the pin. This may cause the retention member to restrict movement of the band by forming a barrier between the pin (disposed within an aperture of the band) and an entrance to the cavity. Additionally or alternatively, an adhesive layer may be applied within the cavity (e.g., within the groove) to secure the pin to a surface of the cavity.

The lug may also include one or more features configured to removeably engage the attachment system with the consumer product. As one non-limiting example, the lug may be coupled with a spring-biased mechanism at least partially disposed at an outer surface of the lug. A portion of the spring-biased mechanism may be configured to move from a first position to a second position as the lug slides relative to the consumer product. In one embodiment, the second position of the spring-biased mechanism may define a protrusion extending from the outer surface of the lug. The protrusion may be received by an aperture, groove, or other appropriate mechanism of the consumer product to removeably engage the lug and the consumer product. The receipt of the spring-biased mechanism by the consumer product may couple the attachment system to the consumer product until, for example, the spring-biased mechanism is released or otherwise disengaged from the consumer product.

As another example, one or more friction elements or alignment features may be disposed on the outer surface of the lug. The friction elements may define a protrusion extending away from the outer surface of the lug. The friction elements may be configured to form a friction or interference fit with a channel or other receiving aperture of the consumer product. This may allow the friction element to align the lug with the consumer product (e.g., by maintaining a spacing between the lug and the consumer product). In some implementations, the friction elements may include one or more features (e.g., such as a shaft, flange, anchor pin, or the like) that may extend into the lug and optionally couple with one or more features of the band and/or lug.

The attachment systems described herein may include one or more elements that facilitate the non-separable interface between the lug and the band. As one example, a sleeve may be positioned between the lug and the band. The sleeve may be coupled to the cavity and configured to receive the insert portion of the band. In some instances, the sleeve may be welded to the lug. One or more pins may be disposed within apertures of the insert portion such that the pins extend beyond a surface of the insert portion. The pins may engage an interior surface of the sleeve upon advancement of the insert portion into the cavity. In some instances, the pin may form an interference or friction fit with the sleeve. The friction or interference fit between the pin and the interior surface of the sleeve non-separably interlocks the band and the lug.

In some instances, it may be desirable to couple the band with a reinforcement member to structurally reinforce the band. For example, the portions of the band surrounding the one or more apertures of the insert portion may be subject to enhanced material stresses, for example, caused by forces associated with wear and tear, etc. A reinforcement member having a greater material stiffness than the band may provide structural support to selectively identified segments of the band (e.g., such as the area surrounding the one or more apertures), thereby enhancing the longevity of the attachment system.

Accordingly, embodiments described herein relate to a method for reinforcing a band, strap, or other feature attachable to user (e.g., such as a band formed from the flexible component described above). To facilitate the foregoing, the band may be disposed adjacent a metal sheet. The metal sheet may define a reinforcement member. The reinforcement member may structurally reinforce the band. The metal sheet may include at least one securement mechanism (e.g., an aperture, protrusion, and/or other feature of the metal sheet) configured to receive a portion of the adjacently disposed band. A flow of electrical current may be induced across the metal sheet to produce heat to melt at least a portion of the band. The melted portion of the flexible band may flow toward (and be received by) the securement mechanism (e.g., due to a compressive force applied to the surface of the flexible band) to bond the band and the metal sheet.

The metal sheet may be joined to the band in a manner that maintains the aesthetic properties of the band (e.g., in a manner that renders the band substantially free of surface defects and/or other imperfections indicative of the joining process). In one implementation, a portion of the band disposed adjacent the metal sheet may be caused to melt. This may prevent a portion of the band opposite the metal sheet from melting by the induced flow of electrical current. As such, the non-melted portions of the flexible band may be substantially free of defects, notwithstanding the joining of the band to the metal sheet.

In certain other embodiments, it may be desirable to directly attach (e.g., via welding) the band to the lug. This may be accomplished, in one embodiment, by positioning a portion of a reinforcement member (coupled with the band according to the techniques described herein) to extend beyond the perimeter of the band. The portion of the reinforcement member that extends beyond the perimeter of the band may be received by an aperture and/or any other appropriate structure of the lug. A welded connection may be formed between the reinforcement member and the aperture. This may non-separably interlock the band to the lug.

In another embodiment, the lug may be an over-molded component. The lug may be constructed from an injection-moldable plastic that is molded over the band. To attach the band to the lug, the band may be placed within a form that may substantially define the shape of the lug. Material (e.g., injection-moldable plastic and/or any other suitable polymers) may flow into the form and towards the band to create a lug that envelops a portion of the band within the form. In some instances, the band may include a securement mechanism (e.g., an aperture, protrusion, and/or other feature of the band) to facilitate the bonding of the band and the material. For example, the band may include a recess such that material introduced into the form is directed toward the recess to affix the band and the material. Additionally or alternatively, the over-molded lug may be coupled with various features configured to removeably engage the attachment system with the consumer product (e.g., such as a catch member, friction elements, and/or the like).

Reference will now be made to the accompanying drawings, which assist in illustrating the various features of the present disclosure. The following description is presented for purposes of illustration and description. Furthermore, the description is not intended to limit the inventive aspect to the forms disclosed herein. Consequently, variations and modifications commensurate with the following teachings, and skill and knowledge of the relevant art, are within the scope of the present inventive aspect.

FIG. 1 depicts an example system 100 including an attachment system 104, such as the attachment system generally discussed above and described in more detail below. The attachment system 104 includes a lug configured for removable engagement with a consumer product 108. It will be appreciated that the lug may be an attachment structure, housing, or other structure configured to removeably engage with a consumer product.

The attachment system 104 may be used with a variety of consumer products. Some example consumer products may include an electronic device, a mechanical device, an electromechanical device, or the like. In one example, the consumer product may be a wearable product, including watches, glasses, rings, or the like. Other examples of the consumer products may include mobile phones, personal digital assistants, music players, timekeeping devices, health monitoring devices, tablet computers, portable storage devices, or the like. Although the above examples include electronic devices, the attachment system 104 may be used with non-electronic devices, including purely mechanical timepieces, luggage, purses, jewelry, or the like.

For purposes of illustration, FIG. 1 depicts a consumer product 108 including a device housing 112; a display 116; one or more input/output members 120; a crown 124; and a channel 128. It should be noted that the consumer product 108 may also include various other components, such as one or more ports (e.g., charging port, data transfer port, or the like), additional input/output buttons, and so on. As such, the discussion of any consumer product, such as consumer product 108, is meant as illustrative only.

As further illustrated in FIG. 1, the attachment system 104 may include a lug 132 configured for removable engagement with the consumer product 108. The lug 132 may be an attachment structure, housing, or the like and may include (or be coupled with) a spring-biased mechanism (not shown in FIG. 1), described in greater detail below. The spring-biased mechanism may removeably engage the attachment system 104 with the consumer product 108. As shown in FIG. 1, the lug 132 may be at least partially received within the channel 128 of the consumer product 108. The spring-biased mechanism may at least partially extend from an outer surface of the lug 132 to engage a corresponding receiving structure of the channel 128 (e.g., including a corresponding receiving aperture, recess, or the like). This may allow the lug 132 to be coupled to the consumer product 108 until the spring-biased mechanism is released or otherwise disengaged from the consumer product 108, according to the embodiments described herein.

The attachment system 104 may also include a band 136. The band 136 may be non-separably interlocked with the lug 132. The band 136 may include an insert portion (not shown in FIG. 1) that is received by a cavity of the lug 132. The insert portion of the band 136 may be coupled with one or more features (e.g., including a pin, sleeve, plate, or the like, described in greater detail below) configured to non-separably interlock the band 136 and the lug 132. The band 136 may be a fabric or textile band, lanyard, strap, or the like formed from any appropriate material (e.g., including nylon, fluroelastomeric polymer, or other suitable polymers). More broadly, the band 136 may be any appropriate "soft good" material that exhibits sufficiently compliant and flexible characteristics. For example, the band 136 may be sufficiently elastic or resilient such that the band 136 does not permanently deform from applied force. (e.g., the band 136 may substantially return to an original or un-deformed shape after the force ceases). The band 136 may not be limited to the above exemplary materials, and may also include any other appropriate materials consistent with the various embodiments presented herein, including silicone, plastic or other flexible materials.

The lug 132 may be constructed from any sufficiently rigid material. In one embodiment, the lug 132 may be formed from a material having a greater material stiffness than the band 136. The lug 132 may be a metallic component, including stainless steel, aluminum, or other metals or metal alloys having a greater material stiffness than the band 136. Additionally or alternatively, the lug 132 may be formed substantially from a plastic component. As one example, the lug 132 may be formed from a hardened injection-moldable plastic.

FIGS. 2A-2D illustrate various views and components of an attachment system 200, according to one or more embodiments of the present disclosure. The attachment system 200 shown and described with respect to FIGS. 2A-2D may be substantially analogous to the attachment system 104 described above with respect to FIG. 1. For example, the attachment system 200 may be configured for removable engagement with a consumer product (e.g., such as the consumer product 108 depicted in FIG. 1). Further, the attachment system 200 may include a substantially flexible component and a substantially rigid component. Specific shapes and orientations are described below with respect to the attachment system 200 and the various components of the attachment system 200. However, the disclosed shapes and orientations of the attachment system 200, and its associated components, are not limiting and are used as examples. Accordingly, similar shapes and orientations of the attachment system 200, and its associated components, described below with respect to FIGS. 2A-2D may be used with the various embodiments of the attachment system described herein.

Figure 2A:
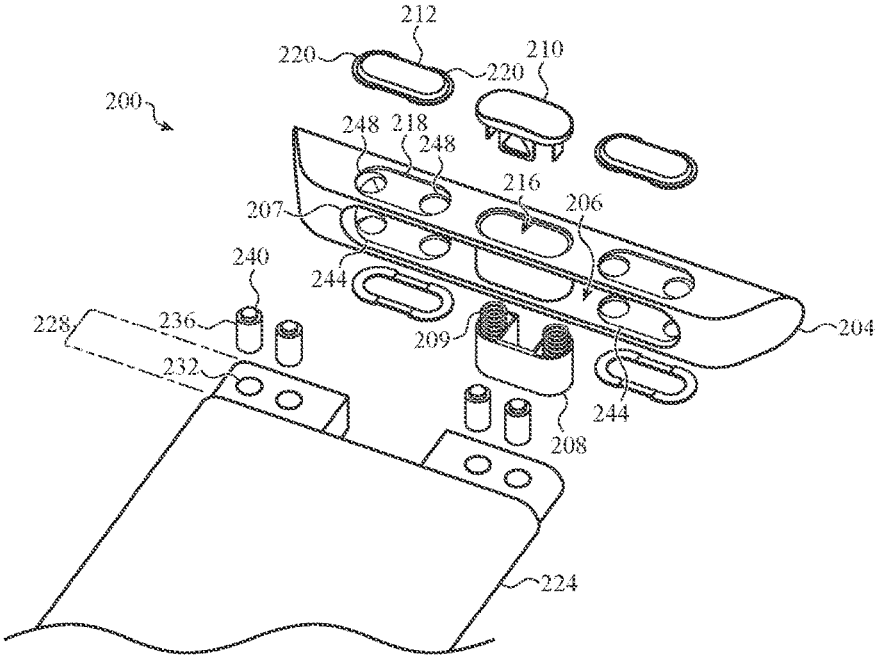
FIG. 2A illustrates an exploded view of an example attachment system.

FIG. 2A illustrates an exploded view of the attachment system 200, according to one or more embodiments of the present disclosure. The attachment system 200 may include a lug 204. As described above, the lug 204 may be an attachment structure, housing, or other appropriate structure configured to removeably engage with a consumer product. A cavity 206 may be defined within an internal volume of the lug 204. As such, the lug 204 may be a substantially hollow structure. The lug 204 may be configured for removable engagement with the consumer product 108 while maintaining a non-separable interlock between the lug 204 and a flexible component of the attachment system 200 (e.g., such as a band, strap, or other feature that is attachable to a user, as described in greater detail below).

The lug 204 may have an elongated and rounded shape that is configured to be at least partially received by a receiving structure of the consumer product 108 (e.g., such as channel 128 depicted in FIG. 1). The lug 204 may be coupled with one or more features to facilitate the removable engagement of the lug 204 with the consumer product 108.

For example, as depicted in FIG. 2A, the lug 204 may be coupled with a catch member 208, a ramp 210, and friction elements 212.

The catch member 208 and the ramp 210 may together define a spring-biased locking mechanism that is configured to removeably engage the lug 204 with the consumer product 108. In one embodiment, the catch member 208 and the ramp 210 may be disposed at opposing external surfaces of the lug 204. The lug 204 may include port 216 that extends between the opposing external surfaces of the lug 204. The port 216 may be configured to receive the catch member 208 and the ramp 210 for coupling of the catch member 208 and the ramp 210 to the lug 204. The lug 204 may include biasing springs 209 that may be positioned within the port 216 and extend between the catch member 208 and the ramp 210 in an assembled configuration. In the assembled configuration, the catch member 208 may be substantially flush against a first surface of the lug 204 and the ramp 210 may protrude from the opposing, second surface of the lug 204.

The biasing springs 209 may be engaged with each of the catch member 208 and the ramp 210 such that the catch member 208 is biased away from the ramp 210. Thus, when the ramp 210 moves in a direction toward the catch member 208 (and the catch member 208 is not prevented from expanding), the biasing springs 209 may cause the catch member 208 to move in a direction away from the ramp 210. This may cause the catch member 208 to be biased to protrude from an external surface of the lug 204 upon the advancement of the ramp 210 towards the catch member 208.

In one implementation, the insertion of the lug 204 into the channel 128 of the consumer product 108 may cause the biasing springs 209 to compress. To illustrate, the insertion of the lug 204 into the channel 128 may cause the ramp 210 to move towards the catch member 208 while the channel 128 prevents the catch member 208 from expanding. Upon further advancement into the channel 128, the catch member 208 may be allowed to expand into a recess of the channel 128. The expansion of the catch member 208 into the recess of the consumer product 108 may cause the lug member 204 to removeably engage the consumer product 108 (e.g., movement of the lug 204 may be restricted upon the expansion of the catch member 208 into the recess).

The lug member 204 may be removed from the consumer product 108 by causing the catch member 208 to move towards the ramp 210 such that the catch member 208 is no longer received by the recess of the channel 128. For instance, in some embodiments, the recess of the channel 128 may be a through portion. This may allow a surface of the catch member 208 to receive a force that moves the catch member 208 towards the ramp 210. Upon the movement of the catch member 208 towards the ramp 210 (e.g., such that the catch member 208 is no longer received by the recess), the movement of the lug member 204 may be substantially unrestricted. Accordingly, the lug member 204 may be slideably removed from the channel to facilitate the removable engagement of the attachment system 200 with the consumer product 108.

The lug 204 may also by coupled with friction elements 212. The friction element may be an alignment feature that is configured to maintain a spacing between, for example, the lug 204 and an associated consumer product. Friction elements 212 may be disposed on, and protrude from, one or more exterior surfaces of the lug 204. The friction elements 212 may be configured to maintain a spacing between the lug member 204 and the channel 128 of the consumer product 108. The friction elements 212 may form a friction or interference fit between the lug 204 and an interior surface of the channel 128. As depicted in FIG. 2A, each of the friction elements 212 may include substantially similar components. However, individual ones of the friction elements 212 may include any appropriate components, including different or varying components, according to the embodiments described herein.

The friction elements 212 may be coupled to an outer surface of the lug 204 at an opening of the lug 204. In one embodiment, the lug 204 may include openings 218. The friction elements 212 may be positioned within the openings 218 to couple the friction elements 212 to the lug 204. The friction elements 212 may be coupled to the openings 218 in a variety of manners. For example, in the embodiment depicted in FIG. 2A, the attachment system 200 may include flanges 220.

In one embodiment, the flanges 220 may be positioned on the friction elements 212 such that the flanges 220 may be interposed between the friction elements 212 and the lug 204. The flanges 220 may be configured to couple the friction elements 212 to the lug 204. For example, in one embodiment, the flanges 220 may extend beyond a perimeter of the friction elements 212. This may allow the friction elements 212 to be disposed within the openings 218 such that the flanges 220 extend into the cavity 206 of the lug 204. The flanges 220 (when positioned in the cavity) may restrict movement of the friction elements 212, thereby facilitating the coupling of the friction elements 212 to the lug 204. Additionally or alternatively, an adhesive layer may be applied adjacent to the flanges 220 to couple the friction elements 212 to the lug 204.

The attachment system 200 may also include a band 224. The band may be a strap or other feature attachable to a user. The band 224 may be non-separably interlocked with the lug 204. A portion of the band 224 may be received within the cavity 206 of the lug 204 to non-separably interlock the band 224 and the lug 204. The band 224 may include an insert portion 228. The insert portion 228 may be defined by a segment of the band 224 that is configured to be received by the lug 204. In some case, the insert portion 228 may be defined by two prongs extending from a side surface of the band 224. The insert portion 228 may include various features configured to non-separably interlock the band 224 with the lug 204. For example, the insert portion 228 may include apertures 232. The apertures 232 may be configured to receive a pin and/or other appropriate mechanism that may engage with the lug 204.

The attachment system 200 may include pins 236. The pins 236 may be a substantially cylindrical shape. The pins 236 may be disposed within the apertures 232 and extend beyond a surface of the insert portion 228. For example, the pins 236 may have a length that is greater than a height of the insert portion 228. Accordingly, the pins 236 may protrude from one, or both, sides of the insert portion 228 when disposed within the apertures 232.

In one embodiment, the pins 236 may include studs 240. The studs 240 may define protrusions extending from opposing external surfaces of the pins 236. In one instance, the studs 240 may have a diameter that is less than a diameter of the pins 236. The studs 240 may be configured for engagement with a surface of the cavity 206 to non-separably interlock the lug 204 and the band 224.

The cavity 206 may include, or be coupled with, retention members 244. The retention members 244 may include a tapered surface that extends between a first cavity width and a second cavity width. Both a top and bottom surface of the cavity 206 may be tapered in this manner to define the retention members 244. In one instance, the tapered surface may be configured such that the first width may correspond to a height of the pins 236 and the second width may correspond to a height of the insert portion 228.

The cavity may include grooves 248. The grooves 248 may be positioned adjacent to the retention members 244 and opposite entrance to the cavity 206 (e.g., such as cavity entrance 207). Grooves 248 may be configured to receive the pins 236. By way of example, the grooves 248 may be dimensioned corresponding to the dimension of the studs 240. As such, the studs 240 may be received by the grooves 248 upon the advancement of the pins 236 past the retention members 244. This may non-separably interlock the lug 204 and the band 224.

Figure 2B:
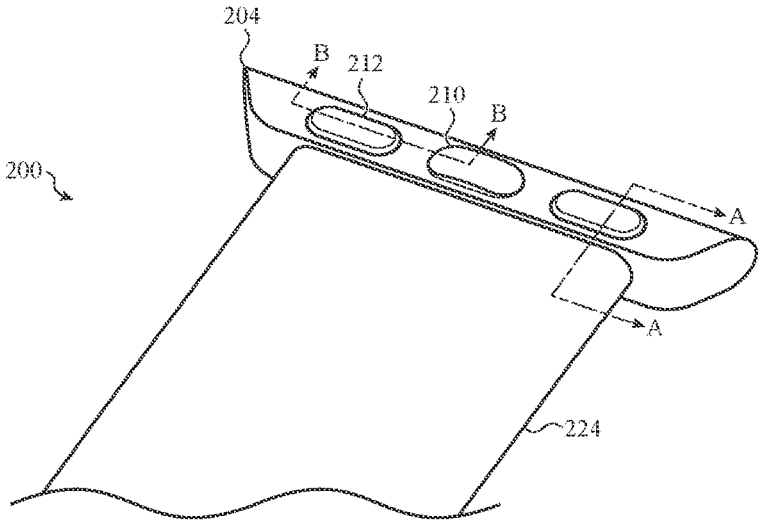
FIG. 2B illustrates a top view of the assembled attachment system of FIG. 2A.

FIG. 2B illustrates a top view of the assembled attachment system 200 of FIG. 2A, according to one or more embodiments of the present disclosure. The insert portion 228 is placed within the cavity 206 such that the band 224 is non-separably interlocked with the lug 204. The insert portion 228 may be substantially disposed within the cavity 206 such that the various components described herein to facilitate the non-separable interlock of the band 224 and the lug 204 (e.g., the retention members 244, the pins 236, etc.) may be concealed from view in the assembled state. Further, the one or more features used to couple the friction elements 212 to the lug 204 (e.g., such as flanges 220) may similarly be concealed from view. In this regard, the attachment system 200 may non-separably interlock the band 224 and the lug 204 in a manner that maintains the aesthetic properties of the attachment system 200.

Figure 2C:
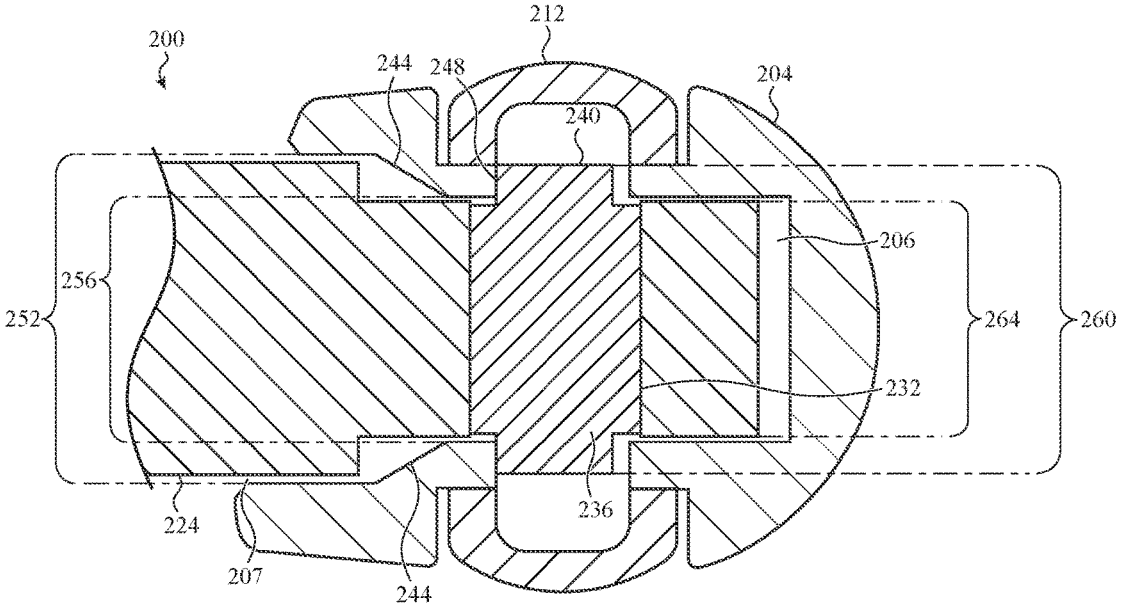
FIG. 2C illustrates a cross-sectional view of the attachment system of FIG. 2B taken along line A-A of FIG. 2B.
Figure 2D:
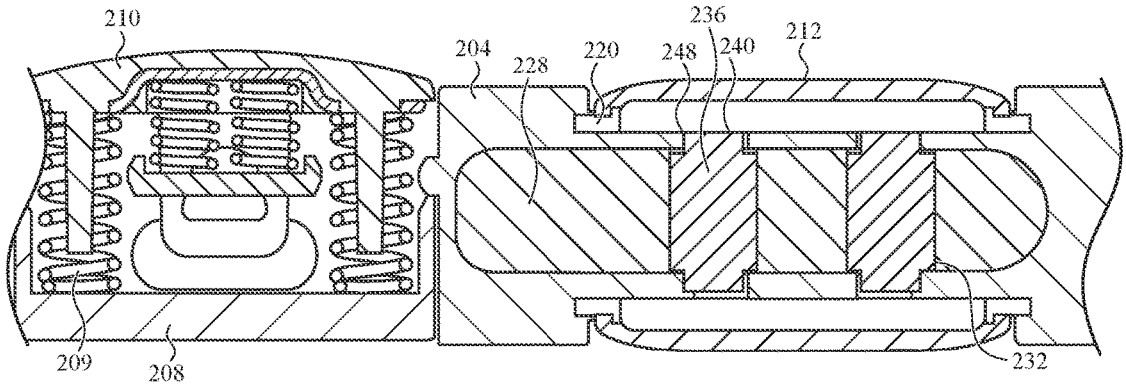
FIG. 2D illustrates a cross-sectional view of the attachment system of FIG. 2B taken along line B-B of FIG. 2B.

FIGS. 2C-2D illustrate various cross-sectional views of the attachment system 200. In particular, FIG. 2C is a cross-sectional view of the attachment system 200, taken along line A-A of FIG. 2B. FIG. 2D is a cross-sectional view of the attachment system 200, taken along line B-B of FIG. 2B. As illustrated, the band 224 may be non-separably interlocked with the lug 204. To facilitate the foregoing, the insert portion 228 may be disposed within the cavity 206 such that the apertures 232 are positioned past retention members 244 (e.g., the retention members 244 may be interposed between the apertures 232 and the cavity entrance 207). In some instances, the apertures 232 may be vertically aligned with the grooves 248 and/or the friction elements 212.

In the assembled configuration, the pins 236 may be disposed within the apertures 232 and extend into the grooves 248. A portion of the pins 236 (e.g., such as studs 240) may extend beyond an external surface of the insert portion 228 such that the pins 236 may be received by the grooves 248. The grooves 248 may be defined by a shape corresponding to the shape of the studs 240 (e.g., the grooves 248 may have a diameter substantially equal to or greater than the studs 240).

In some instances, the cavity 206 may include grooves 248. The grooves 248 may be disposed adjacent opposing external surfaces of the pins 236 in the assembled state. In this manner, the studs 240 extending from the opposing external surfaces of the pins 236 may be received by the grooves 248. This may allow the grooves 248 to restrict axial movement of the pins 236.

The disposition of the pins 236 within the grooves 248, in conjunction with the retention members 244, may non-separably interlock the band 224 and the lug 204. For example, the retention members 244 may be positioned within the cavity 206 to retain the pins 236 upon the advancement of the pins 236 past the retention members 244. The retaining of the pins 236 within the cavity 206 may non-separably interlock the band 224 and the lug 204. To illustrate, in the assembled configuration, the pins 236 may be disposed within the apertures 232 of the insert portion 228 and advanced into the cavity 206 past the retention members 244. Once advanced past the retention members 244, at least a portion of the pins 236 may extend into the grooves 248. Upon receipt by the grooves 248, movement of the band 224 relative to the lug 204 may be substantially restricted. By way of particular example, the retention members 244 may form a barrier between the pins 236 and the cavity entrance 207. The band 224 may therefore be prevented from exiting the cavity 206 for at least because the pins 236 (which are restricted from moving) may be disposed within apertures 232.

To facilitate the foregoing, the retention members 244 may be at least partially defined by a tapered surface of the cavity 206 that extends between a first cavity width 252 and a second cavity width 256. The first cavity width 252 may have a cross dimension that may be greater than a cross dimension of the second cavity width 256. As such, the cavity 206 may have a cross-dimensional area that may gradually decrease between the first cavity width 252 and the second cavity width 256. In one implementation, the first cavity width 252 may substantially correspond to a pin length 260 and the second cavity width 256 may substantially correspond to an insert portion length 264. The pin length 260 may be a longitudinal length of the pins 236 and the studs 240.

The insert portion 228 may be advanced into the cavity 206 in a state in which the pins 236 are disposed within the apertures 232. Upon advancement of the insert portion 228 into the cavity 206, the first cavity width 252 may accommodate the pin length 260 such that the pins 236 may initially pass into the cavity 206 in an undeformed state. Upon further advancement of the insert portion 228 into the cavity 206, the pins 236 may be compressed. In particular, the pins 236 may be elastically deformed from the pin length 260 to the second cavity width 256 as the pins 236 move past the retention members 244.

The pins 236 may be advanced past the retention members 244 to non-removeably capture the pins 236 within the cavity 206. Upon advancement of the pins 236 past the retention members 244, the pins 236 may be received by the grooves 248. The grooves 248 may be dimensioned such that the pins 236 may return to an undeformed shape upon the receipt of the pins 236 by the grooves 248. As such, the retention members 244 may define a barrier between the pins 236 and the cavity entrance 207. Accordingly, the retention members 244 may non-removeably capture the pins 236 within the cavity 206. The non-removable capture of the pins 236 may non-separably interlock the band 224 and the lug 204 (e.g., the pins 236 disposed within the apertures 232 may prevent the band 224 from exiting the cavity 206).

FIGS. 3A-3E illustrate various views and components of an attachment system 300, according to one or more embodiments of the present disclosure. The attachment system 300 shown and described with respect to FIGS. 3A-3E may be substantially analogous to the attachment system 200 described above with respect to FIGS. 2A-2D. For example, the attachment system 300 may be configured for removable engagement with a consumer product (e.g., such as the consumer product 108 depicted in FIG. 1). Further, the attachment system 300 may include a substantially flexible component and a substantially rigid component. In this regard, analogous to the components described in relation to the embodiments of FIGS. 2A-2D, the attachment system 300 may include: lug 304; cavity 306; cavity entrance 307; catch member 308; ramp 310; biasing springs 309; friction elements 312; port 316; openings 318; band 324; insert portion 328; apertures 332; pins 336; studs 340; retention members 344; and grooves 348. Further, analogous to the embodiments of FIGS. 2A-2D, the cavity 306 may include a first cavity width 352 and a second cavity width 356; the pins 336 may include a pin length 360; and the insert portion 328 may include an insert portion length 364.

Figure 3A:
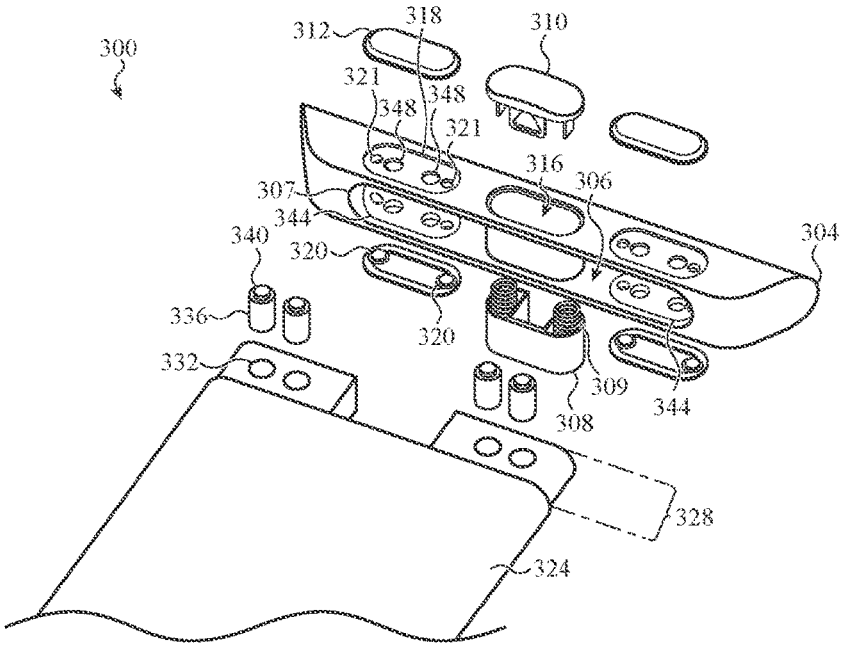
FIG. 3A illustrates an exploded view of an example attachment system.

FIG. 3A illustrates an exploded view of the attachment system 300, according to one or more embodiments of the present disclosure. Notwithstanding the foregoing similarities to the attachment system 200, the attachment system 300 may include one or more sets of anchor pins configured to couple the friction elements 312 to the lug 304. As illustrated in the embodiment depicted in FIG. 3A, the attachment system 300 may include anchor pins 320.

In one embodiment, the anchor pins 320 may be positioned adjacent the friction elements 312 such that the anchor pins 320 may be interposed between the friction elements 312 and the lug 304. The anchor pins 320 may be configured to couple the friction elements 312 to the lug 304. The anchor pins 320 may be positioned on the friction elements 312 such that the anchor pins 320 protrude from an external surface of the friction elements 312. This may allow the friction elements 312 to be disposed with the opening 318 such that the anchor pins 320 extend into the cavity 306 of the lug 304 in an assembled state. In one embodiment, the lug 304 may include holes 321 that may be configured to receive the anchor pins 320 to facilitate coupling the friction elements 312 to the lug 304. Additionally or alternatively, an adhesive layer may be applied adjacent to one or more of the anchor pins 320 to attach the corresponding friction elements 312 to the lug 304.

Figure 3B:
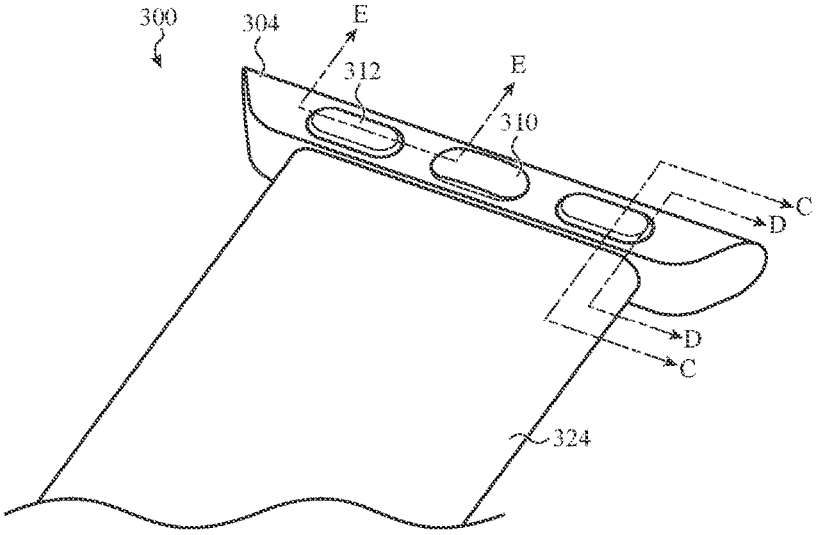
FIG. 3B illustrates a top view of the assembled attachment system of FIG. 3A.

FIG. 3B illustrates a top view of the assembled attachment system 300 of FIG. 3A, according to one or more embodiments of the present disclosure. By way of illustration, the insert portion 328 is placed within the cavity 306 such that the band 324 is non-separably interlocked with the lug 304. The insert portion 328 may be substantially disposed within the cavity 306 such that the various components described herein to facilitate the non-separable interlock of the band 324 and the lug 304 (e.g., the retention members 344, the pins 336, etc.) may be concealed from view in the assembled state. Further, the one or more features used to couple the friction elements 312 to the lug 304 (e.g., such as anchor pins 320) may similarly be concealed from view. In this regard, the attachment system 300 may non-separably interlock the band 324 and the lug 304 in a manner that maintains the aesthetic properties of the attachment system 300.

Figure 3C:
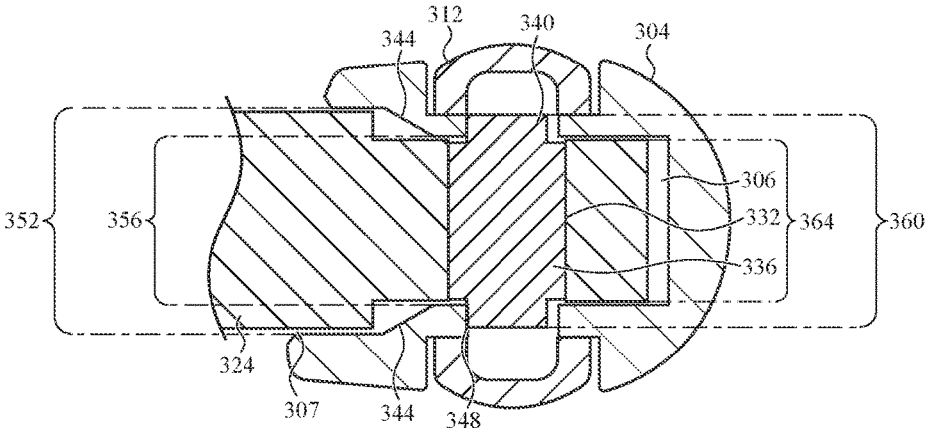
FIG. 3C illustrates a cross-sectional view of the attachment system of FIG. 3B taken along line C-C of FIG. 3B.
Figure 3D:
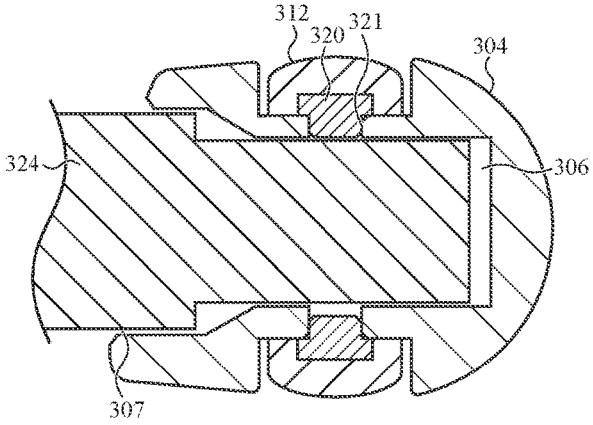
FIG. 3D illustrates a cross-sectional view of the attachment system of FIG. 3B taken along line D-D of FIG. 3B.
Figure 3E:
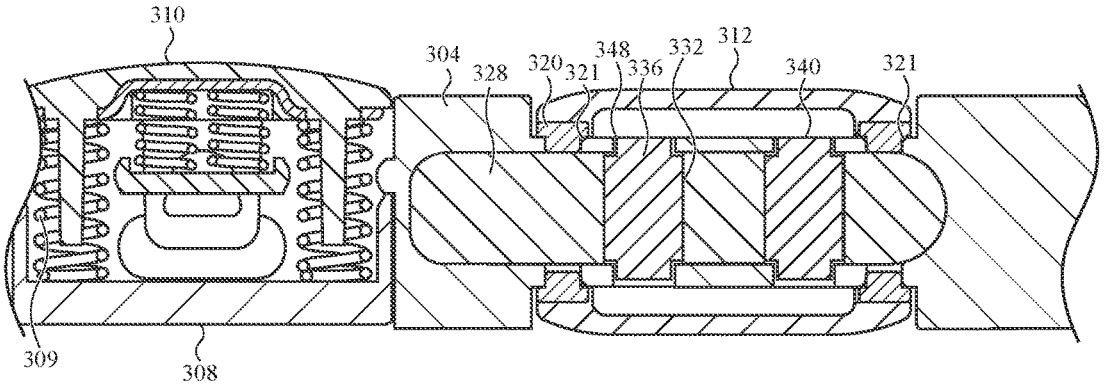
FIG. 3E illustrates a cross-sectional view of the attachment system of FIG. 3B taken along line E-E of FIG. 3B.

FIGS. 3C-3E illustrate various cross-sectional views of the attachment system 300. In particular, FIG. 3C is a cross-sectional view of the attachment system 300, taken along line C-C of FIG. 3B; FIG. 3D is a cross-sectional view of the attachment system 300, taken along line D-D of FIG. 3B; and FIG. 3E is a cross-sectional view of the attachment system 300, taken along line E-E of FIG. 3B. As illustrated, the band 324 may be non-separably interlocked with the lug 304 in a manner substantially analogous to that described with respect to the attachment system 200 depicted in FIGS. 2A-2D. For example, insert portion 328 may be disposed with the cavity 306 such that the retention members 344 may retain the pins 336.

As depicted in FIGS. 3C-3E, friction elements 312 may be connected to anchor pins 320. In an assembled state, the anchor pins 320 may be positioned within holes 321. The holes 321 may restrict movement at the anchors pins 320. As such, the friction elements 312 may be coupled to the lug 304 using the anchor pins 320. In some cases, an adhesive and/or other appropriate bonding technique may be used for affixing the anchor pins 320 to the lug 304 at the holes 321. As shown in FIG. 3E, the anchor pins 320 may include a first and a second of anchor pins 320 disposed at opposing ends of the friction elements 312.

FIGS. 4A-4D illustrate various views and components of an attachment system 400, according to one or more embodiments of the present disclosure. The attachment system 400 shown and described with respect to FIGS. 4A-4D may be substantially analogous to the attachment system 200 described above with respect to FIGS. 2A-2D. For example, the attachment system 400 may be configured for removable engagement with a consumer product (e.g., such as the consumer product 108 depicted in FIG. 1). Further, the attachment system 400 may include a substantially flexible component and a substantially rigid component. In this regard, analogous to the components described in relation to the embodiments of FIGS. 2A-2D, the attachment system 400 may include: lug 404 cavity 406; cavity entrance 407; catch member 408; ramp 410; biasing springs 409; friction elements 412; port 416; openings 418; band 424; insert portion 428; apertures 432; pins 436; studs 440; retention members 444; and grooves 448. Further, analogous to the embodiments of FIGS. 2A-2D, the cavity 406 may include a first cavity width 452 and a second cavity width 456; the pins 436 may include a pin length 460; and the insert portion 428 may include an insert portion length 464.

Figure 4A:
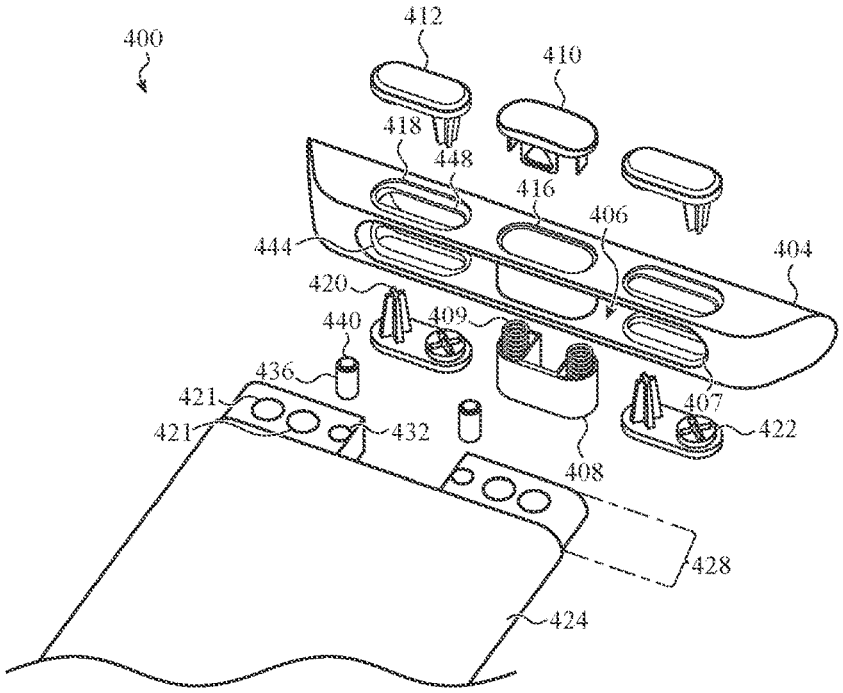
FIG. 4A illustrates an exploded view of an example attachment system.

FIG. 4A illustrates an exploded view of the attachment system 400, according to one or more embodiments of the present disclosure. Notwithstanding the foregoing similarities to the attachment system 200, the attachment system 400 may include one or more shafts configured to couple the friction elements 412 to the lug 404. The one or more shafts may also be configured to non-separably interlock the band 424 and the lug 404 (e.g., by providing a barrier between a segment of the insert portion 428 and the cavity entrance 407). As illustrated, in the embodiment depicted in FIG. 4A, the attachment system 400 may include shafts 420.

In one embodiment, the shafts 420 may be positioned on the friction elements 412 such that the shafts 420 may be interposed between the friction elements 412 and the lug 404. The shafts 420 may be configured to couple the friction elements 412 to the lug 404. To illustrate, the shafts 420 may protrude from an external surface of the friction elements 412 In an assembled state, the shafts 420 may extend into the cavity 406 and through the insert portion 428 to couple the friction elements 412 with the lug 404.

In one embodiment, the insert portion may include holes 421. In the assembled state, the shafts 420 may extend through the holes 421. As such, the shafts 420 may be used to non-separably interlock the band 424 and the lug 404, for example, because the shafts 420 form a physical barrier between a portion of the band 424 and the cavity entrance 407. In some embodiments, the shafts 420 may extend through the holes 421 for engagement with another of the friction elements 412.

To facilitate the foregoing, the friction elements 412 may include receiving recesses 422. The receiving recesses 422 may be configured to receive at least a portion of the shafts 420 that extends through the holes 421. This may allow a pair of the friction elements 412 disposed at opposing external surfaces of the lug 404 to operate together to couple the pair of friction elements 412 to the lug 404. For example, each of the pair of friction elements 412 may include one of the shafts 420 and one of the receiving recesses 422. Each one of the shafts 420 may extend through a corresponding one of the holes 421 and engage a receiving recess 422 of the other one of the friction elements 412 (e.g., the shafts 420 of one of the friction elements 412 may be received by one of the receiving recesses 422 of another of the friction elements 412 that is disposed on the opposite external surface of the lug 404). In some instances, the receiving recesses 422 may form a friction or interference fit with the shafts 420. Additionally or alternatively, an adhesive layer may be applied adjacent to the receiving recesses 422 to couple the shafts 420 to the receiving recesses 422.

Figure 4B:
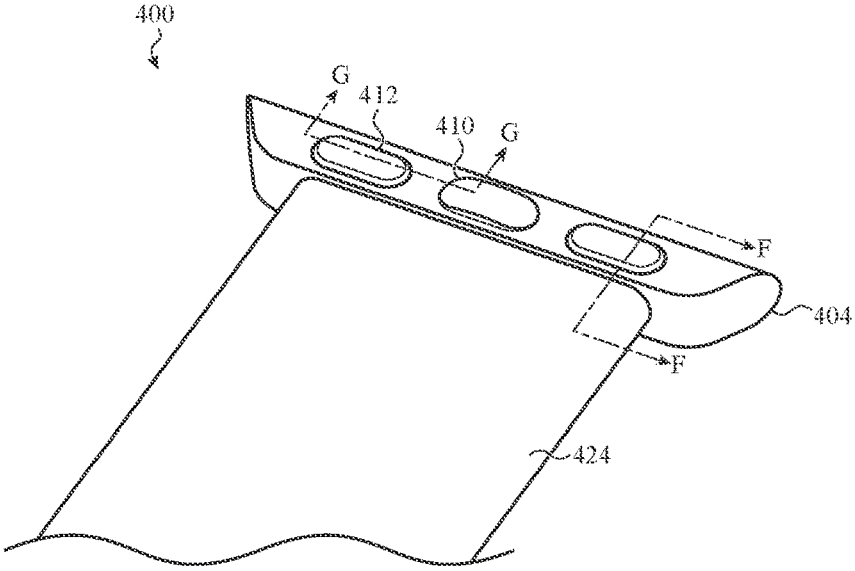
FIG. 4B illustrates a top view of the assembled attachment system of FIG. 4A.

FIG. 4B illustrates a top view of the assembled attachment system 400 of FIG. 4A, according to one or more embodiments of the present disclosure. By way of illustration, the insert portion 428 is placed within the cavity 406 such that the band 424 is non-separably interlocked with the lug 404. The insert portion 428 may be substantially disposed within the cavity 406 such that the various components described herein to facilitate the non-separable interlock of the band 424 and the lug 404 (e.g., the retention members 444, the pins 436, etc.) may be concealed from view in the assembled state. As shown in FIG. 4A, insert portion 428 may include two prongs. Further, the one or more features used to couple the friction elements 412 to the lug 404 (e.g., such as shafts 420) may similarly be concealed from view. In this regard, the attachment system 400 may non-separably interlock the band 424 and the lug 404 in a manner that maintains the aesthetic properties of the attachment system 400.

Figure 4C:
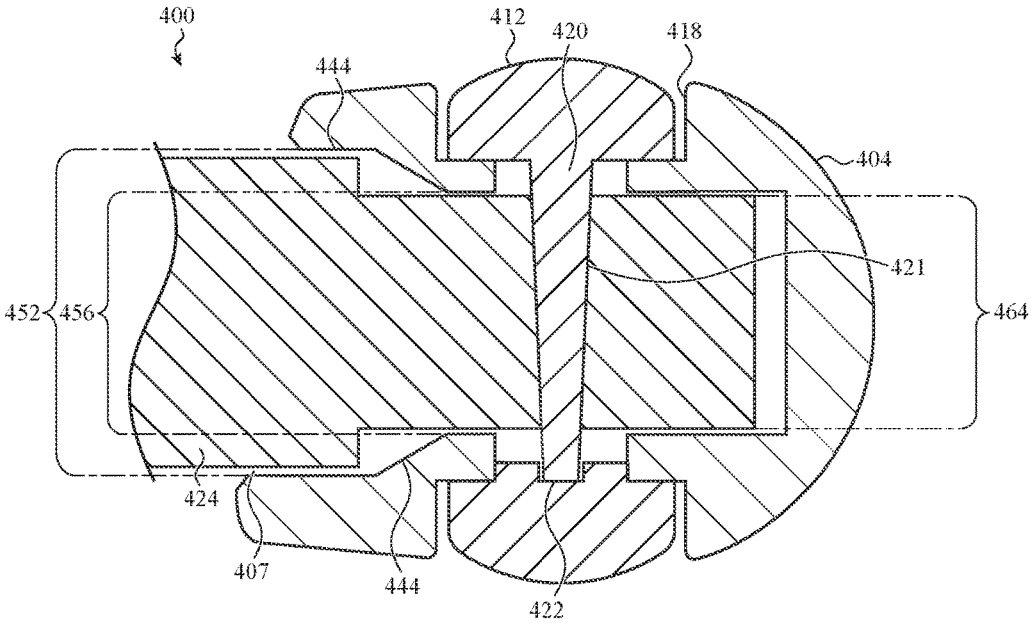
FIG. 4C illustrates a cross-sectional view of the attachment system of FIG. 4B taken along line F-F of FIG. 4B.
Figure 4D:
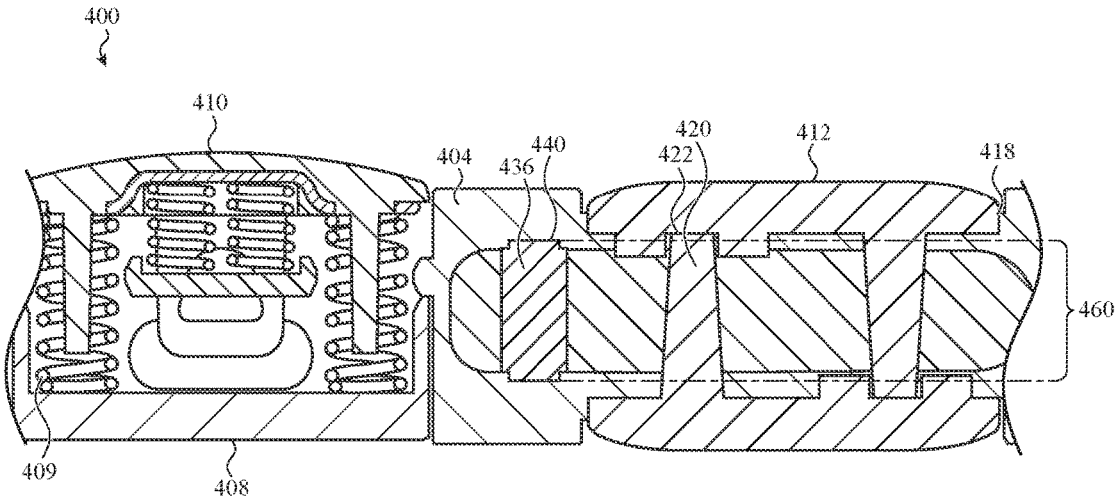
FIG. 4D illustrates a cross-sectional view of the attachment system of FIG. 4B taken along line G-G of FIG. 4B.

FIGS. 4C-4D illustrate various cross-sectional views of the attachment system 400. In particular, FIG. 4C is a cross-sectional view of the attachment system 400, taken along line F-F of FIG. 4B. FIG. 4D is a cross-sectional view of the attachment system 400, taken along line G-G of FIG. 4B. In this regard, as illustrated, the band 424 may be non-separably interlocked with the lug 404 in a manner substantially analogous to that of attachment system 200 depicted in FIGS. 2A-2D. For example, insert portion 428 may be disposed within the cavity 406 such that the retention members 444 may retain the pins 436.

The shafts 420 may define a barrier between a segment of the insert portion 428 and the cavity entrance 407 to non-separably interlock the lug 404 and the band 424. For example, shafts 420 may extend through holes 421 of the insert portion 428 and be received by receiving recess 422. This may cause the band 424 to be prevented from exiting the cavity 406. Further, in the assembled configuration, pins 436 may be disposed adjacent the holes 421. Accordingly, both the pins 436 and the shafts 420 may provide a structural barrier operative to non-separably interlock the band 424 and the lug 404.

Figure 5A:
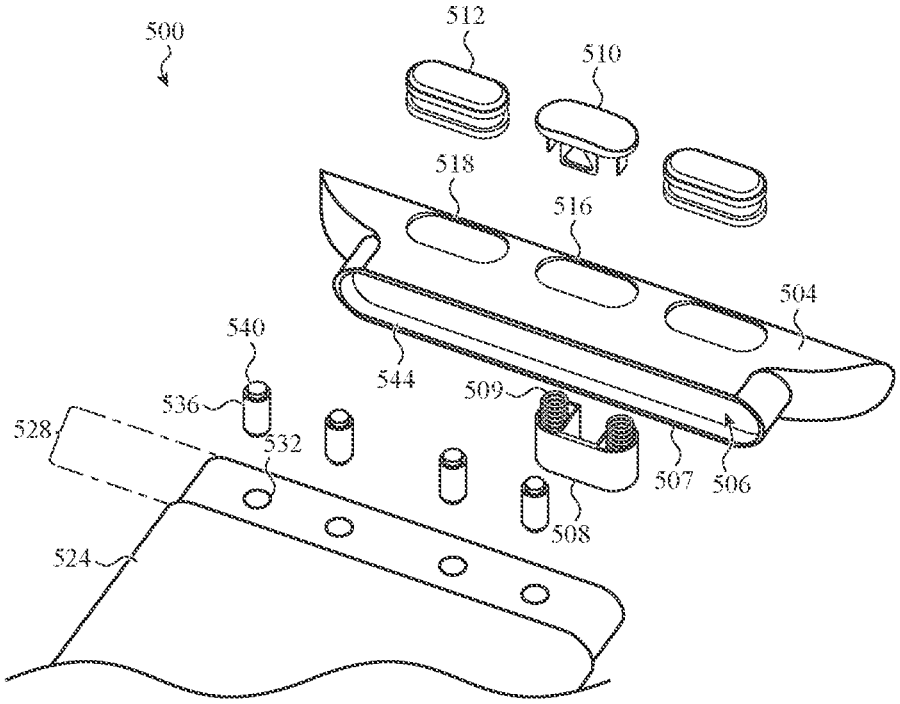
FIG. 5A illustrates an exploded view of an example attachment system.
Figure 5B:
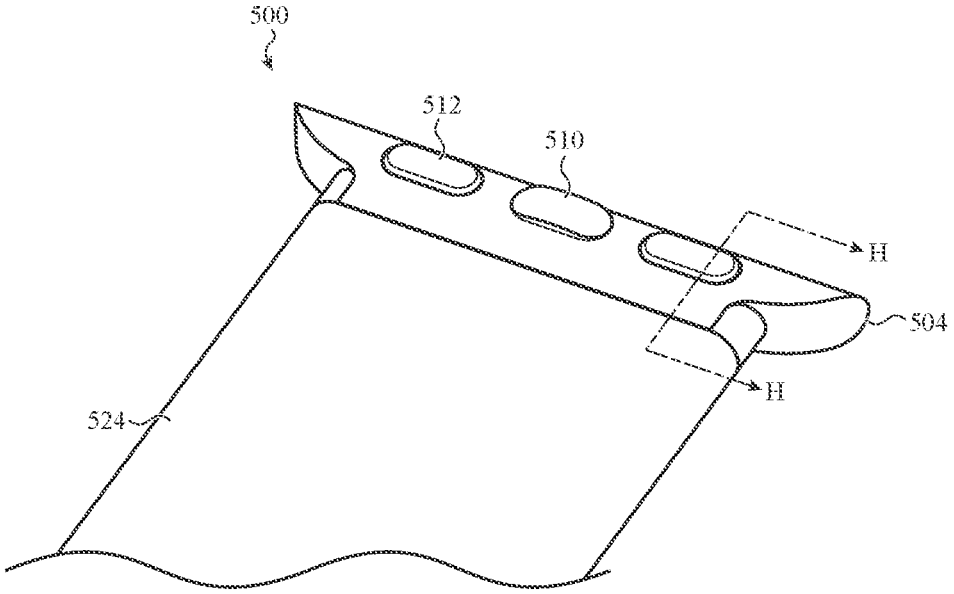
FIG. 5B illustrates a top view of the assembled attachment system of FIG. 5A.
Figure 5C:
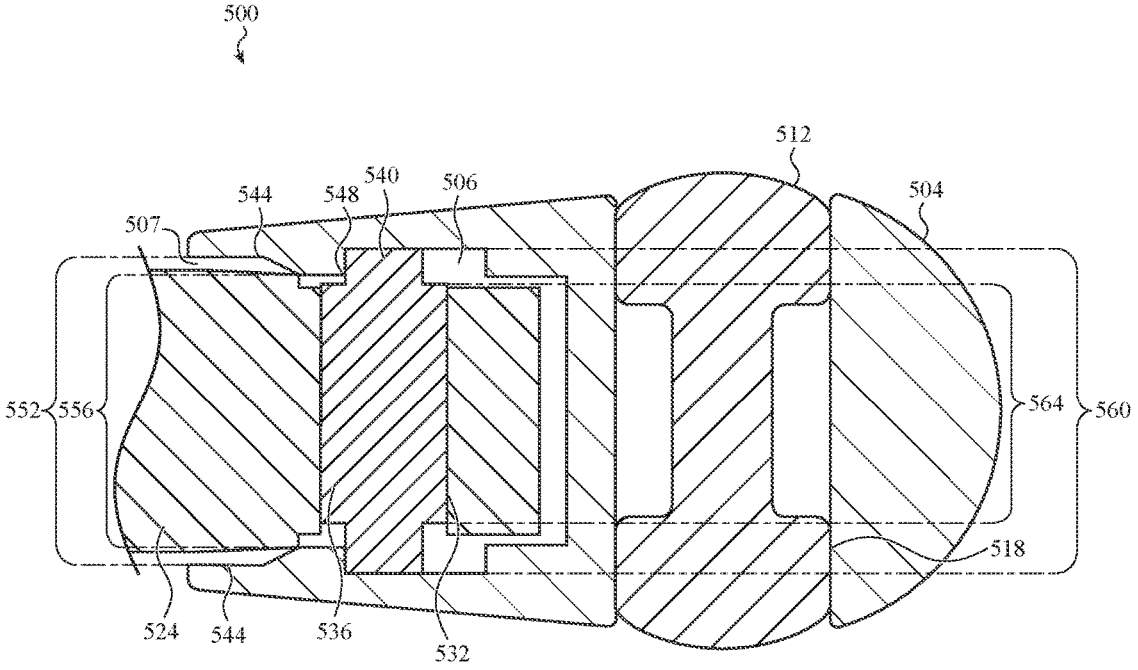
FIG. 5C illustrates a cross-sectional view of the attachment system of FIG. 5B taken along line H-H of FIG. 5B.

FIGS. 5A-5C illustrate various views and components of an attachment system 500 according to one or more embodiments of the present disclosure. The attachment system 500 shown and described with respect to FIGS. 5A-5C may be substantially analogous to the attachment system 200 described above with respect to FIGS. 2A-2D. For example, the attachment system 500 may be configured for removable engagement with a consumer product (e.g., such as the consumer product 108 depicted in FIG. 1). Further, the attachment system 500 may include a substantially flexible component and a substantially rigid component. In this regard, analogous to the components described in relation to the embodiments of FIGS. 2A-2D, the attachment system 500 may include: lug 504; cavity 506; cavity entrance 507; catch member 508; ramp 510; biasing springs 509; friction elements 512; port 516; openings 518; band 524; insert portion 528; apertures 532; pins 536; studs 540; retention members 544; and grooves 548. Further, analogous to the embodiments of FIGS. 2A-2D, the cavity 506 may include a first cavity width 552 and a second cavity width 556; the pins 536 may include a pin length 560; and the insert portion 528 may include an insert portion length 564.

FIG. 5A illustrates an exploded view of the attachment system 500, according to one or more embodiments of the present disclosure. Notwithstanding the foregoing similarities to the attachment system 200, the attachment system 500 may include friction elements 512 that extend through the openings 518. For example, in an assembled configuration, the friction elements 512 may be dimensioned to extend between, or protrude from, opposing external surfaces of the lug 504 such that the friction elements 512 may extend beyond the opposing external surfaces of the lug 504.

FIG. 5B illustrates a top view of the assembled attachment system 500 of FIG. 5A, according to one or more embodiments of the present disclosure. By way of illustration, the insert portion 528 may be placed within the cavity 506 such that the band 524 may be non-separably interlocked with the lug 504. The insert portion 528 may be substantially disposed within the cavity 506 such that the various components described herein to facilitate the non-separable interlock of the band 524 and the lug 504 (e.g., the retention members 544, the pins 536, etc.) may be concealed from view in the assembled state. In this regard, the attachment system 500 may non-separably interlock the band 524 and the lug 504 in a manner that maintains the aesthetic properties of the attachment system 500.

FIG. 5C is a cross-sectional view of the attachment system 500, taken along line H-H of FIG. 5B In this regard, as illustrated, the band 524 may be non-separably interlocked with the lug 504 in a manner substantially analogous to that of attachment system 200 depicted in FIGS. 2A-2D. For example, insert portion 528 may be disposed within the cavity 506 such that the retention members 544 may retain the pins 536.

As depicted in FIG. 5C, the friction elements 512 may be disposed within openings 518 such that the friction elements 512 extend beyond opposing external surfaces of the lug 504. In this regard, in the assembled state, the pins 536 may be offset from the friction elements 512. The offset of the pins 536 from the friction elements 512 may allow the friction elements 512 to extend through the opposing external surfaces of the lug 504.

FIGS. 6A-6D illustrate various views and components of an attachment system 600 according to one or more embodiments of the present disclosure. The attachment system 600 shown and described with respect to FIG. 6A-FIG. 6D may be substantially analogous to the attachment system 200 described above with respect to FIGS. 2A-2D. For example, the attachment system 600 may be configured for removable engagement with a consumer product (e.g., such as the consumer product 108 depicted in FIG. 1). Further, the attachment system 600 may include a substantially flexible component and a substantially rigid component. In this regard, analogous to the components described in relation to the embodiments of FIGS. 2A-2D, the attachment system 600 may include: lug 604; cavity 606; cavity entrance 607; catch member 608; ramp 610; biasing springs 609; friction elements 612; port 616; openings 618; band 624; insert portion 628; apertures 632; retention members 644; and grooves 648.

Figure 6A:
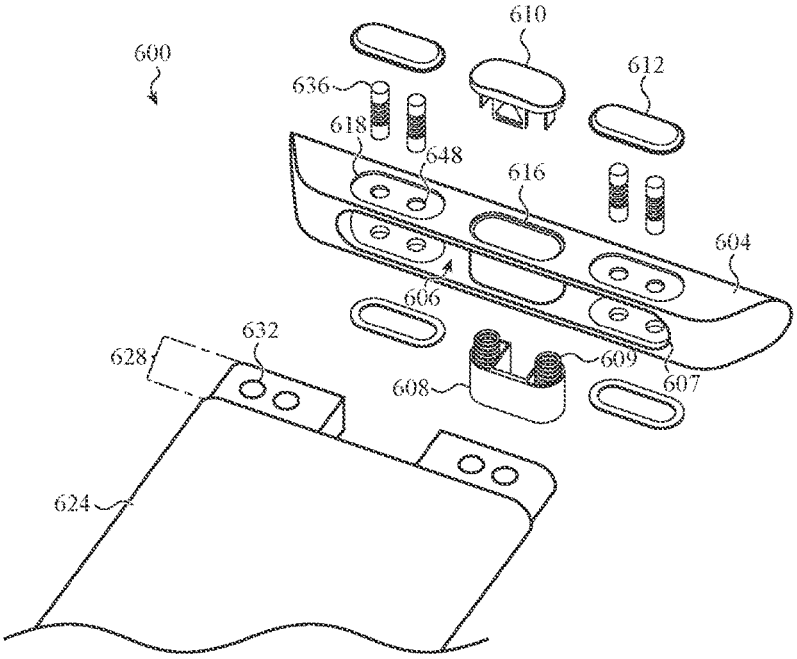
FIG. 6A illustrates an exploded view of an example attachment system.

FIG. 6A illustrates an exploded view of the attachment system 600, according to one or more embodiments of the present disclosure. Notwithstanding the foregoing similarities to the attachment system 200, the attachment system 600 may include one or more elements that are configured to non-separably interlock the band 624 and the lug 604 via an ultrasonic welded connection. For example, in the embodiment depicted in FIG. 6A, the attachment system 600 may include ultrasonic pins 636, so named as they may be ultrasonically welded to the band. It should be appreciated that the ultrasonic pins 636 may be bonded to the band through other attachment techniques and/or structures, in various embodiments.

In one embodiment, the ultrasonic pins 636 may be bonded to the band 624 through ultrasonic welding (e.g., application of high-frequency ultrasonic vibrations). For example and as described in greater detail below with reference to FIG. 20, the ultrasonic pins 636 may be joined to the band 624 (for example, at a surface and/or sidewall of the apertures 632) upon the application of a high-frequency ultrasonic vibration to the ultrasonic pins 636. To illustrate, the ultrasonic vibration of the ultrasonic pins 636 may cause a portion of the band 624 disposed adjacent to the ultrasonic pins 636 to melt due to absorption of vibrational energy. The melted portion of the band 624 may bond with the ultrasonic pins 636, or vice versa, such that the band 624 is non-separably interlocked with the pins 636.

To facilitate the foregoing, at least a portion of the ultrasonic pins 636 may be a knurled surface. The knurled surface of the ultrasonic pins 636 may increase the surface area of the ultrasonic pins 636 disposed adjacent to the band 624. In turn, the increased surface area disposed adjacent the band 624 may increase the relative strength of the bond between the band 624 and the ultrasonic pins 636. For example, the increased surface area of the band 624 may increase the locations at which the band 624 and the ultrasonic pins 636 may be bonded together, thereby increasing the resulting strength of the bond between the band 624 and the ultrasonic pins 636. Additionally or alternatively, the ultrasonic pins 636 may include other features or surface geometries (e.g., including various protrusions and/or recesses) to facilitate the bonding of the band 624 to the ultrasonic pins 636. Further, analogous to the embodiments of FIGS. 2A-2D, the cavity 606 may include a first cavity width 652 and a second cavity width 656; the ultrasonic pins 636 may include a pin length 660; and the insert portion 628 may include an insert portion length 664.

Figure 6B:
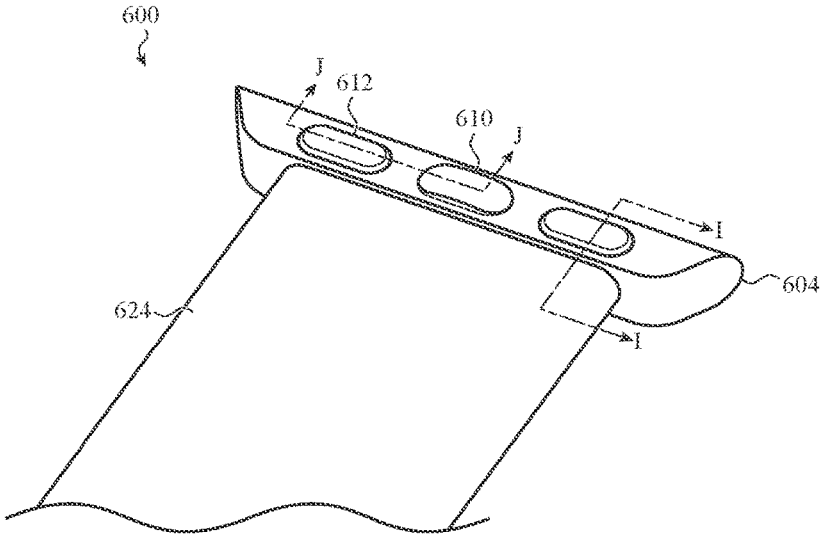
FIG. 6B illustrates a top view of the assembled attachment system of FIG. 6A.

FIG. 6B illustrates a top view of the assembled attachment system 600 of FIG. 6A, according to one or more embodiments of the present disclosure. By way of illustration, the insert portion 628 may be placed within the cavity 606 such that the band 624 may be non-separably interlocked with the lug 604. The insert portion 628 may be substantially disposed within the cavity 606 such that the various components described herein to facilitate the non-separable interlock of the band 624 and the lug 604 (e.g., including the ultrasonic pins 636, etc.) may be concealed from view in the assembled state. In this regard, the attachment system 600 may non-separably interlock the band 624 and the lug 604 in a manner that maintains the aesthetic properties of the attachment system 600.

Figure 6C:
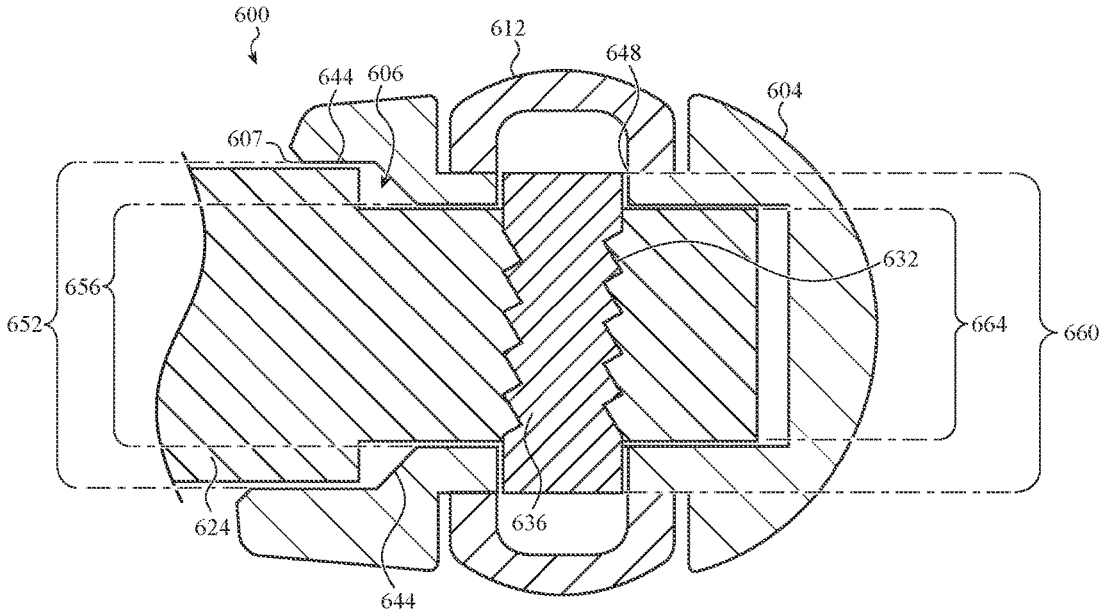
FIG. 6C illustrates a cross-sectional view of the attachment system of FIG. 6B taken along line I-I of FIG. 6B.
Figure 6D:
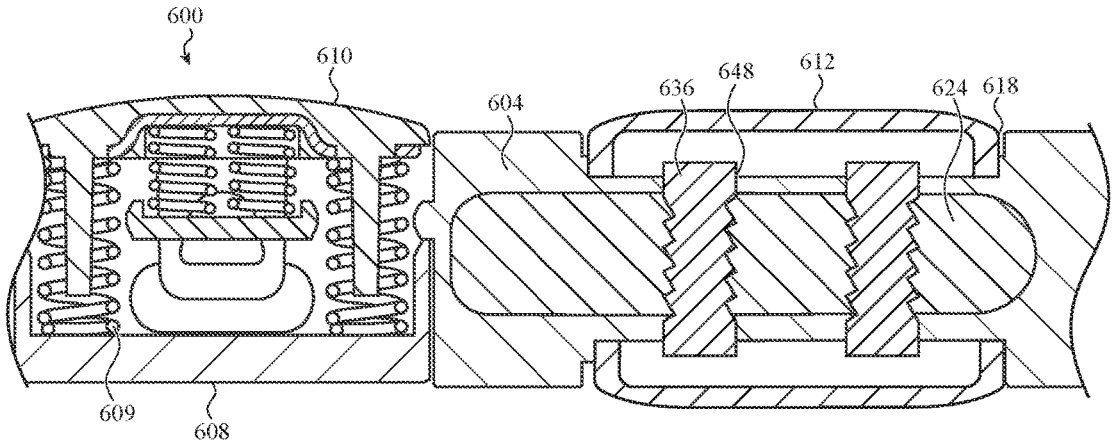
FIG. 6D illustrates a cross-sectional view of the attachment system of FIG. 6B taken along line J-J of FIG. 6B.

FIGS. 6C-6D illustrate various cross-sectional views of the attachment system 600. In particular, FIG. 6C is a cross-sectional view of the attachment system 600, taken along line I-I of FIG. 6B. FIG. 6D is a cross-sectional view of the attachment system 600, taken along line J-J of FIG. 6B. In this regard, as illustrated, the band 624 may be non-separably interlocked with the lug 604 according to the embodiments described herein. In the illustrated assembled configuration, the insert portion 628 may be disposed within the cavity 606 such that the apertures 632 may be vertically aligned with grooves 648. As shown in FIG. 6A, insert portion 28 may include two prongs. The ultrasonic pins 636 may be disposed within apertures 632. In particular, the ultrasonic pins 636 may be disposed within the apertures 632 and bonded to the band 624 at a position within the apertures 632 (e.g., by applying a high-frequency ultrasonic vibration to the ultrasonic pins 636).

The ultrasonic pins 636 may facilitate the non-separable interlock of the band 624 and the lug 604. For example, the ultrasonic pins 636 may provide a structure extending from a surface of the insert portion 628 that engages one or more features of the lug 604 (e.g., such as groove 648) to restrict the movement of the band 624 relative to the lug 604. By way of particular example, in the assembled configuration, the insert portion 628 may be positioned within the cavity 606 such that opposing external surfaces of the insert portion 628 are substantially adjacent and/or flush with surfaces of the cavity 606 (e.g., the insert portion length 664 may substantially equal the second cavity width 656). The ultrasonic pins 636 may have an ultrasonic pin length 660 that is greater than the insert portion length 664 and/or the second cavity width 656. In this regard, the ultrasonic pins 636 disposed within the apertures 632 may at least partially extend from either or both of the external opposing surfaces of the insert portion 628 and into the cavity 606.

The grooves 648 may be configured to receive the ultrasonic pins 636. For example, the ultrasonic pins 636 may be disposed within the apertures 632 and extend into the grooves 648. In this manner, the grooves 648 may restrict the movement of the band 624 relative to the lug 604 by providing a barrier between the ultrasonic pins 636 (e.g., the portion of the ultrasonic pins 636 extending from one or more surfaces of the insert portion 628) and the cavity entrance 607.

In one embodiment, the grooves 648 may be a through portion. Accordingly, the ultrasonic pins 636 may be advanced through the grooves 648 and into the cavity 606 for disposition into the apertures 632. In this regard, the insert portion 628 may be disposed within the cavity 606 during the application of the high-frequency ultrasonic vibration to the ultrasonic pins 636 such that the ultrasonic pins 636 may be bonded to the band 624 in a state in which the band 624 is disposed within the cavity 606.

FIGS. 7A-7D illustrate various views and components of an attachment system 700, according to one or more embodiments of the present disclosure. The attachment system 700 shown and described with respect to FIGS. 7A-7D may be substantially analogous to the attachment system 200 described above with respect to FIGS. 2A-2D. For example, the attachment system 700 may be configured for removable engagement with a consumer product (e.g., such as the consumer product 108 depicted in FIG. 1). Further, the attachment system 700 may include a substantially flexible component and a substantially rigid component. In this regard, analogous to the components described in relation to the embodiments of FIGS. 2A-2D, the attachment system 700 may include: lug 704; cavity 706; cavity entrance 707; catch member 708; ramp 710; biasing springs 709; friction elements 712; port 716; opening 718; band 724; insert portion 728; apertures 732; pins 736; retention members 744; and grooves 748. Further analogous to the embodiments of FIGS. 2A-2D, the cavity 706 may include a first cavity width 752 and a second cavity width 756.

Figure 7A:
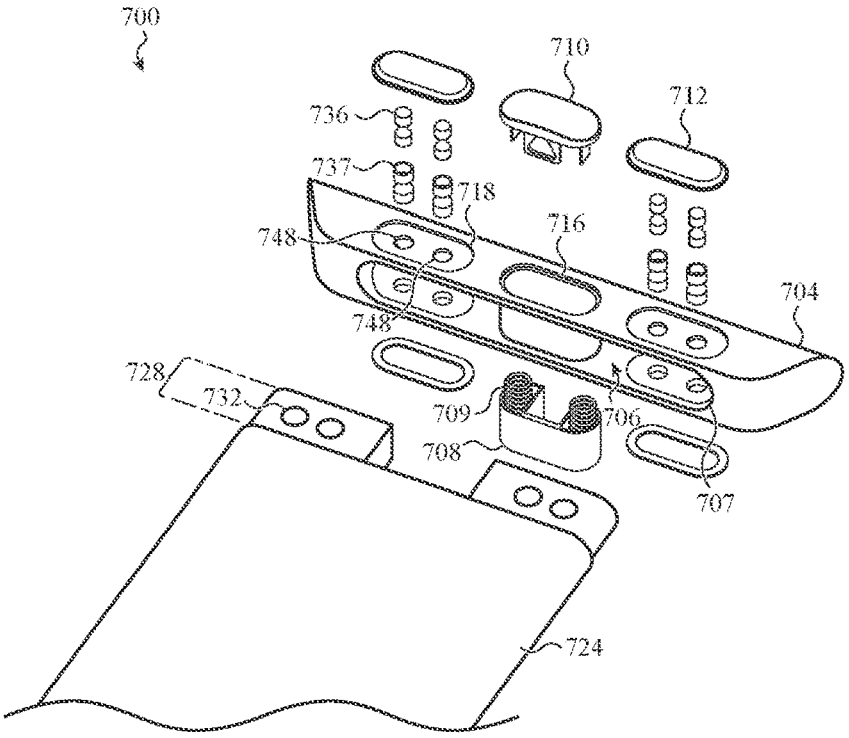
FIG. 7A illustrates an exploded view of an example attachment system.

FIG. 7A illustrates an exploded view of the attachment system 700, according to one or more embodiments of the present disclosure. Notwithstanding the foregoing similarities to the attachment system 200, the attachment system 700 may include one or more elements that are configured to couple the pins 736 with the band 724. For example, in the embodiment depicted in FIG. 7A, the attachment system 700 may include tubes 737. The tubes 737 may have retention features 738 configured to engage a surface feature of the pins 736. The tubes 737 may be configured to receive the pins 736 for coupling of the pins 736 and the band 724. The pins 736 may include engagement members 739 (e.g., as depicted in FIGS. 7C-7D). The engagement members 739 may be configured to couple the pins 736 and the tubes 737. For example, the engagement members 739 may couple with the retention features 738 upon the advancement of the pins 736 into the tubes 737.

Figure 7B:
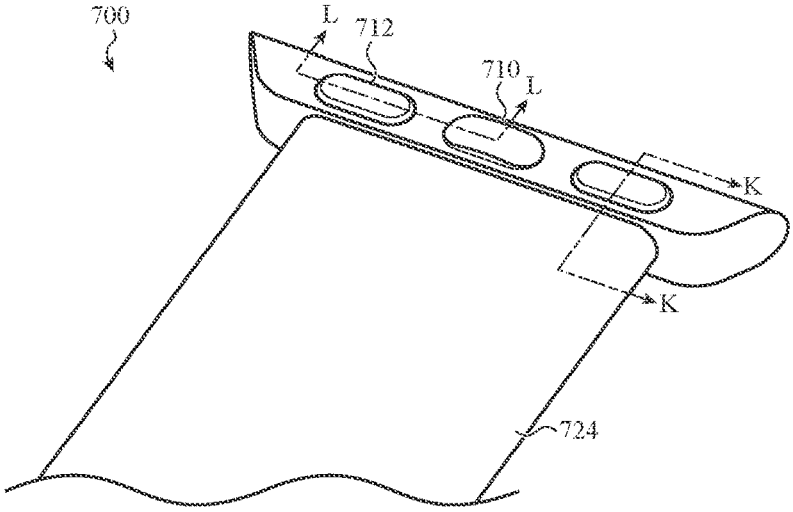
FIG. 7B illustrates a top view of the assembled attachment system of FIG. 7A.
Figure 7C:
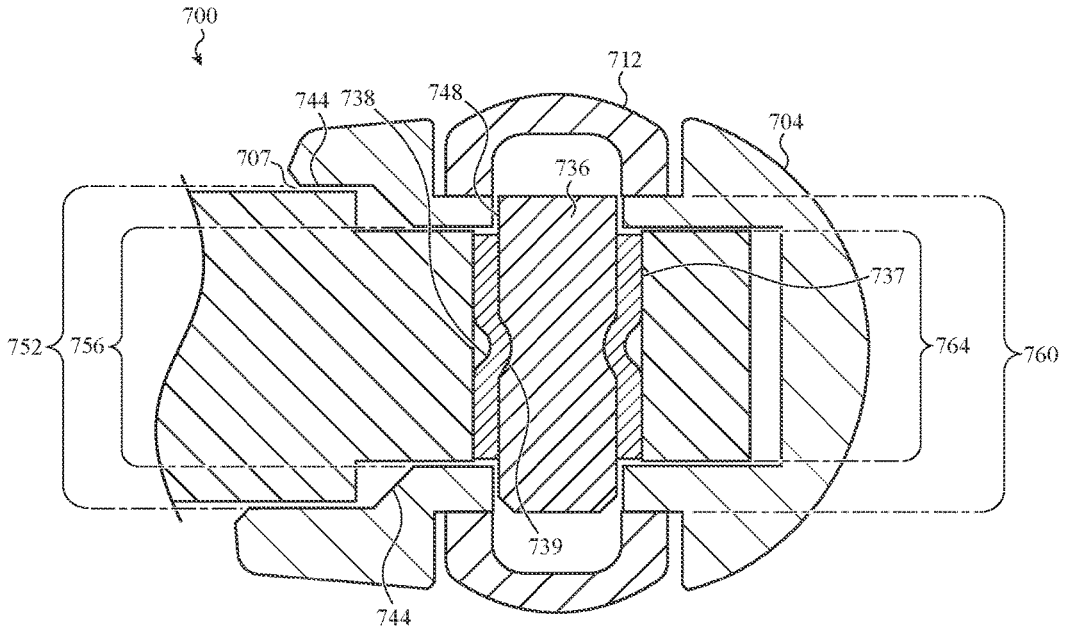
FIG. 7C illustrates a cross-sectional view of the attachment system of FIG. 7B taken along line K-K of FIG. 7B.
Figure 7D:
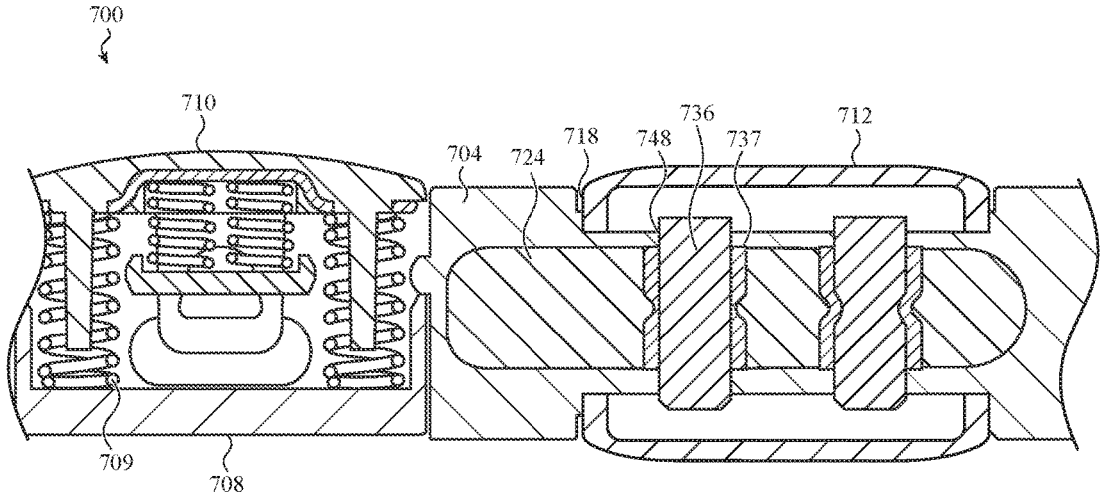
FIG. 7D illustrates a cross-sectional view of the attachment system of FIG. 7B taken along line L-L of FIG. 7B.

FIG. 7B illustrates a top view of the assembled attachment system 700 of FIG. 7A, according to one or more embodiments of the present disclosure. By way of illustration, the insert portion 728 may be placed within the cavity 706 such that the band 724 may be non-separably interlocked with the lug 704. As shown in FIG. 7A, insert portion 728 may include two prongs. The insert portion 728 may be substantially disposed within the cavity 706 such that the various components described herein to facilitate the non-separable interlock of the band 724 and the lug 704 (e.g., including the pins 736, the tubes 737, etc.) may be concealed from view in the assembled state. In this regard, the attachment system 700 may non-separably interlock the band 724 and the lug 704 in a manner that maintains the aesthetic properties of the attachment system 700.

FIGS. 7C-7D illustrate various cross-sectional views of the attachment system 700. In particular, FIG. 7C is a cross-sectional view of the attachment system 700, taken along line K-K of FIG. 7B. FIG. 7D is a cross-sectional view of the attachment system 700, taken along line L-L of FIG. 7B. In this regard, as illustrated, the band 724 may be non-separably interlocked with the lug 704 according to the embodiments described herein. In the illustrated assembled configuration, the insert portion 728 may be disposed within the cavity 706 such that the apertures 732 may be vertically aligned with the grooves 748 (e.g., the apertures 732 and the grooves 748 may be positioned along a common axis). The pins 736 may be disposed within apertures 732. This may allow the pins 736 to be coupled to the band 724 at a position within the apertures 732 via the tubes 737.

The pins 736 may facilitate the non-separable interlock of the band 724 and the lug 704. For example, the pins 736 may provide a structure extending from a surface of the insert portion 728 that engages one or more features of the lug 704 (e.g., such as groove 748) to restrict the movement of the band 724 relative to the lug 704. By way of particular example, in the assembled configuration, the insert portion 728 may be positioned within the cavity 706 such that opposing external surfaces of the insert portion 728 are substantially adjacent and/or flush with surfaces of the cavity 706 (e.g., the insert portion length 764 may substantially equal the second cavity width 756). The pins 736 may have a pin length 760 that is greater than the insert portion length 764 and/or the second cavity width 756. In this regard, the pins 736 disposed within the apertures 732 may at least partially extend from either, or both, of external opposing surfaces of the insert portion 728 and into the cavity 706.

The cavity 706 may include grooves 748. The grooves 748 may be configured to receive the pins 736, which partially extend from the opposing external surfaces of the insert portion 728. For example, the pins 736 may be disposed within the apertures 732 and extend into the grooves 748. In this manner, the grooves 748 may restrict the movement of the band 724 relative to the lug 704 by providing a barrier between the pins 736 (e.g., the portion of the pins 736 extending from one or more surfaces of the insert portion 728) and the cavity entrance 707.

In one embodiment, the grooves 748 may be a through portion. Accordingly, the pins 736 may be advanced through the grooves 748 and into the cavity 706 for positioning within the apertures 732. To illustrate, the pins 736 may be advanced into the cavity 706 in a state in which the insert portion 728 is disposed within the cavity 706. The insert portion 728 disposed within the cavity 706 may include the tubes 737. For example, the tubes 737 may be affixed to the insert portion 728 at the aperture 732. In this regard, the pins 736 may be coupled with the band 724 by advancing the pins 736 into the grooves 748 (e.g., via the application of a compressive force acting on the pins 736) to couple the pins 736 with the tubes 737.

Figure 8A:
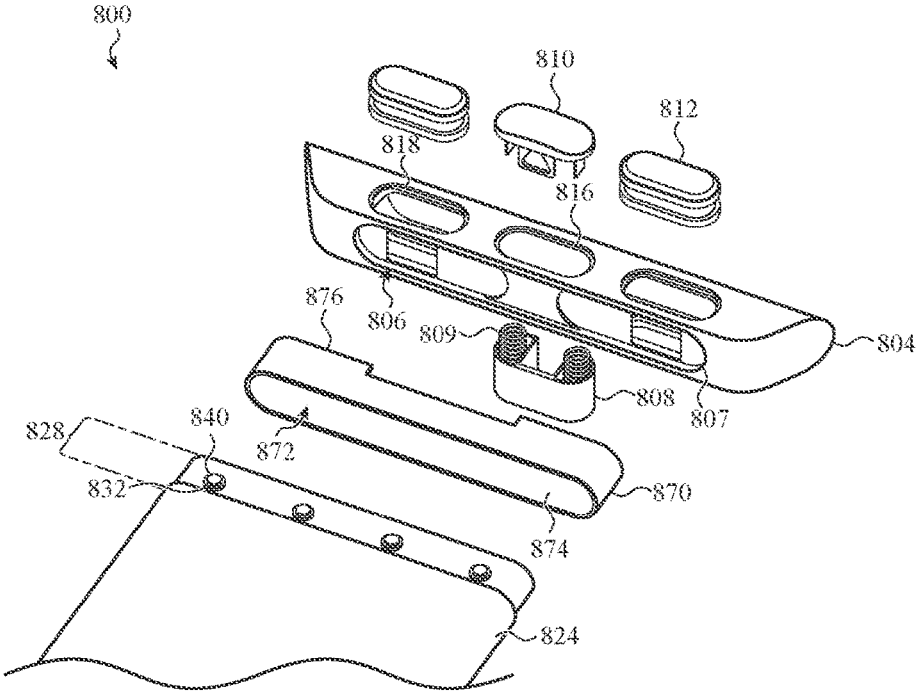
FIG. 8A illustrates an exploded view of an example attachment system.
Figure 8B:
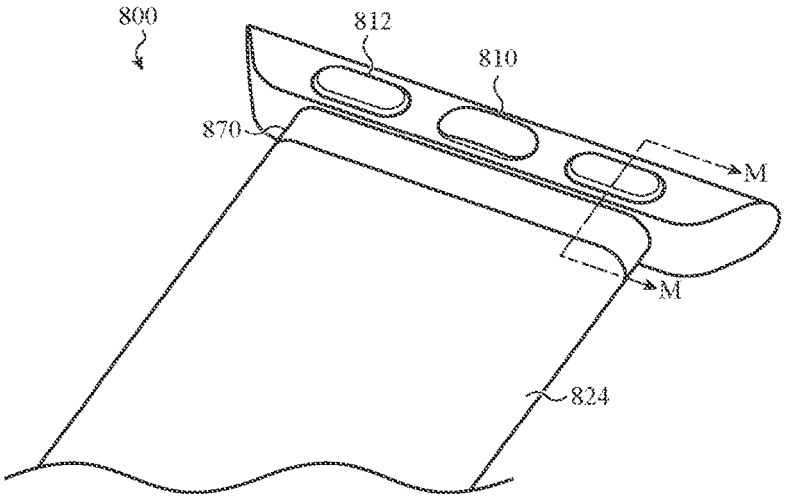
FIG. 8B illustrates a top view of the assembled attachment system of FIG. 8A.
Figure 8C:
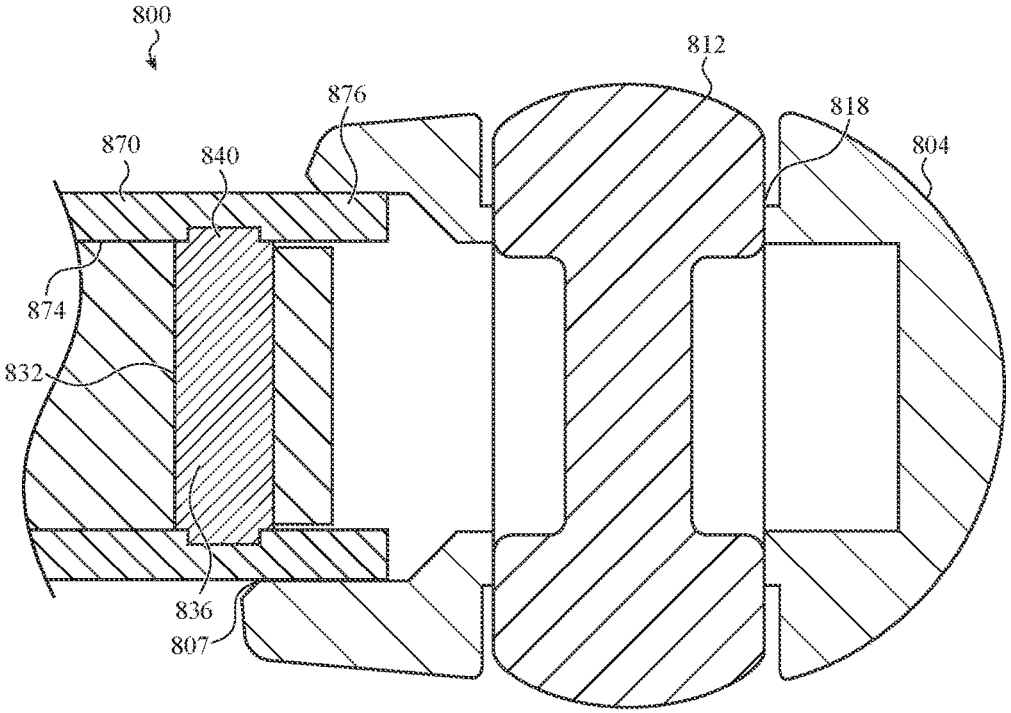
FIG. 8C illustrates a cross-sectional view of the attachment system of FIG. 8B taken along line M-M of FIG. 8B.

FIGS. 8A-8C illustrate various views and components of an attachment system 800, according to one or more embodiments of the present disclosure. The attachment system 800 shown and described with respect to FIGS. 8A-8C may be substantially analogous to the attachment system 200 described above with respect to FIGS. 2A-2D. For example, the attachment system 800 may be configured for removable engagement with a consumer product (e.g., such as the consumer product 108 depicted in FIG. 1). Further, the attachment system 800 may include a substantially flexible component and a substantially rigid component. In this regard, analogous to the components described in relation to the embodiments of FIGS. 2A-2D, the attachment system 800 may include: lug 804; cavity 806; cavity entrance 807; catch member 808; ramp 810; biasing springs 809; friction elements 812; port 816; openings 818; band 824; insert portion 828; apertures 832; pins 836; and studs 840.

FIG. 8A illustrates an exploded view of the attachment system 800, according to one or more embodiments of the present disclosure. Notwithstanding the foregoing similarities to the attachment system 200, the attachment system 800 may include one or more connecting members configured to non-separably interlock the band 824 to the lug 804. For example, in the embodiment depicted in FIG. 8A, the attachment system 800 may include sleeve 870.

In one embodiment, the sleeve 870 may be interposed between the band 824 and the lug 804. The sleeve 870 may provide a structure for connecting the band 824 and the lug 804. As one non-limiting example, the sleeve 870 may be an elongated structure that is substantially hollow. The sleeve 870 may include a sleeve cavity 872 that is defined by an internal volume of the sleeve 870. The sleeve 870 may be dimensioned such that the sleeve 870 receives the insert portion 828 within the sleeve cavity 872. In some embodiments, the sleeve cavity 872 may include a sleeve inner surface 874 that may include one or more features to engage the insert portion 828 (e.g., such that the pins 836 may engage the sleeve 870 to non-separably interlock the band 824 and the sleeve 870).

Further, sleeve 870 may include tabs 876. The tabs 876 may be configured for attachment with the lug 804. For example, the tabs 876 may extend from the sleeve 870 for positioning within the cavity 806. In some embodiments, the sleeve 870 may be attached to the lug 804 via a welded connection. In other instances, adhesives may be applied at the tabs 876 to attach the sleeve 870 to the lug 804.

FIG. 8B illustrates a top view of the assembled attachment system 800 of FIG. 8A, according to one or more embodiments of the present disclosure. By way of illustration, the insert portion 828 may be received by the sleeve 870 in order to non-separably interlock the band 824 with the lug 804. The insert portion 828 may be dimensioned such that an external surface of the band 824 and an external surface of the sleeve 870 may be substantially flush in a state in which the insert portion 828 is received by the sleeve 870. This may allow the attachment system 800 to non-separably interlock the band 824 and the lug 804 in a manner that maintains the aesthetic properties of the attachment system 800.

FIG. 8C is a cross-sectional view of the attachment system 800, taken along line M-M of FIG. 8B. In this regard, as illustrated, the band 824 may be non-separably interlocked with the lug 804 according to the embodiments described herein. In the assembled configuration, the insert portion 828 may be disposed within the sleeve cavity 872. The insert portion 828 may include pins 836 (which may be disposed in the apertures 832) of the insert portion 828. The pins 836 may include studs 840 that may extend from an external surface of the insert portion 828 for engagement with sleeve inner surface 874.

As depicted in FIG. 8C, the studs 840 may contactably engage the sleeve inner surface 874 to form an interference or friction fit with the sleeve inner surface 874. The interference or friction fit of the sleeve inner surface 874 and the studs 840 may restrict the movement of the band 824 relative to the sleeve 870 such that the band 824 may be non-separably interlocked with the sleeve 870. Additionally or alternatively, the band 824 may be non-separably interlocked with the lug 804 via an adhesive layer applied between the insert portion 828 and the sleeve 870. In some instances, a welded connection may be formed between the insert portion 828 and the sleeve 870 to non-separably interlock the band 824 and the lug 804.

Figure 9A:
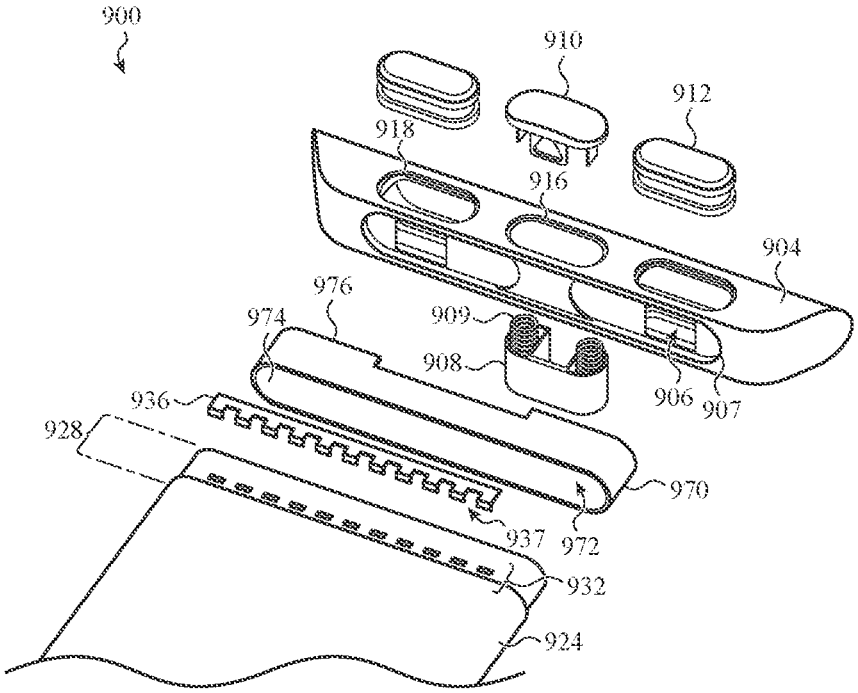
FIG. 9A illustrates an exploded view of an example attachment system.
Figure 9B:
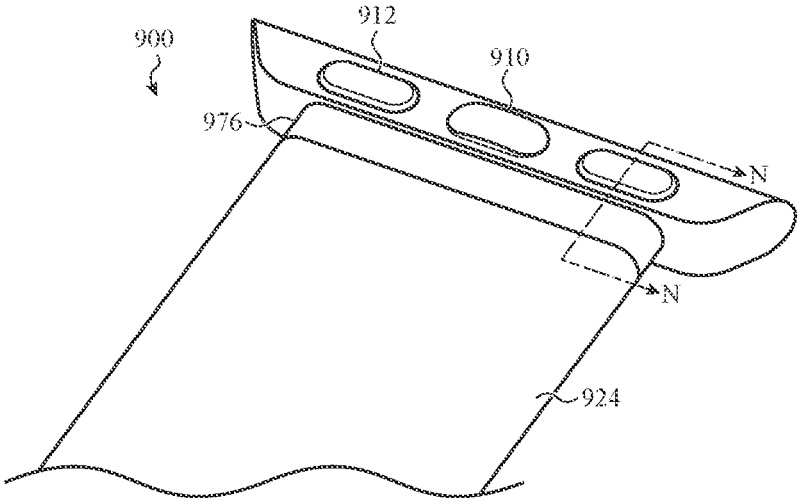
FIG. 9B illustrates a top view of the assembled attachment system of FIG. 9A.
Figure 9C:
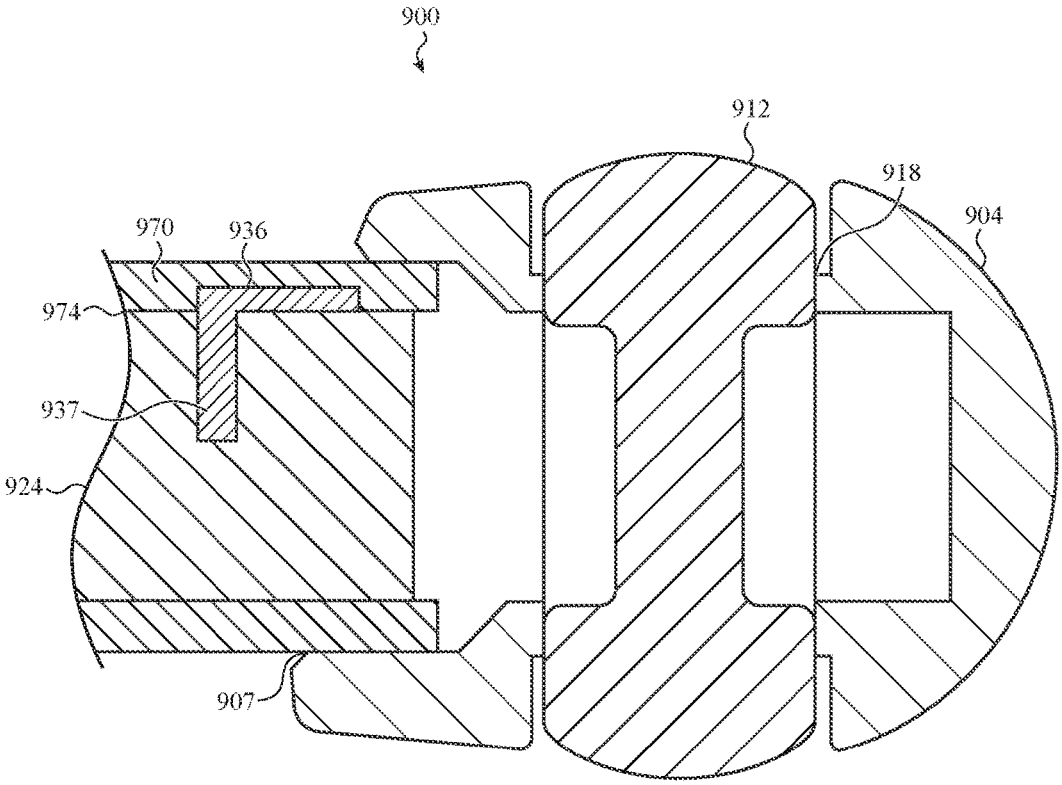
FIG. 9C illustrates a cross-sectional view of the attachment system of FIG. 9B taken along line N-N of FIG. 9B.

FIGS. 9A-9C illustrate various views and components of an attachment system 900, according to one or more embodiments of the present disclosure. The attachment system 900 shown and described with respect to FIGS. 9A-9C may be substantially analogous to the attachment system 800 described above with respect to FIG. 8A-FIG. 8C. For example, the attachment system 900 may be configured for removable engagement with a consumer product (e.g., such as the consumer product 108 depicted in FIG. 1). Further, the attachment system 900 may include a substantially flexible component and a substantially rigid component. In this regard, analogous to the components described in relation to the embodiments of FIGS. 8A-8C, the attachment system 900 may include: lug 904; cavity 906; cavity entrance 907; catch member 908; ramp 910; biasing springs 909; friction elements 912; port 916; openings 918; band 924; insert portion 928; apertures 932; studs 940; sleeve 970; sleeve cavity 972; sleeve inner surface 974; and tabs 976.

FIG. 9A illustrates an exploded view of the attachment system 900, according to one or more embodiments of the present disclosure. Notwithstanding the foregoing similarities to the attachment system 800, the attachment system 900 may include one or more engagement members configured to couple the band 924 to the sleeve 970. For example, in the embodiment depicted in FIG. 9A, the attachment system 900 may include plate 936. The plate 936 may include a pattern of fingers 937 configured for engagement with the apertures 932 of the insert portion 928 (e.g., at least a portion of the pattern of fingers 937 may be received by apertures 932). The plate 936 may be coupled to the sleeve 970 to facilitate the non-separable interlock of the band 924 and the lug 904.

FIG. 9B illustrates a top view of the assembled attachment system 900 of FIG. 9A according to one or more embodiments of the present disclosure. By way of illustration, the insert portion 928 may be received by the sleeve 970 in order to non-separably interlock the band 924 with the lug 904. The insert portion 928 may be dimensioned such that an external surface of the band 924 and an external surface of the sleeve 970 may be substantially flush in a state in which the insert portion 928 is received by the sleeve 970. In this regard, the attachment system 900 may non-separably interlock the band 924 and the lug 904 in a manner that maintains the aesthetic properties of the attachment system 900.

FIG. 9C illustrates a cross-sectional view of the attachment system 900, taken along line N-N of FIG. 9B. In this regard, as illustrated, the band 924 may be non-separably interlocked with the lug 904, according to the embodiments described herein. In the illustrated assembled configuration, the insert portion 928 may be disposed within the sleeve cavity 972. As such, the pattern of fingers 937 of the plate 936 may be disposed within the apertures 932. For example, the pattern of fingers 937 may extend from the plate 936 such that the pattern of fingers 937 may be received by the apertures 932. In this regard, the plate 936 may be disposed on an external surface of the insert portion 928 (e.g., such that the pattern of fingers 937 may be received by the apertures 932) and interposed between the insert portion 928 and the sleeve inner surface 974. Accordingly, the plate 936 may contactably engage the sleeve inner surface 974 to form an interference or friction fit with the sleeve inner surface 974.

The interference or friction fit of the sleeve inner surface 974 and the plate 936 may restrict the movement of the band 924 relative to the sleeve 970 such that the band 924 may be non-separably interlocked with the sleeve 970. Additionally or alternatively, a welded connection may be formed between the plate 936 and the sleeve inner surface 974 to non-separably interlock the band 924 and the lug 904. In some instances, an adhesive layer may be applied between the insert portion 928 and the sleeve 970 to non-separably interlock the band 924 to the lug 904.

Figure 10A:
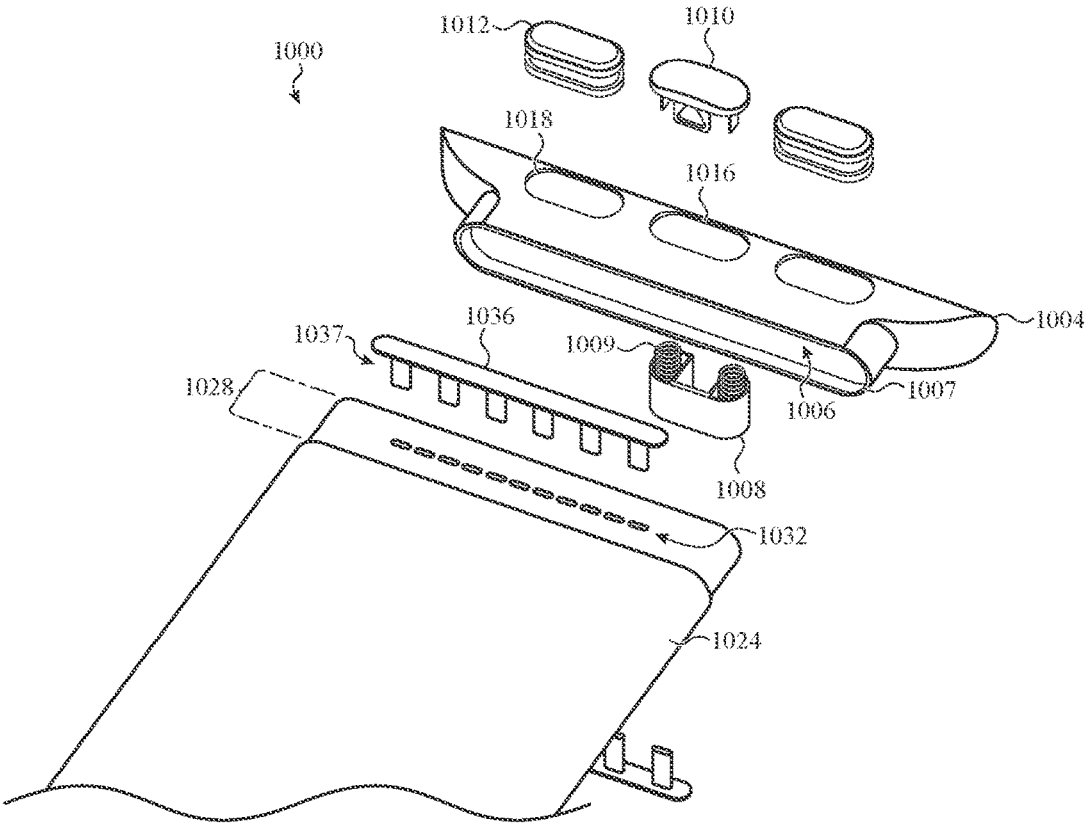
FIG. 10A illustrates an exploded view of an example attachment system.
Figure 10B:
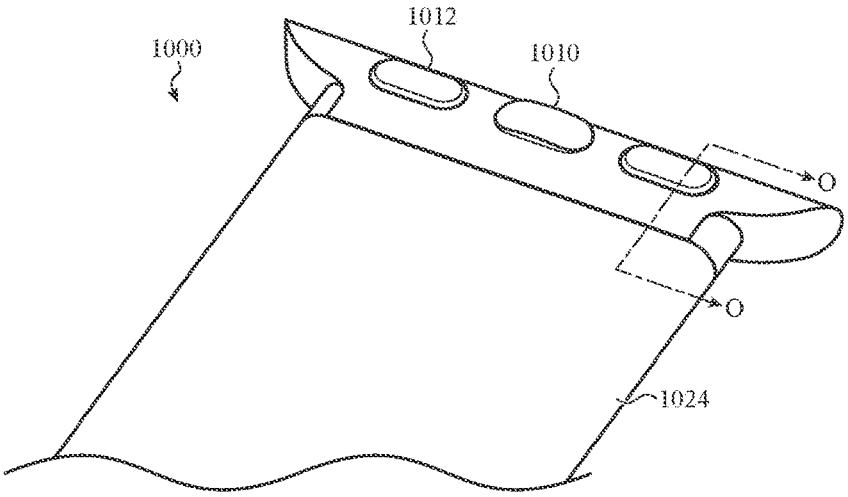
FIG. 10B illustrates a top view of the assembled attachment system of FIG. 10A.
Figure 10C:
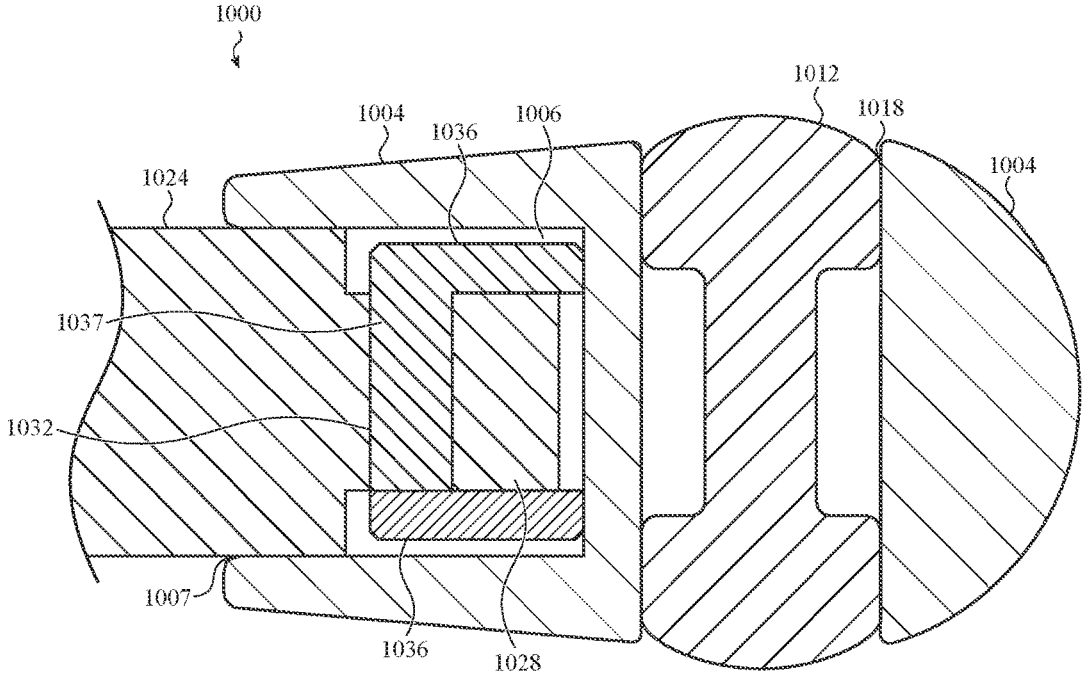
FIG. 10C illustrates a cross-sectional view of the attachment system of FIG. 10B taken along line O-O of FIG. 10B.

FIGS. 10A-10C illustrate various views and components of an attachment system 1000, according to one or more embodiments of the present disclosure. The attachment system 1000 shown and described with respect to FIGS. 10A-10C may be substantially analogous to the attachment system 500 described above with respect to FIGS. 5A-5D. For example, the attachment system 1000 may be configured for removable engagement with a consumer product (e.g., such as the consumer product 108 depicted in FIG. 1). Further, the attachment system 1000 may include a substantially flexible component and a substantially rigid component. In this regard, analogous to the components described in relation to the embodiments of FIGS. 5A-5D, the attachment system 1000 may include: lug 1004; cavity 1006; cavity entrance 1007; catch member 1008; ramp 1010; biasing springs 1009; friction elements 1012; port 1016; openings 1018; band 1024; insert portion 1028; and apertures 1032.

FIG. 10A illustrates an exploded view of the attachment system 1000, according to one or more embodiments of the present disclosure. Notwithstanding the foregoing similarities to the attachment system 500, the cavity 1006 of the attachment system 1000 may have a substantially uniform cross-dimensional area. This may allow the insert portion 1028 to be received within the cavity 1006 substantially free of any retention members and/or other protrusions or other features of the cavity 1006.

The attachment system 1000 may include plates 1036. The plates 1036 may include a pattern of fingers 1037. The apertures 1032 may be configured to receive the pattern of fingers 1037 to couple the plate 1036 to the insert portion 1028. In some instances, the plates 1036 may be a pair of plates disposed on external opposing surfaces of the insert portion 1028. This may allow the pattern of fingers 1037 of one of the pair of plates to be interposed with the pattern of fingers 1037 of another of the pair of plates at a position within the insert portion 1028. To facilitate the foregoing, the pattern of fingers 1037 may be received at non-adjacent ones of the apertures 1032.

FIG. 10B illustrates a top view of the assembled attachment system 1000 of FIG. 10A, according to one or more embodiments of the present disclosure. By way of illustration, the insert portion 1028 may be placed within the cavity 1006 in order to non-separably interlock the band 1024 with the lug 1004. Notably, the insert portion 1028 may be substantially disposed within the cavity 1006 such that the various components described herein to facilitate the non-separable interlock of the band 1024 and the lug 1004 (e.g., the plates 1036) may be concealed from view in the assembled state. In this regard, the attachment system 1000 may non-separably interlock the band 1024 and the lug 1004 in a manner that maintains the aesthetic properties of the attachment system 1000.

FIG. 10C is a cross-sectional view of the attachment system 1000, taken along line O-O of FIG. 10B. In this regard, as illustrated, the band 1024 may be non-separably interlocked with the lug 1004, according to the embodiments described herein. In the assembled configuration, the insert portion 1028 may be disposed within the cavity 1006. The plates 1036 may be disposed within the cavity 1006 and adjacent the insert portion 1028. For example, each of the pair of plates 1036 may be disposed adjacent opposing external surfaces of the insert portion 1028. In turn, the pattern of fingers 1037 of each of the plates 1036 may be disposed within the apertures 1032.

In one implementation, the plates 1036 may contact a surface of the cavity 1006. For example, as shown in FIG. 10C, at least a portion of the plates 1036 may extend beyond a perimeter of the insert portion 1028. A welded connection may be formed between the plates 1036 and the cavity 1006. The welded connection may be operative to non-separably interlock the band 1024 and the lug 1004. For example, the welded connection between the plates 1036 and the cavity 1006 may non-separably interlock the plates 1036 and the cavity 1006. This may allow the pattern of fingers 1037 of the plates 1036 (e.g., which are received by apertures 1032) to provide a structural barrier that restricts the movement of the band 1024 relative to the lug 1004. Additionally or alternatively, an adhesive layer may be applied within the cavity 1006 to couple the plate 1036 to the cavity 1006.

Figure 11A:
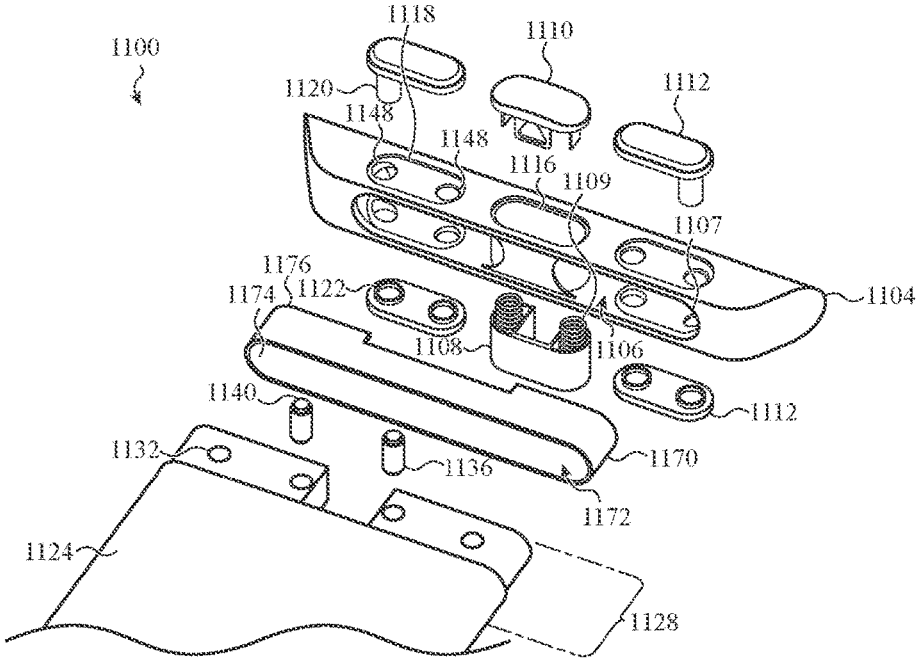
FIG. 11A illustrates an exploded view of an example attachment system.
Figure 11B:
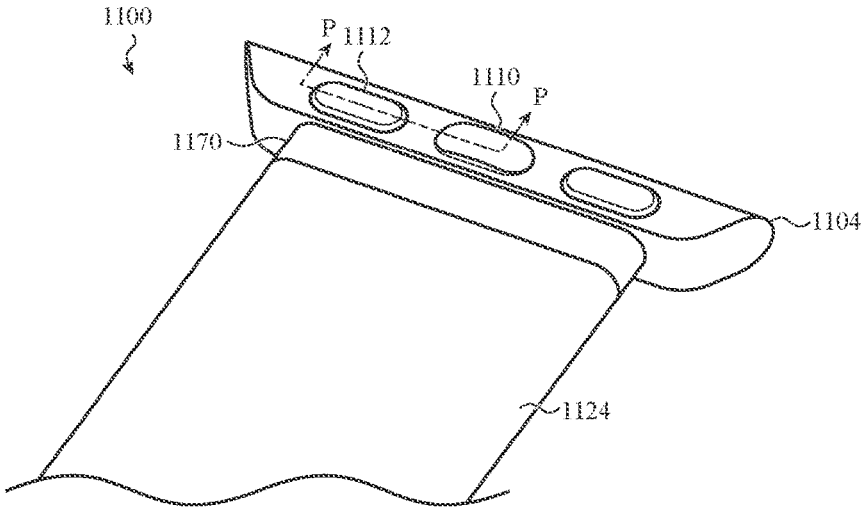
FIG. 11B illustrates a top view of the assembled attachment system of FIG. 11A.
Figure 11C:
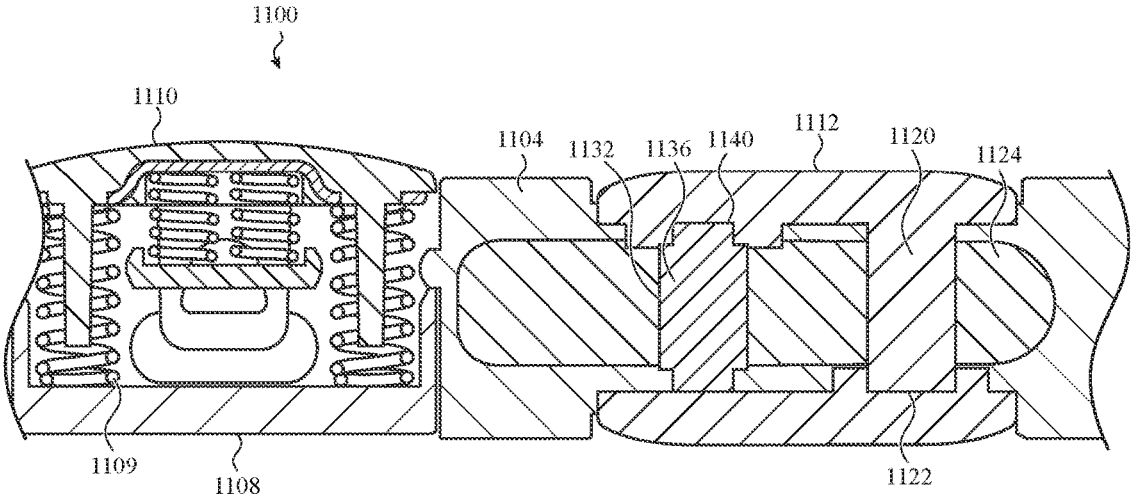
FIG. 11C illustrates a cross-sectional view of the attachment system of FIG. 11B taken along line P-P of FIG. 11B.

FIGS. 11A-11C illustrate various views and components of an attachment system 1100, according to one or more embodiments of the present disclosure. The attachment system 1100 shown and described with respect to FIGS. 11A-11C may be substantially analogous to the attachment system 800 described above with respect to FIG. 8A-FIG. 8C. For example, the attachment system 1100 may be configured for removable engagement with a consumer product (e.g., such as the consumer product 108 depicted in FIG. 1). Further, the attachment system 1100 may include a substantially flexible component and a substantially rigid component. In this regard, analogous to the components described in relation to the embodiments of FIGS. 11A-11C, the attachment system 1100 may include: lug 1104; cavity 1106; cavity entrance 1107; catch member 1108; ramp 1110; biasing springs 1109; friction elements 1112; port 1116; openings 1118; band 1124; insert portion 1128; apertures 1132; studs 1140; sleeve 1170; sleeve cavity 1172; sleeve inner surface 1174; and tabs 1176.

FIG. 11A illustrates an exploded view of the attachment system 1100, according to one or more embodiments of the present disclosure. Notwithstanding the foregoing similarities to the attachment system 800, the attachment system 1100 may include an insert portion 1128 that may be vertically aligned with the friction elements 1112. By way of particular example, the insert portion 1128 may extend through the sleeve 1170 such that the apertures 1132 may be vertically aligned with the friction elements 1112 (e.g., the apertures 1132 and the friction elements 1112 may be positioned along a common axis).

The friction elements 1112 may include shafts 1120. The shafts 1120 may extend from a surface of the friction elements 1112 and into the lug 1104 to engage the insert portion 1128. For example, the shafts 1120 may be received by the apertures 1132 of the insert portion 1128. The dispositions of the shafts 1120 may non-separably interlock the band 1124 and the lug 1104 by providing a structural barrier that restricts the movement of the band 1124 relative to the lug 1104.

To facilitate the foregoing, at least a subset of the friction elements 1112 may include receiving recesses 1122. The receiving recesses 1122 may be configured to receive a portion of the shafts 1120 that extend through the apertures 1132. The receiving recesses 1122 may also be configured to receive studs 1140 in a configuration in which the pins 1136 are disposed within insert portion 1128.

FIG. 11B illustrates a top view of the assembled attachment system 1100 of FIG. 11A, according to one or more embodiments of the present disclosure. By way of illustration, the insert portion 1128 may be received by the sleeve 1170 in order to non-separably interlock the band 1124 with the lug 1104. The insert portion 1128 may be dimensioned such that an external surface of the band 1124 and an external surface of the sleeve 1170 may be substantially flush in a state in which the insert portion 1128 is received by the sleeve 1170. In this regard, the attachment system 1100 may non-separably interlock the band 1124 and the lug 1104 in a manner that maintains the aesthetic properties of the attachment system 1100.

FIG. 11C illustrates a cross-sectional view of the attachment system 1100, taken along line P-P of FIG. 11B. In this regard, as illustrated, the band 1124 may be non-separably interlocked with the lug 1104 according to the embodiments described herein. In the illustrated configuration, the insert portion 1128 may be disposed within the cavity 1106 such that the insert portion 1128 is vertically aligned with the friction elements 1112. The vertical alignment of the insert portion 1128 and the friction elements 1112 may allow the apertures 1132 to receive pins 1136 and shafts 1120. The receipt of the pins 1136 and the shafts 1120 may non-separably interlock the band 1124 and the lug 1104.

Accordingly, the pins 1136 and the shafts 1120 may each facilitate the non-separable interlock of the band 1124 and the lug 1104. For example, the pins 1136 and the shafts 1120 may form a barrier between a portion of the insert portion 1128 and the cavity entrance 1107 to restrict movement of the band 1124 relative to the lug 1104. Additionally or alternatively, an adhesive layer may be applied within the lug 1104 to non-separably interlock the lug 1004 with the band 1124.

Figure 12A:
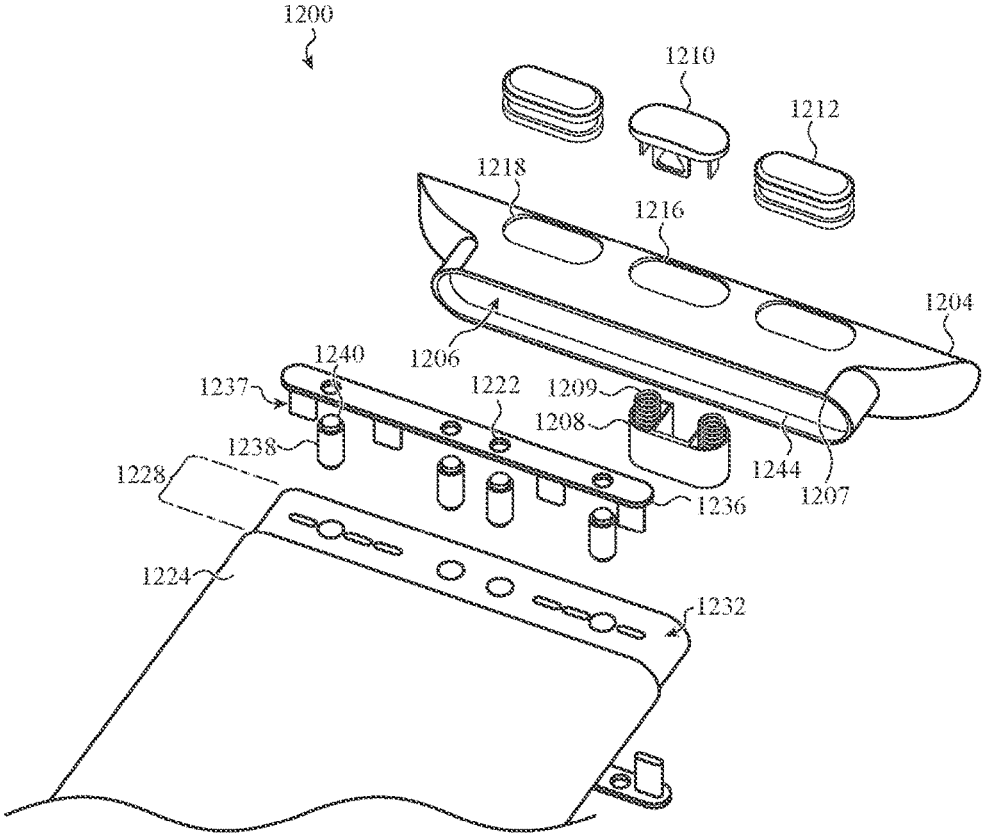
FIG. 12A illustrates an exploded view of an example attachment system.
Figure 12B:
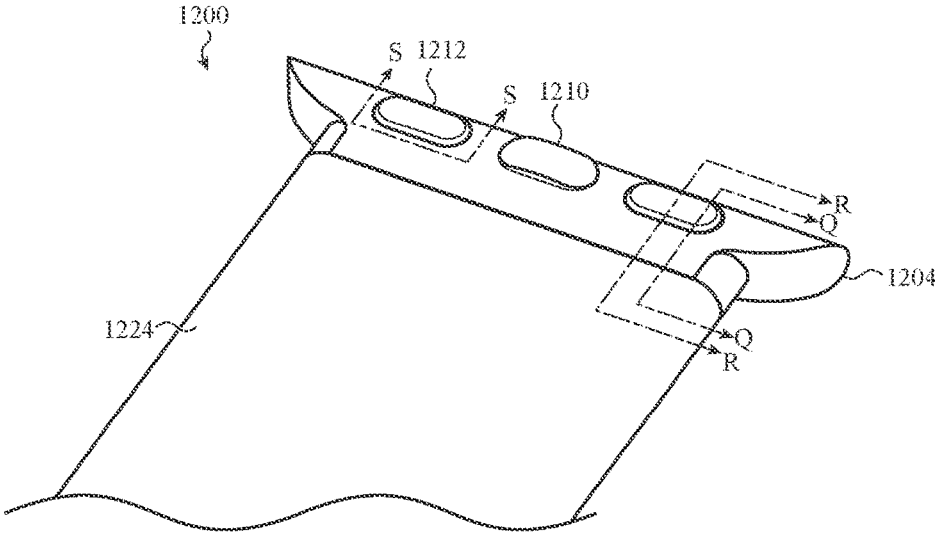
FIG. 12B illustrates a top view of the assembled attachment system of FIG. 12A.
Figure 12C:
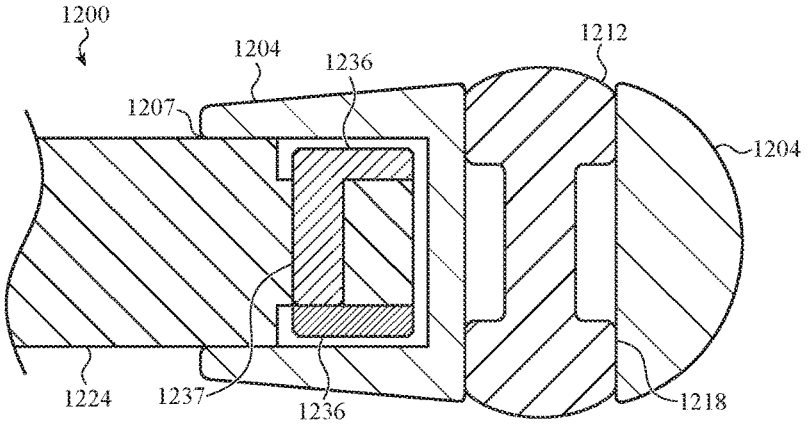
FIG. 12C illustrates a cross-sectional view of the attachment system of FIG. 12B taken along line Q-Q of FIG. 12B.

FIGS. 12A-12C illustrate various views and components of an attachment system 1200, according to one or more embodiments of the present disclosure. The attachment system 1200 shown and described with respect to FIGS. 12A-12C may be substantially analogous to the attachment system 1000 described above with respect to FIGS. 10A-10D. For example, the attachment system 1200 may be configured for removable engagement with a consumer product (e.g., such as the consumer product 108 depicted in FIG. 1). Further, the attachment system 1200 may include a substantially flexible component and a substantially rigid component. In this regard, analogous to the components described in relation to the embodiments of FIGS. 10A-10D, the attachment system 1200 may include: lug 1204; cavity 1206; cavity entrance 1207; catch member 1208; ramp 1210; biasing springs 1209; friction elements 1212; port 1216; openings 1218; band 1224; insert portion 1228; apertures 1232; plates 1236; pattern of fingers 1237; retention members 1244; and grooves 1248.

FIG. 12A illustrates an exploded view of the attachment system 1200, according to one or more embodiments of the present disclosure. Notwithstanding the foregoing similarities to the attachment system 1000, the attachment system 1200 may include pins 1238 having studs 1240. The plate 1236 may contain bores 1222 that are configured to receive the studs 1240. Accordingly, the pins 1238 may be disposed within the apertures 1232 such that the studs 1240 extend from an external surface of the insert portion 1228. In this manner, the pins 1238 may extend from the external surface of the insert portion 1228 to engage a surface of the cavity 1206.

FIG. 12B illustrates a top view of the assembled attachment system 1200 of FIG. 12A, according to one or more embodiments of the present disclosure. By way of illustration, the insert portion 1228 may be placed within the cavity 1206 in order to non-separably interlock the band 1224 within the lug 1204. The insert portion 1228 may be substantially disposed within the cavity 1206 such that the various components described herein to facilitate the non-separable interlock of the band 1224 and the lug 1204 (e.g., including the plates 1236) may be concealed from view in the assembled state. In this regard, the attachment system 1200 may non-separably interlock the band 1224 and the lug 1204 in a manner that maintains the aesthetic properties of the attachment system 1200.

Figure 12D:
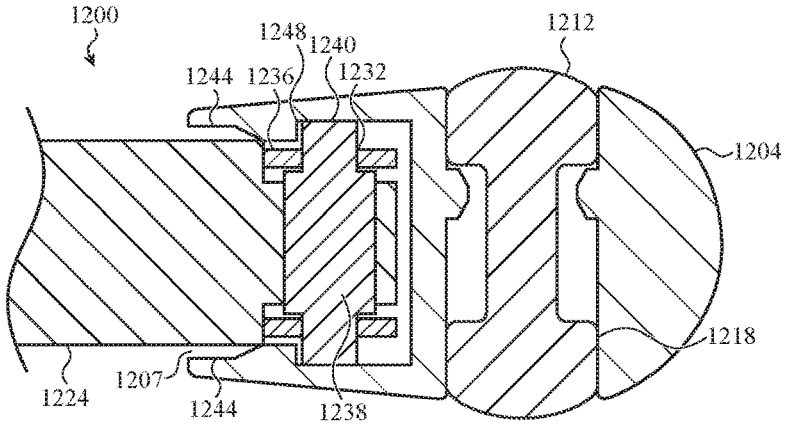
FIG. 12D illustrates a cross-sectional view of the attachment system of FIG. 12B taken along line R-R of FIG. 12B.
Figure 12E:
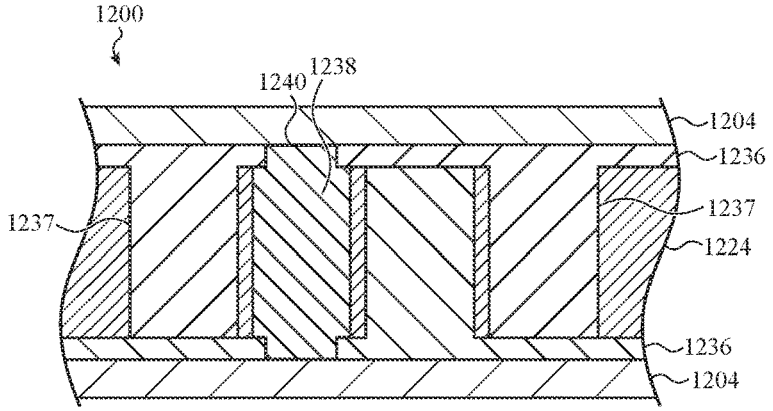
FIG. 12E illustrates a cross-sectional view of the attachment system of FIG. 12B taken along line S-S of FIG. 12B.

FIGS. 12C-12E illustrate various cross-sectional views of the attachment system 1200. In particular, FIG. 12C is a cross-sectional view of the attachment system 1200, taken along line Q-Q of FIG. 12B; FIG. 12D is a cross-sectional view of the attachment system 1200, taken along line R-R of FIG. 12B; and FIG. 12E is a cross-sectional view of the attachment system 1200, taken along line S-S of FIG. 12B. In this regard, as illustrated, the band 1224 may be non-separably interlocked with the lug 1204 in a manner substantially analogous to that of attachment system 200 depicted in FIG. 2A-FIG. 2D. For example, insert portion 1228 may be disposed within the cavity 1206 such that the retention members 1244 may retain the pins 1238. Additionally or alternatively, a welded connection may be formed between the plates 1236 and the lug 1204 to non-separably interlock between the band 1224 and the lug 1204.

As depicted in FIGS. 12C-12E, the bores 1222 of the plates 1236 may be through holes. In this regard, in the assembled configuration, the studs 1240 may extend from an external surface of the insert portion 1228 and through one of the bores 1222 to engage a surface of the cavity 1206. For example, the studs 1240 may be received by the grooves 1248. The plates 1236 may have a greater material stiffness than the insert portion 1228. In this manner, the plates 1236 may structurally reinforce the insert portion 1228 where the studs 1240 engage with the grooves 1248.

FIGS. 13A-13E illustrate various views and components of an attachment system 1300, according to one or more embodiments of the present disclosure. The attachment system 1300 shown and described with respect to FIGS. 13A-13B may be substantially analogous to the attachment system 200 described above in relation to FIGS. 2A-2D. For example, the attachment system 1300 may be configured for removable engagement with a consumer product (e.g., such as the consumer product 108 depicted in FIG. 1). Further, the attachment system 1300 may include a substantially flexible component and a substantially rigid component. In this regard, analogous to the components described in relation to the embodiments of FIGS. 2A-2D, the attachment system 1300 may include: lug 1304; cavity 1306; cavity entrance 1307; catch member 1308; ramp 1310; biasing springs 1309; friction elements 1312; port 1316; openings 1318; band 1324; insert portion 1328; apertures 1332; pins 1336; and grooves 1348.

Figure 13A:
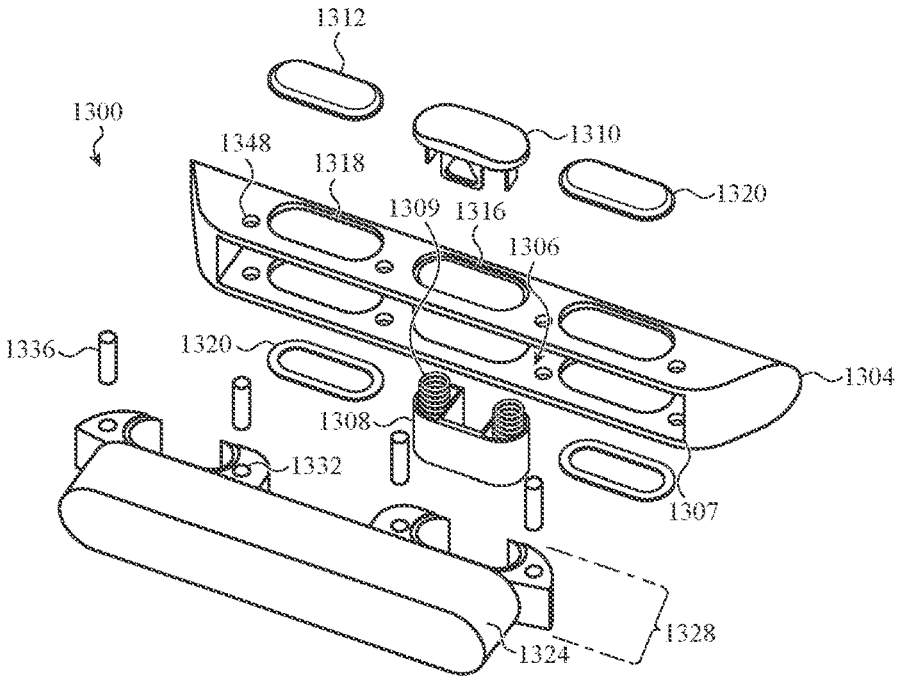
FIG. 13A illustrates an exploded view of an example over-molded attachment system.

FIG. 13A illustrates an exploded perspective view of the attachment system 1300 according to one or more embodiments of the present disclosure. Notwithstanding the foregoing similarities to the attachment system 200, the lug 1304 may be an over-molded component. It will be appreciated that the lug 1304 may be an over-molded attachment structure, housing, or other like component. For example, the lug 1304 may be formed from an injection moldable plastic that is molded over the band 1324. In this regard, the lug 1304 may be directly bonded to an external surface of the insert portion 1328 such that the band 1324 may be non-separably interlocked with the lug 1304. In some instances, additional injection-moldable plastic layers may be bonded to an external surface of the lug 1304 to form a multi-layer lug structure which envelops the band 1324.

To facilitate the bonding of the lug 1304 and the band 1324, the attachment system 1300 may include one or more securement mechanisms. For example, the band 1324 may include apertures 1332. In one embodiment, the injection-moldable plastic of the lug 1304 may be caused to flow into the apertures 1332 such that the injection moldable plastic may form a bond with the band 1324. Additionally or alternatively, the attachment system 1300 may include pins 1336. The pins 1336 may be positioned with the aperture 1332 such that the pins 1336 extend beyond a surface of the insert portion 1328. In some instances, the lug 1304 may be molded over the pins 1336.

In an alternative embodiment, the lug 1304 may include grooves 1348. The grooves 1348 may be through portions that may be vertically aligned with one or more of the apertures 1332 (e.g., the grooves 1348 and the pins 1336 may be positioned along a common axis). Accordingly, in an assembled, over-molded configuration, the pins 1336 may be positioned within the grooves 1348 and the apertures 1332.

Figure 13B:
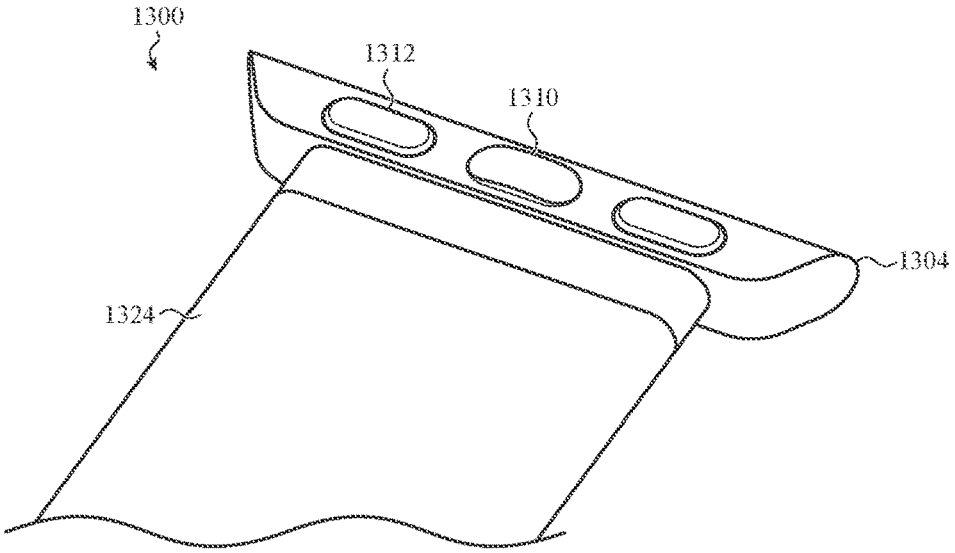
FIG. 13B illustrates a top view of the assembled attachment system of FIG. 13A.

FIG. 13B illustrates a top view of the assembled attachment system 1300 of FIG. 13A, according to one or more embodiments of the present disclosure. In the assembled configuration, lug 1304 is shown as being molded over the insert portion 1328. In this regard, the attachment system 1300 may non-separably interlock the band 1324 and the lug 1304 in a manner that maintains the aesthetic properties of the attachment system 1300. For example, the band 1324 may be directly bonded with the lug 1304 in a manner that is concealed from the user.

Figure 14A:
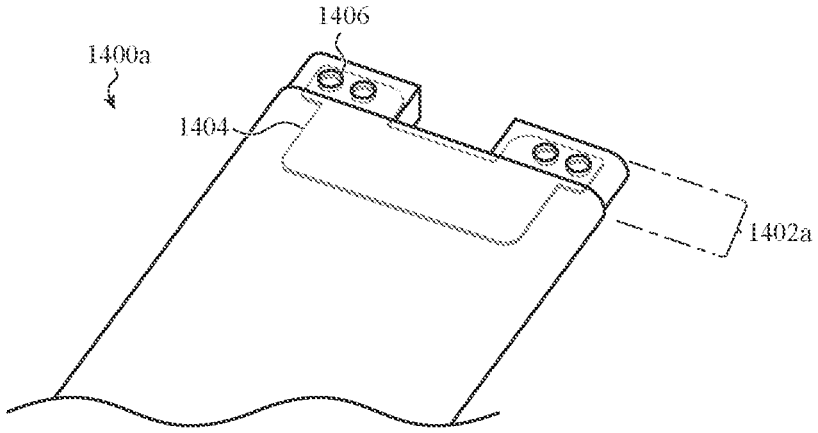
FIG. 14A illustrates a top view of an example band having one or more reinforcement members.
Figure 14B:
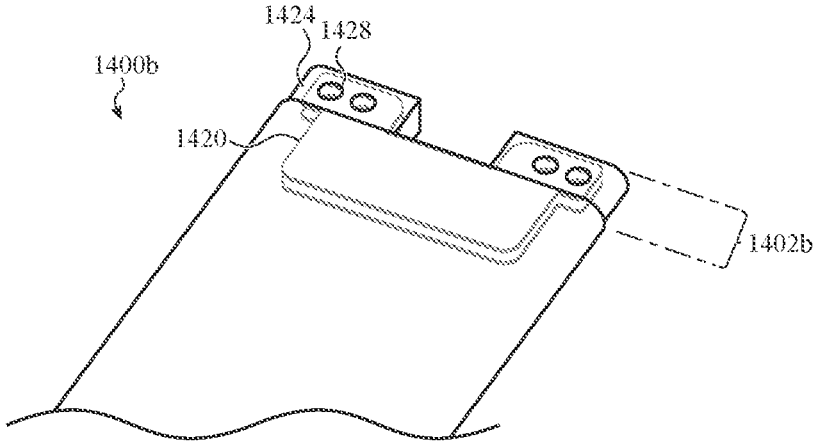
FIG. 14B illustrates a top view of an example band having one or more reinforcement members.

FIGS. 14A-14B illustrate various views and components of example bands 1400*a* and 1400*b* (collectively referred to as "the example bands"), according to one or more embodiments of the present disclosure. The example bands shown and described with respect to FIGS. 14A-14B may be substantially analogous to the band 136 described above with respect to FIG. 1. For example, the example bands may non-separably interlock with a lug, attachment structure, housing, or other like feature (e.g., such as the lug 132 depicted in FIG. 1). In this regard, the example bands may be a component of an attachment system (e.g., such as the attachment system 104 depicted in FIG. 1) that is operative to attach a consumer product to a user. Specific shapes and orientations are described below with respect to the example bands and the various components of the example bands. However, the disclosed shapes and orientations of the example bands, and any associated components, are not limiting and are used as examples. Accordingly, similar shapes and orientations of the example bands, and the associated components, described below with respect to FIGS. 14A-14B, may be used with the various embodiments of the attachment system described herein.

FIG. 14A illustrates an assembled view of the band 1400*a*. The band may be a strap or other feature attachable to a user. The band 1400*a* may have an insert portion 1402*a* configured to non-separably interlock with a lug. As shown in FIG. 14A, insert portion 1402*a* may include two prongs. The lug may an attachment structure, housing, or other structure configured for removable engagement with a consumer product. The band 1400*a* may include a plate 1404. The plate 1404 may be positioned within the band 1400*a* such that the band 1400*a* envelops the plate 1404. The plate 1404 may have a greater material stiffness than the band 1400*a*. In this regard, the plate 1404 may structurally reinforce a portion of the band 1400*a*.

In some instances, the plate 1404 may include apertures 1406 that are vertically aligned with the insert portion 1402*a*. For example, the apertures 1406 may be vertically aligned with one or more through portions of the insert portion 1402*a* that may be configured to receive one or more elements to non-separably interlock the band 1400*a* and lug (e.g., such as lug 132 depicted in FIG. 1). In some instances, additional structural elements may be disposed within the band 1400*a*, including additional plates disposed within the band 1400*a* in spaced relation with the plate 1404.

FIG. 14B illustrates an assembled view of the band 1400*b*. The band 1400*b* may have an insert portion 1402*b* configured to non-separably interlock with a lug. As shown in FIG. 14B, insert portion 1402*b* may include two prongs. The band 1400*b* may include plates 1420. The plates 1420 may be disposed within the band 1400*b* such that the band 1400*b* envelops the plates 1420. The plates 1420 may be positioned within the band 1400*b* in spaced relation to one another and provide structural reinforcement to the band 1400*b*.

The band 1400*b* may include reinforcement bars 1424. The plates 1420 may be connected to, or integrally formed with, the reinforcement bars 1424. The reinforcement bars 1424 may be disposed within the band 1400*b* to provide structural reinforcement to the insert portion 1402*b*. For example, the reinforcement bars 1424 may have a greater material stiffness than the band 1400*b*.

In some instances, the reinforcement bars 1424 may include apertures 1428. The apertures 1428 may be vertically aligned with a through portion of the insert portion 1402*b*. In some embodiments, the apertures 1428 may be configured to engage one or more features to facilitate the non-separable interlock of the band 1400*b* one or more of the lugs described herein. In this regard, the reinforcement bars 1424 may be configured to reinforce the non-separable interlock of the band 1400*b* and the lug. As shown in FIG. 14B, the plates 1420 may be coupled with the reinforcement bars 1424 to provide additional structural reinforcement of the band 1400*b* of the insert portion 1402*b*. In another embodiment, the plates 1420 may be integrally formed with the reinforcement bars 1424 such that the plates 1420 and the reinforcement bars 1424 form a single, unitary component. In some instances, the reinforcement bars 1424 may define a portion of an outer surface of the insert portion 1402*b*.

Figure 15A:
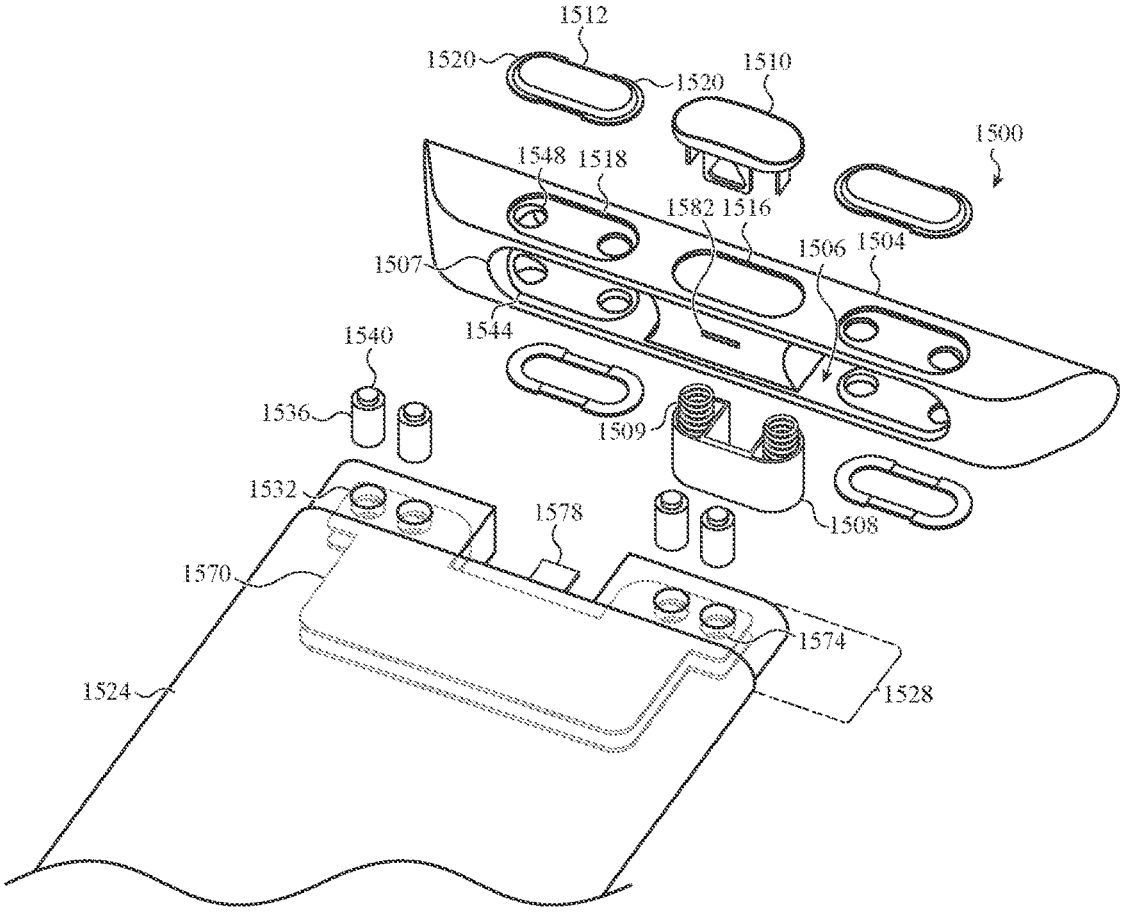
FIG. 15A illustrates an exploded view of an example attachment system.
Figure 15B:
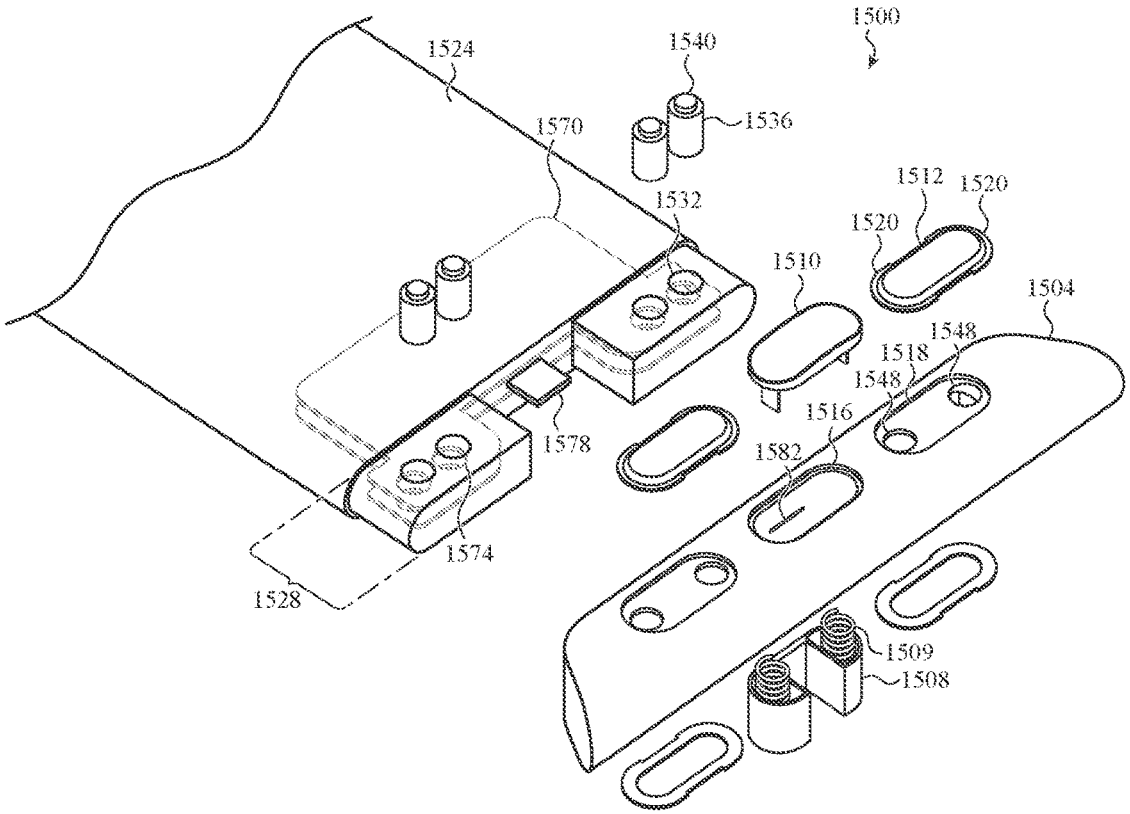
FIG. 15B illustrates an exploded view of an example attachment system.

FIGS. 15A-15B illustrate exploded views of an attachment system 1500, according to one or more embodiments of the present disclosure. The attachment system 1500 shown and described may be substantially analogous to the attachment system 200 described above with respect to FIG. 2. For example, the attachment system 1500 may be configured for removable engagement with a consumer product (e.g., such as the consumer product 108 depicted in FIG. 1). Further, the attachment system 1500 may include a substantially flexible component and a substantially rigid component. In this regard, analogous to the components described in relation to the embodiments of FIGS. 2A-2D, the attachment system 1500 may include: lug 1504; cavity 1506; cavity entrance 1507; catch member 1508; ramp 1510; biasing springs 1509; friction elements 1512; port 1516; opening 1518; band 1524; insert portion 1528; apertures 1532; pins 1536; studs 1540; retention members 1544; and grooves 1548.

Notwithstanding the foregoing similarities to the attachment system 200, the attachment system 1500 may include one or more structural members configured to reinforce the band 1524. For example, in the embodiment depicted in FIG. 15, the attachment system 1500 may include plate 1570. The plate 1570 may be substantially analogous to the plate 1404 described with respect to FIG. 14A. The plate 1570 may be positioned within the band 1524 such that the band envelops the plate 1570. The plate 1570 may have a greater material stiffness than the band 1524, thereby providing structural reinforcement to the band 1524.

In some embodiments, the plate 1570 may be disposed within the insert portion 1528 to structurally reinforce the non-separably interlocked connection between the band 1524 and the lug 1504. For example, the plate 1570 may include holes 1574. The holes 1574 may be vertically aligned with apertures 1532. In this regard, pins 1536 may be received by the apertures 1532 and the holes 1574 to facilitate the non-separable interlock between the band 1524 and the lug 1504.

In another embodiment, the plate 1570 may be configured to non-separably interlock the lug 1504 and the band 1524. For example, plate 1570 may include tab 1578. Tab 1578 may be coupled to, or integrally formed with, the plate 1570 (e.g., such that the plate 1570 and the tab 1578 may be a single, unitary component). The tab 1578 may extend beyond a perimeter of the insert portion 1528 to define a protrusion. The tab 1578 may be engaged with a portion of the lug 1504 to non-separably interlock the band 1524 and the lug 1504. For example, lug 1504 may include receiving socket 1582. Receiving socket 1582 may be configured to receive the tab 1578. In one embodiment, a welded connection may be formed between the tab 1578 and the receiving socket 1582 to non-separably interlock the band 1524 and the lug 1504.

Figure 16:
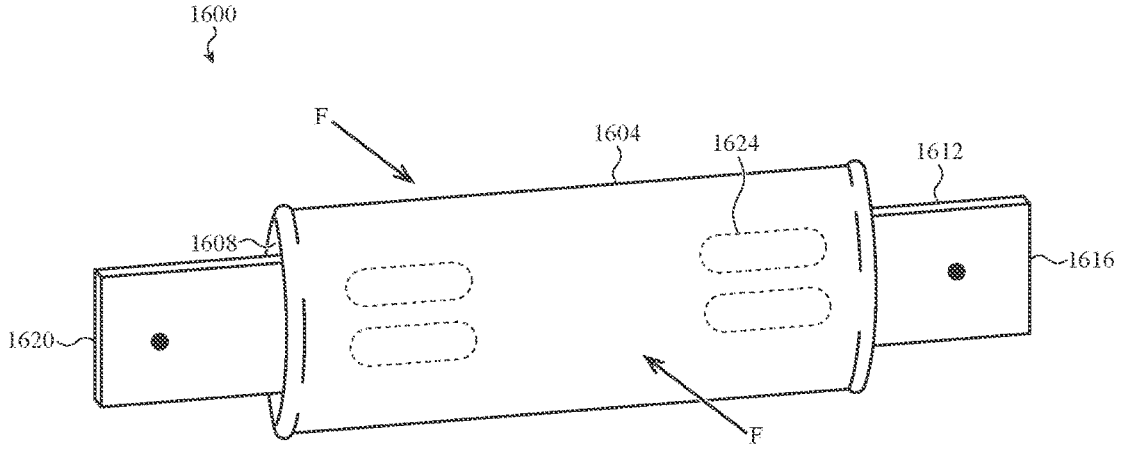
FIG. 16 illustrates an example system for reinforcing a flexible band.

FIG. 16 illustrates an example reinforcement system 1600. Reinforcement system 1600 may be configured to join a substantially flexible component and a substantially rigid component in a manner that maintains the aesthetic characteristics of the flexible component. For example, the reinforcement system 1600 may be configured to structurally reinforce the flexible component in a manner that maintains at least a portion of the band substantially free of defects or other imperfections indicative of bonding a flexible band to a reinforcement structure.

By way of particular example, the reinforcement system 1600 may include band 1604. The band 1604 may be a woven band that may be formed from a variety of appropriate materials, including nylons and other appropriate polymers. In this regard, the band 1604 may be configured to melt upon the localized application of heat. In one embodiment, the band 1604 may be a substantially hollow structure having a cavity 1608.

The reinforcement system 1600 may also include a metal sheet 1612. The metal sheet 1612 may be disposed within the cavity 1608 such that the band 1604 surrounds at least a portion of the metal sheet 1612. The metal sheet 1612 may be constructed from any appropriate material that is electrically conductive. In particular, the metal sheet 1612 may be any conductive material that generates a sufficient quantity of heat upon the induction of an electric current across a portion of the metal sheet 1612. Possible materials may include silver, copper, gold, aluminum, and/or other appropriate metals or metal alloys.

Electrical current is induced across at least a portion of the metal sheet 1612. As depicted in FIG. 16, the metal sheet 1612 may include a first end 1616 having a first electric potential and a second end 1620 having a second electric potential. The first electric potential and the second electric potential may be different such that electrical current may flow between the first end 1616 and the second end 1620 or the second end 1620 and the first end 1616. For example, the metal sheet 1612 may be connected to an external power source in order to cause the first end 1616 to have the first electric potential and the second end 1620 to have the second electric potential.

The inducement of electrical current between the first end 1616 and the second end 1620 may generate heat. The generation of heat by the metal sheet 1612 may melt at least a portion of the band 1604. When the band 1604 is in a melted state, the melted portion may be manipulated to facilitate the joining of the band 1604 and the metal sheet 1612.

The metal sheet 1612 may include one or more features to facilitate the attachment of the band 1604 to the metal sheet 1612. For example, the metal sheet 1612 may include securement mechanisms 1624. The securement mechanisms 1624 may be holes, apertures, recesses, and/or other features of the metal sheet 1612. In this regard, in one implementation, the securement mechanisms 1624 may be through portions. Accordingly, the securement mechanisms 1624 may be configured to receive a portion of the band 1604 to facilitate the joining of the band 1604 with the metal sheet 1612. For example, a melted portion of the band 1604 may be caused to flow into and/or through one or more of the securement mechanisms 1624 to join the band 1604 and the metal sheet 1612.

The band 1604 may be configured to receive a force "F" on opposing external surfaces of band 1604. The force "F" applied at both of the opposing external surfaces of the band 1604 may compress the band 1604 relative to the metal sheet 1612. In one implementation, the force may be received from a non-metallic object.

To facilitate the reader's understanding of the various functionalities of the embodiments discussed herein, reference is now made to the flow diagrams in FIGS. 17-20, which illustrates processes 1700, 1800, 1900, and 2000, respectively. While specific steps (and orders of steps) of the methods presented herein have been illustrated and will be discussed, other methods (including more, fewer, or different steps than those illustrated) consistent with the teachings presented herein are also envisioned and encompassed with the present disclosure.

Figure 17:
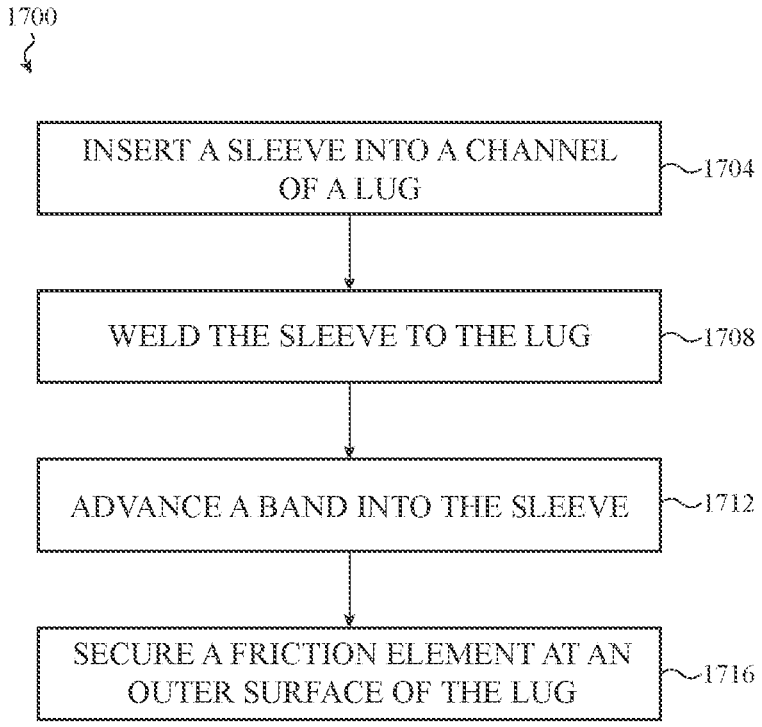
FIG. 17 is a flow diagram of a method for assembling an attachment system for an electronic device.

In this regard, with reference to FIG. 17, process 1700 relates generally to assembling an attachment system for a consumer product. The process 1700 may be used in conjunction with the consumer product described herein (e.g., consumer product 108). At operation 1704, a sleeve may be inserted into a channel of a lug. The lug may an attachment structure, housing, or other structure configured for removable engagement with a consumer product. For example and with reference to FIG. 8A, the sleeve 870 may be inserted into the cavity 806 via the cavity entrance 807. In some cases, the sleeve 870 may include tabs 876. In this manner, the sleeve 870 may be inserted into the cavity 806 such that at least a portion of tabs 876 engage an interior surface of the cavity 806.

At operation 1708, the sleeve may be welded to the lug. For example and with reference to FIG. 8A, a welded connection may be formed between a portion of the sleeve 870 and the lug 804. For example, a welded connection may be formed between the tabs 876 and an interior surface of the cavity 806. The welded connection between the sleeve 870 and the lug 804 may non-separably interlock the sleeve 870 to the lug 804.

At operation 1712, a band may be advanced into the sleeve to non-separably interlock the band and the sleeve. For example and with reference to FIG. 8A, the band 824 may be advanced into the sleeve 870. In one embodiment, the band 824 may be coupled with one or more engagement members (e.g., such as pins 836) that are configured to non-separably interlock the band 824 to the sleeve 870. For example, the pins 836 may be disposed within the band 824 such that a portion of the pins 836 extend beyond a perimeter of the band 824 for engagement with the sleeve inner surface 874. The engagement of the pins 836 may form a friction or interference fit with the sleeve inner surface 874 that facilitates non-separably interlocking the band 824 with the sleeve 870. Additionally or alternatively, an adhesive layer may be applied between the band 824 and the sleeve 870 to non-separably interlock the band 824 and the sleeve 870.

At operation 1716, a friction element may be secured to an outer surface of the lug. The friction element may be an alignment feature configured to maintain a spacing between the lug 804 and an associated consumer product. For example and with reference to FIG. 8A, the friction elements 812 may be secured to the lug 804 at the openings 818. Various structures may be employed to secure the friction elements 812 to the lug 804, including flanges, anchor pins, shafts, and adhesive layers, according to the embodiments described herein.

Figure 18:
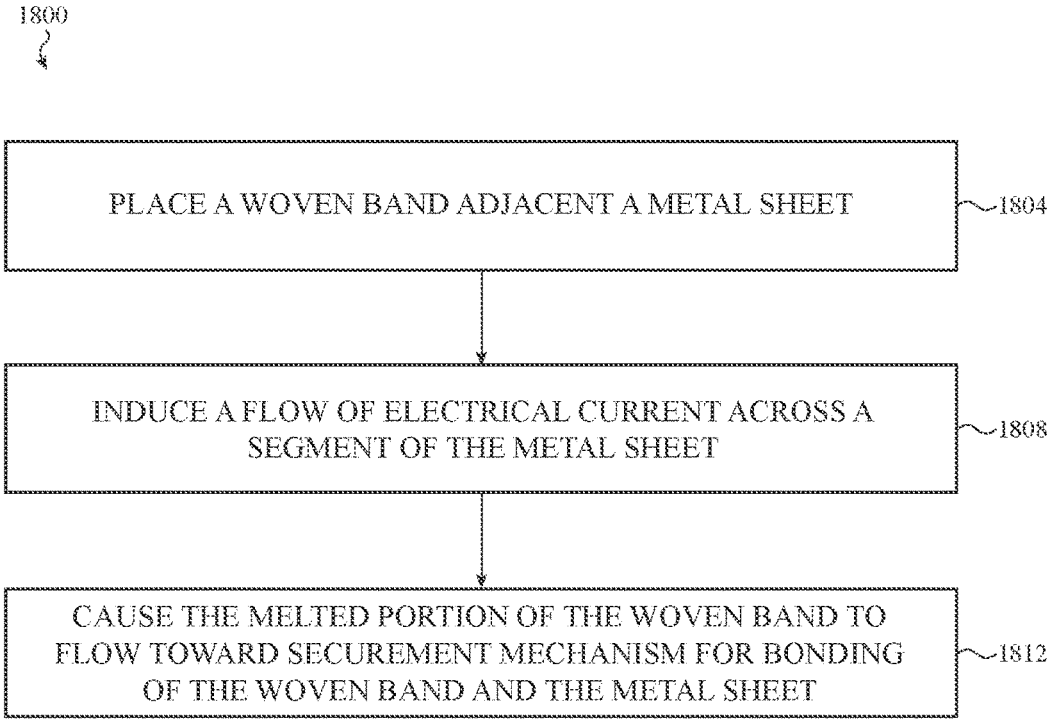
FIG. 18 is a flow diagram of a method for reinforcing a flexible band.

FIG. 18 illustrates a process 1800 that relates generally to reinforcing a strap. For example, the process 1800 may be used to create a reinforced strap, such as band **1400*a* depicted in FIG. 14A. In this regard, at operation 1804, a woven strap may be placed adjacent a metal sheet. For example and with reference to FIG. 16**, the woven strap

1604 may be placed adjacent to the metal sheet 1612. In some instances, the metal sheet 1612 may include one or more securement mechanisms, such as a hole, recess, or other feature that may be configured to facilitate the attachment of the metal sheet 1612 to the woven strap 1604.

At operation 1808, a flow of electrical current may be induced across a segment of the metal sheet. For example and with reference to FIG. 16, an electrical current may be induced between first end 1616 and the second 1620. The inducement of electrical current may be configured to generate heat at the metal sheet 1612. The heat may melt at least a portion of the woven strap 1604 disposed adjacent to the metal sheet 1612.

At operation 1812, the melted portion of the woven strap may be caused to flow toward a securement mechanism for bonding of the woven strap and the metal sheet. For example and with reference to FIG. 16, the application of force "F" on the adjacent woven strap 1604 may cause the melted portion of the woven strap 1604 to flow toward the one or more securement mechanisms 1624 of the metal sheet 1612. For example, the melted portion of the woven strap 1604 may flow toward the securement mechanism 1624 to facilitate the bonding of the woven strap 1604 and the metal sheet 1612. The woven strap 1604 may be joined with the metal sheet 1612 in a manner that may cause at least a portion of the woven strap 1604 (e.g., a portion of the woven strap 1604 opposite the metal sheet 1612) to be substantially free from surface defects.

Figure 19:
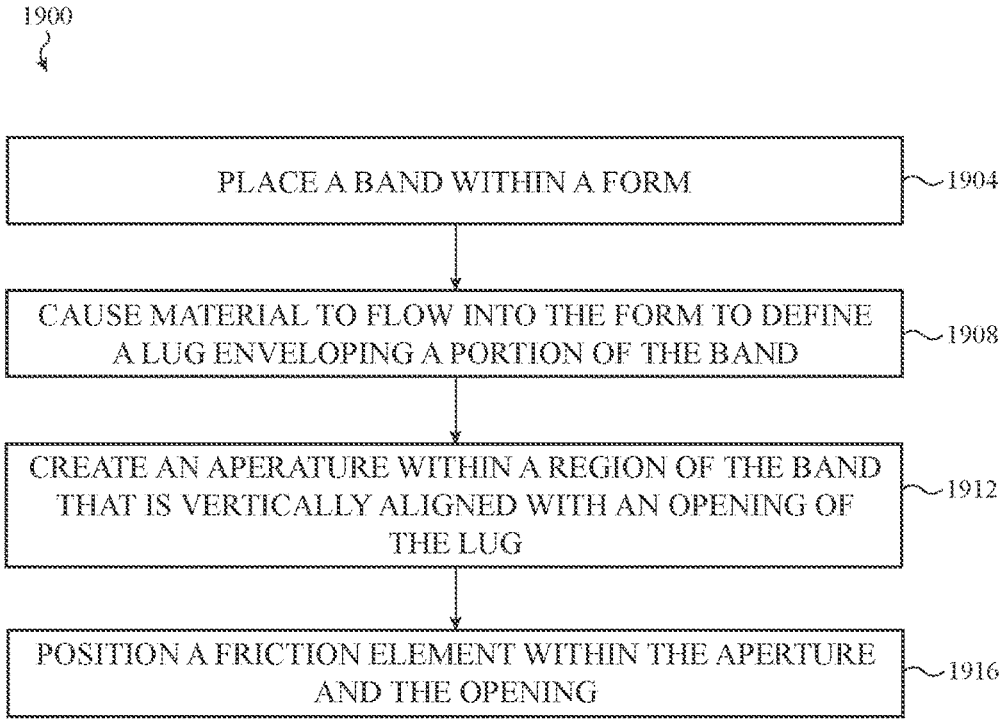
FIG. 19 is a flow diagram of a method for assembling an over-molded attachment system.

FIG. 19 illustrates a process 1900 that relates generally to assembling an over-molded attachment system. At operation 1904, a band may be placed within a form. For example and with reference to FIG. 13A, the band 1324 may be placed within a form that may be constructed to define the shape of a lug that may envelop a portion of the band 1324. In some instances, the band 1324 may include a securement mechanism, for example, including a recess, pin, or other structure that may be configured to facilitate the joining of the band 1324 and the lug. The lug may an attachment structure, housing, or other structure configured for removable engagement with a consumer product.

At operation 1908, material may be caused to flow into the form to define a lug enveloping a portion of the band. For example and with reference to FIG. 13A, an injection-moldable plastic may be caused to flow into the form to envelop a portion of the band 1324 (e.g., the portion of the band 1324 disposed within the form). The injection-moldable plastic may be cooled and hardened. This may cause the injection-moldable plastic to bond to the band 1324 and create the lug 1304.

At operation 1912, an aperture may be created within a region of the band that is vertically aligned with an opening of the lug. For example and with reference to FIG. 13A, the apertures 1332 may be created within the band 1324 such that the apertures 1332 and the opening 1318 are positioned along a common axis. This may be accomplished by cutting or otherwise removing excess material from the band 1324.

At operation 1916, a friction element may be positioned within the aperture and the opening. The friction element may be an alignment feature configured to maintain a spacing between the lug 804 and an associated consumer product. For example and with reference to FIG. 13A, the friction elements 1312 may be secured to the lug 1304 at the opening 1318. Various structures may be employed to secure the friction elements 1312 to the lug 1304, including flanges, anchor pins, shafts, welded connections, and adhesive, according to the embodiments described herein.

Figure 20:
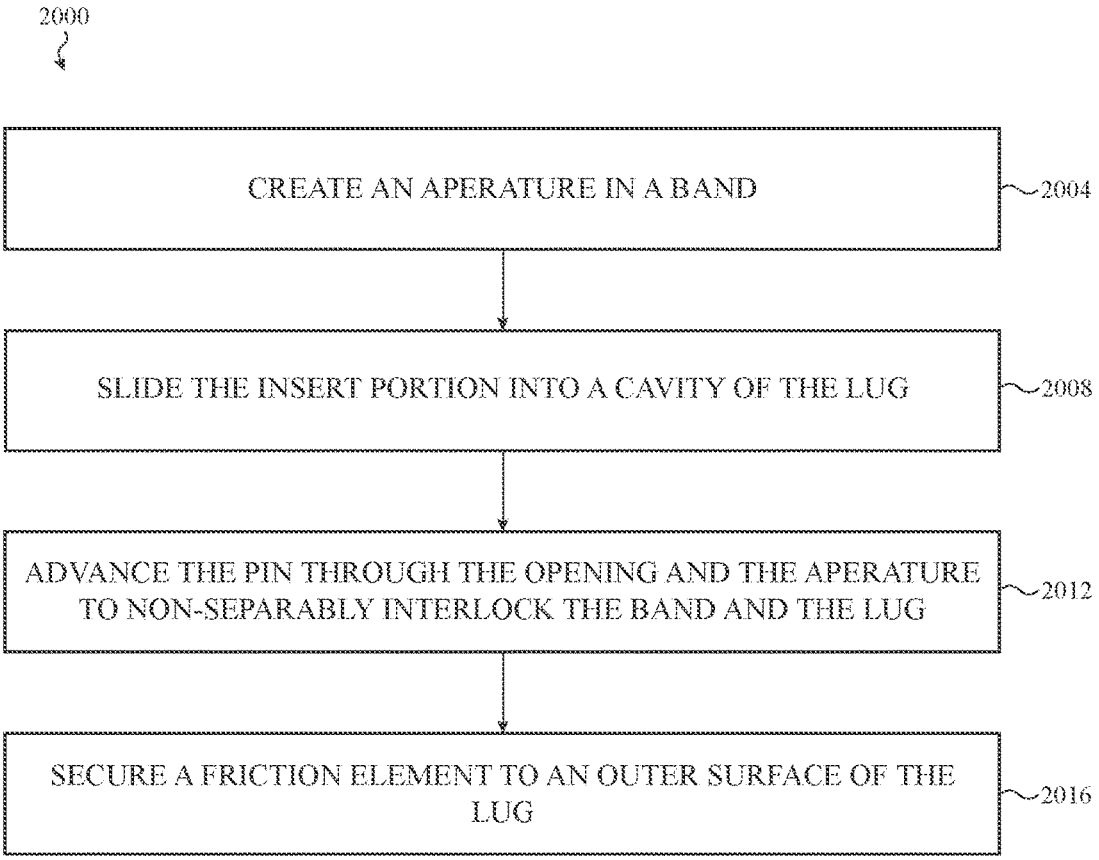
FIG. 20 is a flow diagram of a method for assembling an attachment system.

FIG. 20 illustrates a process 2000 that relates generally to assembling an attachment system for use with a consumer product. At operation 2004, an aperture may be created in a band. For example and with reference to FIG. 6A, the apertures 632 may be created in the band 624 at insert portion 628. The apertures 632 may be created by cutting or otherwise removing excess material from the band 624.

At operation 2008, an insert portion may be slid into a cavity of the lug. The lug may be an attachment structure, housing, or other structure configured for removable engagement with a consumer product. For example and with reference to FIG. 6A, the insert portion 628 may be slid into the cavity 606 via cavity entrance 607. The insert portion 628 may be slid into the cavity 606 such that the apertures 632 may be vertically aligned with the opening 618.

At operation 2012, a pin may be advanced through the opening and the aperture to non-separably interlock the band and the lug. For example and with reference to FIG. 6A, in one embodiment, the ultrasonic pins 636 may be advanced through the openings 618 and the apertures 632 to non-separably interlock the band 624 and the lug 604. In some instances, a high-frequency ultrasonic vibration may be applied to the ultrasonic pins 636 such that a portion of the band 624 (e.g., a surface of the apertures 632 adjacently disposed to the ultrasonic pins 636) may be caused to melt. The melting and subsequent cooling of the melted portion of the band 624 may cause the band 624 to bond to a surface of the ultrasonic pins 636 (e.g., the melted portion of the band 624 may bond to a knurled surface of the ultrasonic pins 636).

At operation 2016, a friction element may be secured to an outer surface of the lug. The friction element may be an alignment feature configured to maintain a spacing between the lug 804 and an associated consumer product. The friction element may be configured to engage a consumer product. For example and with reference to FIG. 6A, the friction elements 612 may be secured to the lug 604 at the openings 618. Various structures may be employed to secure the friction elements 612 to the lug 604, including flanges, anchor pins, shafts, and adhesive layers, according to the embodiments described herein. In one implementation, the friction elements 612 may protrude from an outer surface of the lug 604 for engagement with a consumer product.

Figure 21:
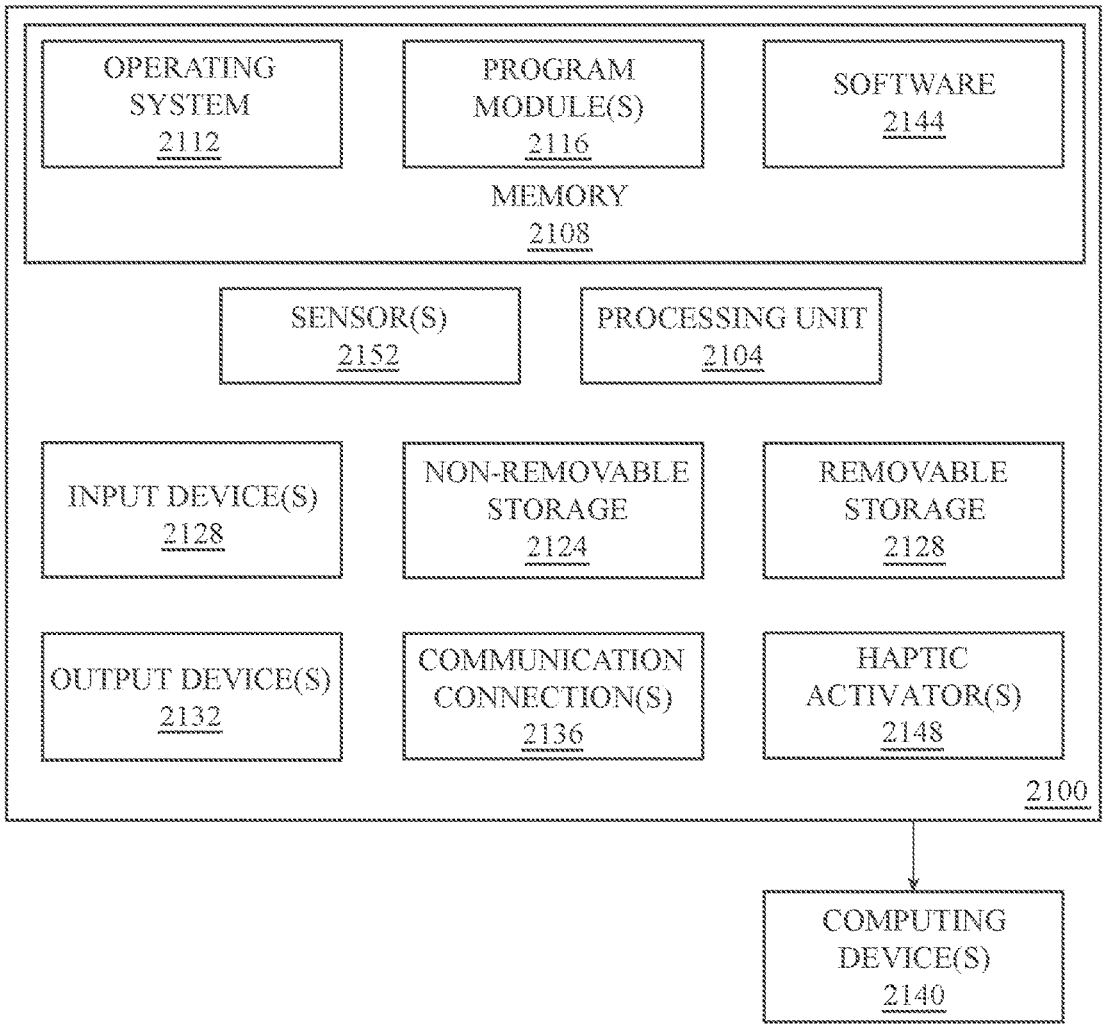
FIG. 21 depicts an example functional block diagram of a system including a consumer product that may be used with one or more embodiments of the present disclosure.

FIG. 21 is a block diagram illustrating example components, such as, for example, hardware components of a consumer product 2100 according to one or more embodiments of the present disclosure. The consumer product 2100 may be similar to the consumer product 108 described above. Although various components of the consumer product 2100 are shown, connections and communication channels between each of the components are omitted for simplicity. As previously discussed, the consumer product may be a wearable device such as a watch or glasses, a tablet computing device, a telecommunications device such as a phone, a laptop computer or the like, a remote control, and so on.

In a basic configuration, the consumer product 2100 may include at least one processor 2104 or processing unit and a memory 2108. The memory 2108 may comprise, but is not limited to, volatile storage, such as random access memory and non-volatile storage such as read-only memory, flash memory, or any combination thereof. The memory 2108 may store an operating system 2112 and one or more program modules 2116 suitable for running software applications 2144. The operating system 2112 may be configured to control the consumer product 2100 and/or one or more software applications 2144 being executed by the operating system 2112. The software applications 2144 may include browser applications, e-mail applications, calendaring applications, contact manager applications, messaging applications, games, media player applications, time keeping applications, and the like.

The consumer product 2100 may have additional features or functionality than those expressly described herein. For example, the consumer product 2100 may also include additional data storage devices such as removable storage device 2128 and non-removable storage device 2124. Examples of such storage devices include magnetic disks, optical disks, or tape.

As also shown in FIG. 21, the consumer product 2100 may include one or more input devices 2128. The input devices 2128 may include a keyboard, a mouse, a pen or stylus, a sound input device, a touch input device, and the like. The consumer product 2100 may also include one or more output devices 2132. The output devices 2132 may include a display, one or more speakers, and the like. The consumer product 2100 may also include one or more haptic actuators 2148 that are used to provide the haptic feedback. In some embodiments, the consumer product 2100 may also include one or more sensors 2152. The sensors may include, but are not limited to, accelerometers, ambient light sensors, gyroscopes, magnetometers and other types of sensors.

The consumer product 2100 may also include communication connections 2136 that facilitate communications with additional computing devices 2140. Such communication connections 2136 may include a RF transmitter, a receiver, and/or transceiver circuitry, universal serial bus (USB) communications, parallel ports and/or serial ports.

The consumer product 2100 may also include a synchronization application or module configured to synchronize applications or data resident on the consumer product 2100 with another computer or device.

The consumer product 2100 may also include a power supply such as a battery, a solar cell, and the like that provides power to each of the components shown. The power supply may also include an external power source, such as an AC adapter or other such connector that supplements or recharges the batteries. The consumer product 2100 may also include a radio that performs the function of transmitting and receiving radio frequency communications. Additionally, communications received by the radio may be disseminated to the application programs. Likewise, communications from the application programs may be disseminated to the radio as needed.

The consumer product 2100 may also include a visual indicator, a keypad and a display. In embodiments, the keypad may be a physical keypad or a virtual keypad generated on a touch screen display. The visual indicator may be used to provide visual notifications to a user of the consumer product. The consumer product 2100 may also include an audio interface for producing audible notifications and alerts.

In certain embodiments, the visual indicator is a light emitting diode (LED) or other such light source and the audio interface is a speaker. In certain embodiments, the audio interface may be configured to receive audio input.

The audio interface may also be used to provide and receive audible signals from a user of the consumer product 2100. For example, a microphone may be used to receive audible input. The system may further include a video interface that enables an operation of an on-board camera to record still images, video, and the like.

In one or more embodiments, data and information generated or captured by the consumer product 2100 may be stored locally. Additionally or alternatively, the data may be stored on any number of storage media that may be accessed by the consumer product using the radio, a wired connection or a wireless connection between the consumer product and a remote computing device. Additionally, data and information may be readily transferred between computing devices.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An attachment system, comprising:
a band having an insert portion;
an aperture within the insert portion;
a lug having a cavity;
a friction element disposed at, and extending away from, an outer surface of the lug and defining a protrusion;
a pin; and
a retention member positioned within the cavity and configured to retain the pin within the aperture upon advancement of at least a portion of the pin past the retention member.

2. The attachment system of claim 1, wherein the retention member comprises a tapered surface extending between a first width and a second width of the cavity.

3. The attachment system of claim 2, wherein:
the second width of the cavity is less than a length of the pin; and
the length of the pin is elastically deformable to the second width of the cavity.

4. The attachment system of claim 3, wherein:
the cavity comprises a groove disposed adjacent the retention member and configured to receive the pin; and
the pin returns to an undeformed shape when received by the groove.

5. The attachment system of claim 1, wherein:
the friction element includes a flange; and
the friction element is connected to the lug at the flange.

6. The attachment system of claim 1, wherein:
the friction element includes an anchor pin; and
the friction element is connected to the lug at the anchor pin.

7. The attachment system of claim 1, wherein:
the friction element is a first friction element;
the protrusion is a first protrusion; and the attachment system further comprises:

a second friction element disposed at, and extending away from, the outer surface of the lug to define a second protrusion; and a catch member disposed between the first friction element and the second friction element at the outer surface, wherein the catch member is configured to move from a first position to a second position as the lug slides relative to a consumer product.

8. The attachment system of claim 1, wherein:

the friction element includes a shaft extending into the cavity of the lug; and the insert portion is configured to receive the shaft when the pin is advanced past the retention member.

9. An attachment system, comprising:

a lug having a cavity;

a band having an insert portion within the cavity;

an aperture within the insert portion;

a friction element protruding away from an outer surface of the lug;

a spring-biased locking mechanism extending through the lug;

a pin within the aperture and preventing movement of the insert portion relative to the lug; and a retention member positioned within the cavity and configured to retain the pin within the aperture upon advancement of at least a portion of the pin past the retention member.

10. The attachment system of claim 9, wherein:

the spring-biased locking mechanism is configured to removably engage the lug with a watch; and the friction element is configured to maintain a spacing between the lug and the watch when the lug is removably engaged with the watch.

11. The attachment system of claim 9, wherein:

the cavity has first and second cavity portions positioned on opposite sides of the spring-biased locking mechanism;

the insert portion comprises two prongs;

a first of the two prongs is received within the first cavity portion;

a second of the two prongs is received within the second cavity portion.

12. The attachment system of claim 9, wherein the spring-biased locking mechanism comprises:

a ramp positioned at a first surface of the lug;

a catch member positioned at a second surface of the lug opposite the first surface; and a spring arranged between the ramp and the catch member and biasing the ramp and the catch member in a direction away from one another.

13. The attachment system of claim 12, wherein the friction element is one of multiple friction elements positioned on the first surface and the second surface of the lug.

14. The attachment system of claim 9, wherein:

the pin has studs positioned on opposing sides of the pin; and the lug comprises multiple receiving grooves arranged along an interior of the cavity and each configured to receive one of the studs.

15. An attachment system, comprising:

a lug having a cavity;

a band having an insert portion within the cavity;

an aperture within the insert portion; a pin within the aperture;

a retention member positioned within the cavity and configured to retain the pin within the aperture; and a friction element positioned over the pin and protruding away from an outer surface of the lug.

16. The attachment system of claim 15, wherein the cavity comprises a spring-biased locking mechanism extending through the lug.

17. The attachment system of claim 16, wherein:

the spring-biased locking mechanism is configured to removably engage the lug with a watch; and the friction element is configured to maintain a spacing between the lug and the watch when the lug is removably engaged with the watch.

18. The attachment system of claim 16, wherein:

the cavity has first and second cavity portions positioned on opposite sides of the spring-biased locking mechanism;

the insert portion comprises two prongs;

a first of the two prongs is received within the first cavity portion;

a second of the two prongs is received within the second cavity portion.

19. The attachment system of claim 16, wherein the spring-biased locking mechanism comprises:

a ramp positioned at a first surface of the lug;

a catch member positioned at a second surface of the lug opposite the first surface; and a spring arranged between the ramp and the catch member and biasing the ramp and the catch member in a direction away from one another.

20. The attachment system of claim 19, wherein the friction element is one of multiple friction elements positioned on the first surface and the second surface of the lug.

* * * * *